US012305323B2

(12) United States Patent
Jang et al.

(10) Patent No.: US 12,305,323 B2
(45) **Date of Patent: *May 20, 2025**

(54) CLOTHES TREATMENT APPARATUS

(71) Applicant: LG Electronics Inc., Seoul (KR)

(72) Inventors: Semin Jang, Seoul (KR); Jaehyung Kim, Seoul (KR); Minji Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/594,591

(22) Filed: Mar. 4, 2024

(65) Prior Publication Data

US 2024/0200260 A1 Jun. 20, 2024

Related U.S. Application Data

(63) Continuation of application No. 17/466,799, filed on Sep. 3, 2021, now Pat. No. 11,959,222.

(30) Foreign Application Priority Data

Sep. 4, 2020 (KR) ..... 10-2020-0113135

(51) Int. Cl.
*D06F 73/02* (2006.01)
*D06F 58/10* (2006.01)
(Continued)

(52) U.S. Cl.
CPC ..... *D06F 73/02* (2013.01); *D06F 58/10* (2013.01); *D06F 58/24* (2013.01); *D06F 2103/28* (2020.02); *D06F 2105/58* (2020.02)

(58) Field of Classification Search
None
See application file for complete search history.

(56) References Cited

U.S. PATENT DOCUMENTS 11,959,222 B2 * 4/2024 Jang ..... D06F 58/24
2004/0206131 A1 10/2004 Kleker
(Continued)

FOREIGN PATENT DOCUMENTS

DE 202012009608 1/2013
KR 20130038659 4/2013
(Continued)

OTHER PUBLICATIONS

Extended European Search Report in European Appln. No. 21194973.0, dated Jan. 26, 2022, 11 pages.
(Continued)

*Primary Examiner* — Cristi J Tate-Sims
(74) *Attorney, Agent, or Firm* — Fish & Richardson P.C.

(57) ABSTRACT

The present disclosure relates to a cabinet including an inlet on a front side thereof; a first chamber positioned inside the cabinet and defining a space for accommodating clothes through the inlet; a second chamber positioned under the first chamber and defining a space separated from the first chamber; a hanger bar positioned in the first chamber and configured to hold the clothes accommodated in the first chamber; and a driver including: a motor configured to generate torque; a vibrating body configured to support the motor and vibrate alternately in a first rotation direction and a second rotation direction opposite to the first rotation direction by rotation of the motor; and a motion converter configured to rotate together with the vibrating body and convert the vibration of the vibrating body in connection with the hanger bar such that the hanger bar reciprocates along a predetermined movement direction, wherein the hanger bar is configured to reciprocate with different amplitudes and periods depending on a number of times that the motor rotates.

20 Claims, 23 Drawing Sheets

(51) Int. Cl.

| | |
|---|---|
| ***D06F 58/24*** | (2006.01) |
| *D06F 103/28* | (2020.01) |
| *D06F 105/58* | (2020.01) |

(56) References Cited

U.S. PATENT DOCUMENTS

| | | | | |
|---|---|---|---|---|
| 2010/0043500 | A1 | 2/2010 | Yoo et al. | |
| 2011/0107617 | A1 | 5/2011 | Lee et al. | |
| 2013/0086830 | A1 | 4/2013 | Moon et al. | |
| 2019/0385017 | A1 | 12/2019 | Hwang et al. | |
| 2021/0363683 | A1* | 11/2021 | Kim | D06F 58/12 |

FOREIGN PATENT DOCUMENTS

| | | |
|---|---|---|
| KR | 101285890 | 7/2013 |
| KR | 101780223 | 10/2017 |
| KR | 20170137505 | 12/2017 |
| KR | 20190068275 | 6/2019 |
| KR | 20190068429 | 6/2019 |
| WO | WO 2019112354 | 6/2019 |

OTHER PUBLICATIONS

International Search Report and Written Opinion in International Appln. No. PCT/KR2021/011935, dated Dec. 27, 2021, 9 pages.

* cited by examiner

| Process | Preheating | Steam supply and standby | Wrinkle removal | Drying |
|---|---|---|---|---|
| Driver (hanger bar) | ON | ON | ON | ON |
| Blowing fan | ON | ON | ON | ON |
| Compressor | OFF | OFF | OFF | ON |
| Heater | ON (steam spray X) | (steam spray O) → OFF | OFF | OFF |

CLOTHES TREATMENT APPARATUS

CROSS-REFERENCE TO RELATED APPLICATIONS

This application is a continuation of U.S. application Ser. No. 17/466,799, filed on Sep. 3, 2021, which claims the benefit of Korean Patent Application No. 10-2020-0113135, filed on Sep. 4, 2020, which are hereby incorporated by reference as if fully set forth herein.

TECHNICAL FIELD

The present disclosure relates to a clothes treatment apparatus, and more particularly, to a clothes treatment apparatus having a clothes supporter for holding clothes and clothes treatment courses thereof.

BACKGROUND

A clothes treatment apparatus refers to an apparatus designed to wash and dry clothes and eliminate wrinkles on clothes at home or laundry. The clothes treatment apparatus may include a washing machine for washing clothes, a dryer for drying clothes, a washing/drying machine with both washing and drying functions, and a clothes management apparatus for refreshing clothes, a steamer for removing wrinkles from clothes.

The steamer is an apparatus for supplying steam to clothes to remove wrinkles. The steamer removes wrinkles by applying heat to clothes through convection, unlike a regular iron that applies heat to clothes directly (for example, by contacting a hard object with clothes).

The clothes management apparatus is an apparatus for keeping clothes pleasant and clean. The clothes treatment apparatus may remove fine dust attached to clothes, deodorize clothes, dry clothes, and add fragrance to clothes. In addition, the clothes treatment apparatus may prevent the generation of static electricity, remove wrinkles from clothes through dehumidified air or steam, and sterilize clothes.

In particular, the clothes treatment apparatus may include a clothes supporter configured to shake clothes in order to better implement fine dust removal, wrinkle removal, and clothes drying. In other words, the clothes management apparatus may include the clothes supporter configured to allow a hanger bar for clothes to reciprocate in a predetermined direction.

Some clothes supporter capable of reciprocating include a driver configured to remove wrinkles and dust from clothes by reciprocating a hanger bar on which hangers for clothes are hung. When the rotation speed of the driver changes, the period (or frequency) of the hanger bar varies, but the driver is capable of maintaining the amplitude of the hanger bar. However, on the premise that the amplitude of the hanger bar is constant, there are physical limitations in decreasing the period of the hanger bar or increasing only the corresponding frequency is physically limited.

Some example methods of controlling courses for clothes treatment include removing wrinkles from mounted clothes by providing steam and operating a heat pump during a drying process only, and there is no mention about the amplitude and period of a hanger bar for maximizing the moisture content and improving clothes drying.

SUMMARY

Accordingly, the present disclosure is directed to a clothes treatment apparatus that substantially obviates one or more problems due to limitations and disadvantages of the related art.

An object of the present disclosure is to provide a clothes treatment apparatus capable of changing the amplitude and period of a hanger bar for holding clothes to perform functions such as removing dust from clothes or removing wrinkles from clothes.

Another object of the present disclosure is to minimize unnecessary vibration of the hanger bar in a direction other than the movement direction.

Another object of the present disclosure is to effectively increase the driving force (or excitation force) required to move the hanger bar in the movement direction by minimizing the unnecessary vibration.

Another object of the present disclosure is to improve the performance of clothes management functions by using the amplitude and period of the hanger bar suitable for each clothes management function.

Another object of the present disclosure is to minimize unnecessary noise and vibration by changing the amplitude and period of the hanger bar.

Another object of the present disclosure is to change the amplitude and period of the hanger bar to prevent the product from being damaged.

Another object of the present disclosure is to provide amplitudes and periods suitable for various clothes management functions such as removing wrinkles from clothes, removing dust from clothes, maximizing the moisture content of clothes during steam supply, and improving clothes drying.

Another object of the present disclosure is to provide a clothes management course for improving the performance of clothes management by combining various clothes management functions.

A further object of the present disclosure is to increase user's convenience and satisfaction by improving the durability of the product.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, particular implementations of the present application provide a clothes treatment apparatus that includes a cabinet defining an inlet, a first chamber positioned inside the cabinet and configured to accommodate clothes through the inlet, a second chamber positioned under the first chamber and separated from the first chamber, a hanger bar positioned in the first chamber and configured to hold the clothes accommodated in the first chamber, and a driver. The driver may include a motor, a vibrating body configured to support the motor and, based on rotation of the motor, vibrate by rotating alternately in a first rotation direction and a second rotation direction opposite to the first rotation direction, and a motion converter configured to rotate together with the vibrating body and convert the vibration of the vibrating body to cause the hanger bar to reciprocate. The hanger bar may be configured to reciprocate with different amplitudes and periods depending on a rotation of the motor.

In some implementations, the clothes treatment apparatus may optionally include one or more of the following features. The hanger bar is configured to reciprocate at an amplitude that varies depending on a reciprocating period of the hanger bar. The hanger bar is configured to reciprocate in either a first mode or a second mode. The hanger bar is configured to, in the first mode, reciprocate at a first frequency and a first amplitude, the first frequency being smaller than a resonance frequency of the driver, and the first amplitude being determined based on the first frequency. The hanger bar is configured to, in the second mode, reciprocate at a second frequency and a second amplitude, the second frequency being greater than the resonance frequency, and the second amplitude being determined based on the second frequency. The hanger bar is configured to reciprocate in one of the first mode, the second mode, and a third mode. The hanger bar is configured to, in the third mode, reciprocate at a third frequency and a third amplitude, the third frequency being between the first and second frequencies, and the third amplitude being determined based on the third frequency. The third amplitude is greater than the first amplitude and the second amplitude. The hanger bar is configured to reciprocate in one of the first mode, the second mode, the third mode, and a fourth mode. The hanger bar is configured to, in the fourth mode, reciprocate at a fourth frequency and a fourth amplitude, the fourth frequency being greater than the third frequency, and the fourth amplitude being determined based on the fourth frequency. The fourth amplitude is smaller than the first amplitude, the second amplitude, and the third amplitude. The hanger bar is configured to reciprocate in the third mode for at least part of a total wrinkle removal time during which wrinkles are removed from the clothes being accommodated in the first chamber. The hanger bar is configured to reciprocate in the first mode for a first wrinkle removal time. The hanger bar is configured to, based on the first wrinkle removal time elapsing, reciprocate in the third mode for a second wrinkle removal time. The hanger bar is configured to, during a total wrinkle removal time, reciprocate repeatedly in the first mode for the first wrinkle removal time and in the third mode for the second wrinkle removal time. The hanger bar is configured to reciprocate in the third mode for a first wrinkle removal time. The hanger bar is configured to, based on the first wrinkle removal time elapsing, reciprocate in the second mode for a second wrinkle removal time. The hanger bar is configured to, during a total wrinkle removal time, reciprocate repeatedly in the third mode for the first wrinkle removal time and in the second mode for the second wrinkle removal time. The hanger bar is configured to reciprocate in the second mode for a first wrinkle removal time. The hanger bar is configured to, based on the first wrinkle removal time elapsing, reciprocate in the fourth mode for a second wrinkle removal time. The hanger bar is configured to, based on the second wrinkle removal time elapsing, reciprocate in the third mode for a third wrinkle removal time. The hanger bar is configured to, during a total wrinkle removal time, reciprocate repeatedly in the second mode for the first wrinkle removal time, in the fourth mode for the second wrinkle removal time, and in the third mode for the third wrinkle removal time. The hanger bar is configured to reciprocate in the second mode for at least part of a total dust removal time during which dust is removed from the clothes being accommodated in the first chamber. The hanger bar is configured to reciprocate in the second mode for a first dust removal time. The hanger bar is configured to, based on the first dust removal time elapsing, reciprocate in the fourth mode for a second dust removal time. The hanger bar is configured to, based on the second dust removal time elapsing, reciprocate in the third mode for a third dust removal time. The hanger bar is configured to, during a total dust removal time, reciprocate repeatedly in the second mode for the first dust removal time, in the fourth mode for the second dust removal time, and in the third mode for the third dust removal time. The hanger bar is configured to reciprocate in the second mode for a first volume time. The hanger bar is configured to, based on the first volume time elapsing, reciprocate in the fourth mode for a second volume time. The hanger bar is configured to, based on the second volume time elapsing, reciprocate in the third mode for a third volume time. The hanger bar is configured to, during a total volume time, reciprocate repeatedly in the second mode for the first volume time, in the fourth mode for the second volume time, and in the third mode for the third volume time. The reciprocation of the hanger bar is configured to, during the total volume time, maintain or increase a thickness of the clothes being accommodated in the first chamber. The clothes treatment apparatus may include a heat pump positioned inside the second chamber, the heat pump being configured to dehumidify and heat air being suctioned from the first chamber and discharge the air into the first chamber. The clothes treatment apparatus may include a steamer positioned inside the second chamber and configured to generate and supply steam to the first chamber. The steamer is configured to supply the steam to the first chamber for a steam supply time. The heat pump is configured to, based on the steamer supplying the steam to the first chamber for the steam supply time, discharge the dehumidified and heated air to the first chamber. The hanger bar is configured to, based on the heat pump discharging the dehumidified and heated air to the first chamber, reciprocate in the first mode for at least part of a total drying time. The clothes treatment apparatus may include a heat pump positioned inside the second chamber. The heat pump is configured to dehumidify and heat air being suctioned from the first chamber and discharge the air into the first chamber. The clothes treatment apparatus may include a steamer positioned inside the second chamber and configured to generate and supply steam to the first chamber. The steamer is configured to supply the steam to the first chamber for a steam supply time. The heat pump is configured to, based on the steamer supplying the steam to the first chamber for the steam supply time, discharge the dehumidified and heated air to the first chamber. The hanger bar is configured to, based on the heat pump discharging the dehumidified and heated air to the first chamber, reciprocate in the second mode for a first drying time. The hanger bar is configured to, based on the first drying time elapsing, reciprocate in the third mode for a second drying time. The hanger bar is configured to, based on the second drying time elapsing, reciprocate in the first mode for a third drying time. The hanger bar is configured to reciprocate in the fourth mode for a first restoration time. The hanger bar is configured to, based on the first restoration time elapsing, reciprocate in the third mode for a second restoration time. The hanger bar is configured to, during a total restoration time, reciprocate repeatedly in the fourth mode for the first restoration time and in the third mode for the second restoration time. The reciprocation of the hanger bar is configured to, during the total restoration time, maintain or increase a thickness of the clothes being accommodated in the first chamber. The hanger bar is configured to reciprocate in the fourth mode for a first restoration time. The hanger bar is configured to, based on the first restoration time elapsing, reciprocate in the third mode for a second restoration time. A sum of the first restoration time and the second restoration time is equal to a total restoration time. The reciprocation of the hanger bar is configured to, during the total restoration time, maintain or increase a thickness of the clothes being accommodated in the first chamber. The driver may include at least one driver elastic member configured to, based on rotation of the vibrating body, apply elastic force. The vibrating body may include a first eccentric part connected to the motor and configured to rotate a first eccentric weight around a first rotation axis parallel to a motor rotation shaft, and a second eccentric part connected to the motor and configured to rotate a second eccentric weight around a second rotation axis parallel to the motor rotation shaft. The second rotation axis is located opposite to the first rotation axis with respect to the motor rotation shaft along a width direction of the cabinet. The vibrating body is configured to rotatably support the motor, the first eccentric part, and the second eccentric part. The first eccentric part and the second eccentric part are configured to rotate based on rotation of the motor and vibrate the vibrating body alternately in the first rotation direction and the second rotation direction. A center of mass of the first eccentric part has a phase difference of 180 degrees from a center of mass of the second eccentric part. A rotation direction of the first eccentric part is the same as a rotation direction of the second eccentric part. The clothes treatment apparatus may include a slot positioned in the hanger bar and configured to convert reciprocation of the motion converter into reciprocation of the hanger bar. The motion converter protrudes from the vibrating body and is inserted into the slot.

Particular implementations of the present application provide a clothes treatment apparatus that includes a cabinet defining an inlet, a door rotatably coupled to the cabinet and configured to open and close the inlet, a first chamber positioned inside the cabinet and configured to accommodate clothes through the inlet, a second chamber positioned under the first chamber and being separated from the first chamber, a hanger bar positioned in the first chamber and configured to hold the clothes accommodated in the first chamber, a motor configured to generate torque around a direction parallel to a height direction of the door, a vibrating body configured to, based on rotation of the motor, rotate alternately in a first rotation direction and a second rotation direction opposite to the first rotation direction, and a motion converter having (i) a first end configured to be rotated together with the vibrating body and (ii) a second end connected to the hanger bar, the motion converter configured to convert movement of the vibrating body to cause the hanger bar to reciprocate along a width direction of the door. The hanger bar is configured to reciprocate with different amplitudes and periods depending on a rotation of the motor.

To achieve these objects and other advantages and in accordance with the purpose of the disclosure, as embodied and broadly described herein, a clothes treatment apparatus including a clothes supporter or moving hanger configured to change the amplitude of the hanger bar depending on the period (or frequency) of the hanger bar is provided.

The clothes treatment apparatus may include: a cabinet including an inlet on a front side thereof; a first chamber positioned inside the cabinet and defining a space for accommodating clothes through the inlet; a second chamber positioned under the first chamber and defining a space separated from the first chamber; a hanger bar positioned in the first chamber and configured to hold the clothes accommodated in the first chamber; and a driver. The driver may include: a motor configured to generate torque; a vibrating body configured to support the motor and vibrate alternately in a first rotation direction and a second rotation direction opposite to the first rotation direction by rotation of the motor; and a motion converter configured to rotate together with the vibrating body and convert the vibration of the vibrating body in connection with the hanger bar such that the hanger bar reciprocates along a predetermined movement direction. The hanger bar may be configured to reciprocate with different amplitudes and periods depending on a number of times that the motor rotates.

While the hanger bar reciprocates, an amplitude of the hanger bar may vary depending on a period of the hanger bar or a frequency of the hanger bar related to the period of the hanger bar.

The hanger bar may be configured to reciprocate in either a first mode or a second mode. The first mode may allow the hanger bar to reciprocate at a predetermined first frequency smaller than a resonance frequency of the driver and a first amplitude depending on the first frequency, and the second mode may allow the hanger bar to reciprocate at a predetermined second frequency greater than the resonance frequency and a second amplitude depending on the second frequency.

The hanger bar may be configured to reciprocate in one of the first mode, the second mode, and a third mode that allows the hanger bar to reciprocate at a third frequency between the first and second frequencies and a third amplitude depending on the third frequency, where the third amplitude may be greater than the first amplitude and the second amplitude.

The hanger bar may be configured to reciprocate in one of the first mode, the second mode, the third mode, and a fourth mode that allows the hanger bar to reciprocate at a predetermined fourth frequency greater than the third frequency and a fourth amplitude depending on the fourth frequency, where the fourth amplitude may be smaller than the first amplitude, the second amplitude, and the third amplitude.

The hanger bar may be configured to reciprocate in the third mode for at least part of a predetermined total wrinkle removal time to remove wrinkles from the clothes accommodated in the first chamber.

The hanger bar may be configured to reciprocate in the first mode for a predetermined first wrinkle removal time. The hanger bar may be configured to reciprocate in the third mode for a predetermined second wrinkle removal time after the first wrinkle removal time elapses. During a predetermined total wrinkle removal time, the hanger bar may be configured to reciprocate repeatedly in the first mode for the first wrinkle removal time and in the third mode for the second wrinkle removal time.

The hanger bar may be configured to reciprocate in the third mode for a predetermined first wrinkle removal time. The hanger bar may be configured to reciprocate in the second mode for a predetermined second wrinkle removal time after the first wrinkle removal time elapses. During a predetermined total wrinkle removal time, the hanger bar may be configured to reciprocate repeatedly in the third mode for the first wrinkle removal time and in the second mode for the second wrinkle removal time.

The hanger bar may be configured to reciprocate in the second mode for a predetermined first wrinkle removal time. The hanger bar may be configured to reciprocate in the fourth mode for a predetermined second wrinkle removal time after the first wrinkle removal time elapses. The hanger bar may be configured to reciprocate in the third mode for a predetermined third wrinkle removal time after the second wrinkle removal time elapses. During a predetermined total wrinkle removal time, the hanger bar may be configured to reciprocate repeatedly in the second mode for the first wrinkle removal time, in the fourth mode for the second wrinkle removal time, and in the third mode for the third wrinkle removal time.

The hanger bar may be configured to reciprocate in the second mode for at least part of a predetermined total dust removal time to remove dust from the clothes accommodated in the first chamber.

The clothes treatment apparatus may further include a dust sensor positioned in the first chamber and configured to detect dust concentration in the first chamber. The predetermined total dust removal time may be variable depending on the dust concentration detected by the dust sensor.

The hanger bar may be configured to reciprocate in the second mode for a predetermined first dust removal time. The hanger bar may be configured to reciprocate in the fourth mode for a predetermined second dust removal time after the first dust removal time elapses. The hanger bar may be configured to reciprocate in the third mode for a predetermined third dust removal time after the second dust removal time elapses. During a predetermined total dust removal time, the hanger bar may be configured to reciprocate repeatedly in the second mode for the first dust removal time, in the fourth mode for the second dust removal time, and in the third mode for the third dust removal time.

The clothes treatment apparatus may further include a dust sensor positioned in the first chamber and configured to detect dust concentration in the first chamber. The first dust removal time may be variable depending on the dust concentration detected by the dust sensor.

The hanger bar is configured to reciprocate in the second mode for a predetermined first volume time. The hanger bar is configured to reciprocate in the fourth mode for a predetermined second volume time after the first volume time elapses. The hanger bar is configured to reciprocate in the third mode for a predetermined third volume time after the second volume time elapses. During a predetermined total volume time, the hanger bar is configured to reciprocate repeatedly in the second mode for the first volume time, in the fourth mode for the second volume time, and in the third mode for the third volume time. A thickness of the clothes accommodated in the first chamber after the total volume time elapses may be greater than or equal to a thickness of the clothes before being accommodated in the first chamber.

The clothes treatment apparatus may further include: a heat pump positioned inside the second chamber and configured to dehumidify and heat air sucked from the first chamber and discharge the air into the first chamber; and a steamer positioned inside the second chamber and configured to generate and supply steam. While the heat pump operates after the steamer supplies the steam to the first chamber for a predetermined steam supply time, the hanger bar may be configured to reciprocate in the first mode for at least part of a predetermined total drying time.

The clothes treatment apparatus may further include: a heat pump positioned inside the second chamber and configured to dehumidify and heat air sucked from the first chamber and discharge the air into the first chamber; and a steamer positioned inside the second chamber and configured to generate and supply steam. While the heat pump operates after the steamer supplies the steam to the first chamber for a predetermined steam supply time, the hanger bar may be configured to reciprocate in the second mode for a predetermined first drying time. The hanger bar may be configured to reciprocate in the third mode for a predetermined second drying time after the first drying time elapses. The hanger bar may be configured to reciprocate in the first mode for a predetermined third drying time after the second drying time elapses.

The hanger bar may be configured to reciprocate in the fourth mode for a predetermined first restoration time. The hanger bar may be configured to reciprocate in the third mode for a predetermined second restoration time after the first restoration time elapses. During a predetermined total restoration time, the hanger bar may be configured to reciprocate repeatedly in the fourth mode for the first restoration time and in the third mode for the second restoration time. A thickness of the clothes accommodated in the first chamber after the total restoration time elapses may be greater than or equal to a thickness of the clothes before being accommodated in the first chamber.

The hanger bar may be configured to reciprocate in the fourth mode for a predetermined first restoration time. The hanger bar may be configured to reciprocate in the third mode for a predetermined second restoration time after the first restoration time elapses. A sum of the first restoration time and the second restoration time may be equal to a predetermined total restoration time. A thickness of the clothes accommodated in the first chamber after the total restoration time elapses may be greater than or equal to a thickness of the clothes before being accommodated in the first chamber.

The driver may further include at least one driver elastic member configured to apply elastic force while the vibrating body rotates. The vibrating body may include: a first eccentric part connected to the motor and configured to rotate an eccentric weight around a first rotation axis parallel to a motor rotation shaft; and a second eccentric part connected to the motor and configured to rotate an eccentric weight around a second rotation axis parallel to the motor rotation shaft, wherein the second rotation axis may be located opposite to the first rotation axis with respect to the motor rotation shaft along a width direction of the cabinet. The vibration body may be configured to rotatably support the motor, the first eccentric part, and the second eccentric part. The first eccentric part and the second eccentric part may be configured to rotate by the rotation of the motor and vibrate the vibrating body alternately in the first rotation direction and the second rotation direction.

Centers of mass of the first and second eccentric parts may have a phase difference of 180 degrees, and rotation directions of the first and second eccentric parts may be equal to each other.

The clothes treatment apparatus may further include a slot positioned in the hanger bar and configured to convert reciprocation of the motion converter into reciprocation in the movement direction. The motion converter configured to rotate together with the vibrating body may protrude from the vibrating body and be inserted into the slot.

The clothes treatment apparatus may further include an upper panel defining an upper surface of the cabinet. The driver may be positioned between the first chamber and the upper panel.

The clothes treatment apparatus may further include: a first support bar and a second support bar configured to support both ends of the hanger bar such that the hanger bar is capable of reciprocating; a support frame positioned between the first chamber and the upper panel and configured to support the driver; a first fixer and a second fixer configured to rotatably support the first support bar and the second support bar in the support frame; and a first chamber upper surface defining an upper surface of the first chamber. The support frame may include: a central through-hole penetrating the support frame in a height direction of the cabinet; and a first support through-hole and a second support through-hole positioned opposite to each other with respect to the central through-hole along a width direction of the cabinet and penetrating the support frame in the height direction of the cabinet. The first chamber upper surface further may include: a motion converter communication hole matching with the central through-hole and penetrating the first chamber upper surface; and a first upper communication hole and a second upper communication hole respectively matching with to the first support through-hole and the second support through-hole and penetrating the first chamber upper surface. The first support bar may be coupled to the first fixer and inserted into the first support through-hole and the first upper communication hole so that the first support bar may be connected to a first end of the hanger bar, and the second support bar may be coupled to the second fixer and inserted into the second support through-hole and the second upper communication hole so that the second support bar may be connected to a second end of the hanger bar.

When the hanger bar reciprocates, the reciprocation may include at least the third mode.

The clothes treatment apparatus may include: a cabinet including an inlet on a front side thereof; a door rotatably coupled to the cabinet and configured to open and close the inlet; a first chamber positioned inside the cabinet and defining a space for accommodating clothes through the inlet; a second chamber positioned under the first chamber and defining a space separated from the first chamber; a hanger bar positioned in the first chamber and configured to hold the clothes accommodated in the first chamber; a motor configured to generate torque in a direction parallel to a height direction of the door as an axis direction; a vibrating body configured to rotate alternately in a first rotation direction and a second rotation direction opposite to the first rotation direction by rotation of the motor; and a motion converter having a first end rotated together with the vibrating body and a second end connected to the hanger bar and configured to convert the movement of the vibrating body such that the hanger bar reciprocates along a width direction of the door. The hanger bar may be configured to reciprocate with different amplitudes and periods depending on a number of times that the motor rotates.

The clothes treatment apparatus may include: a cabinet including an inlet on a front side thereof; a first chamber positioned inside the cabinet and defining a space for accommodating clothes through the inlet; a second chamber positioned under the first chamber and defining a space separated from the first chamber; a blowing fan positioned inside the second chamber and configured to suck air from the first chamber; a heat pump including a compressor configured to compress a refrigerant for heat exchange with the air sucked by the blower fan and configured to discharge the heat-exchanged air to the first chamber; a steamer positioned inside the second chamber and configured to generate and supply steam; a water supply tank positioned in front of the second chamber and configured to supply water to the steamer; a water drain tank positioned in front of the second chamber and configured to store condensed water generated in the first chamber and the heat pump; a hanger bar positioned in the first chamber and configured to hold the clothes accommodated in the first chamber; and a driver. The driver may include: a motor configured to generate torque; a vibrating body configured to support the motor and vibrate alternately in a first rotation direction and a second rotation direction opposite to the first rotation direction by rotation of the motor; and a motion converter configured to rotate together with the vibrating body and convert the vibration of the vibrating body to allow the hanger bar to reciprocate along a predetermined movement direction in connection with the hanger bar. The hanger bar may be configured to reciprocate with different amplitudes and periods depending on a number of times that the motor rotates.

While the hanger bar reciprocates, an amplitude of the hanger bar may vary depending on a period of the hanger bar or a frequency of the hanger bar related to the period of the hanger bar.

The hanger bar may be configured to reciprocate in either a first mode or a second mode. The first mode may allow the hanger bar to reciprocate at a predetermined first frequency smaller than a resonance frequency of the driver and a first amplitude depending on the first frequency, and the second mode may allow the hanger bar to reciprocate at a predetermined second frequency greater than the resonance frequency and a second amplitude depending on the second frequency.

The hanger bar may be configured to reciprocate in one of the first mode, the second mode, and a third mode that allows the hanger bar to reciprocate at a third frequency between the first and second frequencies and a third amplitude depending on the third frequency, where the third amplitude may be greater than the first amplitude and the second amplitude.

The hanger bar may be configured to reciprocate in one of the first mode, the second mode, the third mode, and a fourth mode that allows the hanger bar to reciprocate at a predetermined fourth frequency greater than the third frequency and a fourth amplitude depending on the fourth frequency, where the fourth amplitude may be smaller than the first amplitude, the second amplitude, and the third amplitude.

The steamer may include: a storage configured to store the water supplied from the water supply tank; and a heater configured to heat the water stored in the storage or supplied from the water supply tank. The steamer may be configured to heat the water through the heater for a predetermined steam preheating time to generate the steam.

The hanger bar may be configured to reciprocate in the second mode for at least part of the steam preheating time.

The steamer may be configured to supply the steam into the first chamber for a predetermined steam supply time after the steam preheating time elapses.

The hanger bar may be configured to reciprocate in the fourth mode for at least part of the steam supply time.

The steamer may be configured to stop heating the water through the heater after the steam supply time elapses. The hanger bar may be configured to reciprocate in the fourth mode for a standby time.

The hanger bar may be configured to reciprocate in the third mode for a predetermined total wrinkle removal process time after the standby time elapses.

The hanger bar may be configured to reciprocate in the third mode for a predetermined first wrinkle removal process time after the standby time elapses.

The hanger bar may be configured to reciprocate in one of the second mode and the fourth mode for a predetermined second wrinkle removal process time after the first wrinkle removal process time elapses.

The hanger bar may be configured to reciprocate in the other one of the second mode and the fourth mode for a predetermined third wrinkle removal process time after the second wrinkle removal process time elapses. The predetermined total wrinkle removal process time may be equal to a sum of the first wrinkle removal process time, the second wrinkle removal process time, and the third wrinkle removal process time.

The compressor may be configured to operate for a predetermined drying process time after the total wrinkle removal process time elapses. The hanger bar may be configured to reciprocate in the first mode for the drying process time.

The blowing fan may be configured to rotate at a first rotation speed for the steam preheating time.

The blowing fan may be configured to rotate at a second rotation speed for the steam supply time.

The blowing fan may be configured to rotate at a third rotation speed for the standby time.

The blowing fan may be configured to rotate at a fourth rotation speed for the total wrinkle removal process time.

A rotation speed of the blowing fan for the first wrinkle removal process time may be different from at least one of a rotation speed of the blowing fan for the second wrinkle removal process time or a rotation speed of the blowing fan for the third wrinkle removal process time.

The blowing fan may be configured to rotate at a fifth rotation speed for the drying process time.

The blowing fan may be configured to rotate while the hanger bar reciprocates.

The hanger bar may be configured to reciprocate in the first mode while the compressor operates.

The driver may further include at least one driver elastic member configured to apply clastic force while the vibrating body rotates. The vibrating body may include: a first eccentric part connected to the motor and configured to rotate an eccentric weight around a first rotation axis parallel to a motor rotation shaft; and a second eccentric part connected to the motor and configured to rotate an eccentric weight around a second rotation axis parallel to the motor rotation shaft, wherein the second rotation axis may be located opposite to the first rotation axis with respect to the motor rotation shaft along a width direction of the cabinet. The vibration body may be configured to rotatably support the motor, the first eccentric part, and the second eccentric part. The first eccentric part and the second eccentric part may be configured to rotate by the rotation of the motor and vibrate the vibrating body alternately in the first rotation direction and the second rotation direction.

Centers of mass of the first and second eccentric parts may have a phase difference of 180 degrees, and rotation directions of the first and second eccentric parts may be equal to each other.

The clothes treatment apparatus may further include a slot positioned in the hanger bar and configured to convert reciprocation of the motion converter into reciprocation in the movement direction. The motion converter configured to rotate together with the vibrating body may protrude from the vibrating body and be inserted into the slot.

The clothes treatment apparatus may further include an upper panel defining an upper surface of the cabinet. The driver may be positioned between the first chamber and the upper panel.

The clothes treatment apparatus may further include: a first support bar and a second support bar configured to support both ends of the hanger bar such that the hanger bar is capable of reciprocating; a support frame positioned between the first chamber and the upper panel and configured to support the driver; a first fixer and a second fixer configured to rotatably support the first support bar and the second support bar in the support frame; and a first chamber upper surface defining an upper surface of the first chamber. The support frame may include: a central through-hole penetrating the support frame in a length direction of the cabinet; and a first support through-hole and a second support through-hole positioned opposite to each other with respect to the central through-hole along a width direction of the cabinet and penetrating the support frame in the length direction of the cabinet. The first chamber upper surface further may include: a motion converter communication hole matching with the central through-hole and penetrating the first chamber upper surface; and a first upper communication hole and a second upper communication hole respectively matching with to the first support through-hole and the second support through-hole and penetrating the first chamber upper surface. The first support bar may be coupled to the first fixer and inserted into the first support through-hole and the first upper communication hole so that the first support bar may be connected to a first end of the hanger bar, and the second support bar may be coupled to the second fixer and inserted into the second support through-hole and the second upper communication hole so that the second support bar may be connected to a second end of the hanger bar.

As is apparent from the above description, the present disclosure has effects as follows.

According to the present disclosure, a clothes treatment apparatus may change the amplitude and period of a hanger bar for holding clothes to perform functions such as removing dust from clothes or removing wrinkles from clothes.

Unnecessary vibration of the hanger bar in a direction other than the movement direction may be minimized.

The driving force (or excitation force) required to move the hanger bar in the movement direction may be effectively improved by minimizing the unnecessary vibration.

The performance of clothes management functions may be improved by using the amplitude and period of the hanger bar suitable for each clothes management function.

Unnecessary noise and vibration may be minimized by changing the amplitude and period of the hanger bar.

It is possible to prevent the product from being damaged by changing the amplitude and period of the hanger bar.

It is possible to provide amplitudes and periods suitable for various clothes management functions such as removing wrinkles from clothes, removing dust from clothes, maximizing the moisture content of clothes during steam supply, and improving clothes drying.

A clothes management course for improving the performance of clothes management may be provided by combining various clothes management functions.

User's convenience and satisfaction may be improved by increasing the durability of the product.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Hereinafter, preferred embodiments of the present disclosure will be described in detail with reference to the accompanying drawings. The configuration or control method of the apparatus, which will be described below, is only for explaining the embodiments of the present disclosure and not for limiting the scope of the present disclosure. The same reference numbers used herein represent the same components.

Specific terms used in the present specification are only for convenience of description, but the terms do not limit the scope of the present disclosure.

For example, expressions such as "same" and "same as" not only indicate an identical state but also indicate a state including a tolerance or a difference in the degree to which the same function is obtained.

For example, expressions indicating relative or absolute arrangement such as "in a direction", "along a direction", "in parallel to", "in orthogonal to", "with respect to", "concentrically to", and "coaxially to" not only indicate the arrangement but also indicate a state including a tolerance or a relative displacement in angle or distance allowed in obtaining the same function.

The present disclosure will be described based on a spatial orthogonal coordinate system where X, Y, and Z axes are orthogonal to each other. Each axis direction (X-axis direction, Y-axis direction, and Z-axis direction) refers to two directions in which each axis extends. Each axis direction with a '+' sign in front thereof (+X-axis direction, +Y-axis direction, and +Z-axis direction) refers to a positive direction which is one of the two directions in which each axis extends. Each axis direction with a '−' sign in front thereof (−X-axis direction, −Y-axis direction, and −Z-axis direction) refers to a negative direction which is the other of the two directions in which each axis extends.

The terms used herein to indicate directions such as "front (+Y), back (−Y), left (+X), right (−X), up (+Z), and down (−Z)" are defined by the X, Y, and Z coordinate axes, but these terms are merely used for better understanding of the present disclosure. That is, it is obvious that the directions may be defined differently depending on where the reference is placed.

The use of terms such as "first", "second", "third", etc. in front of the components described herein is only to avoid confusion between the components. That is, the terms are not related to the order, importance, or master-slave relationship between the components. For example, an embodiment including only a second component without a first component is also feasible.

The singular form used herein include plural forms unless the context clearly dictates otherwise.

Figure 1:
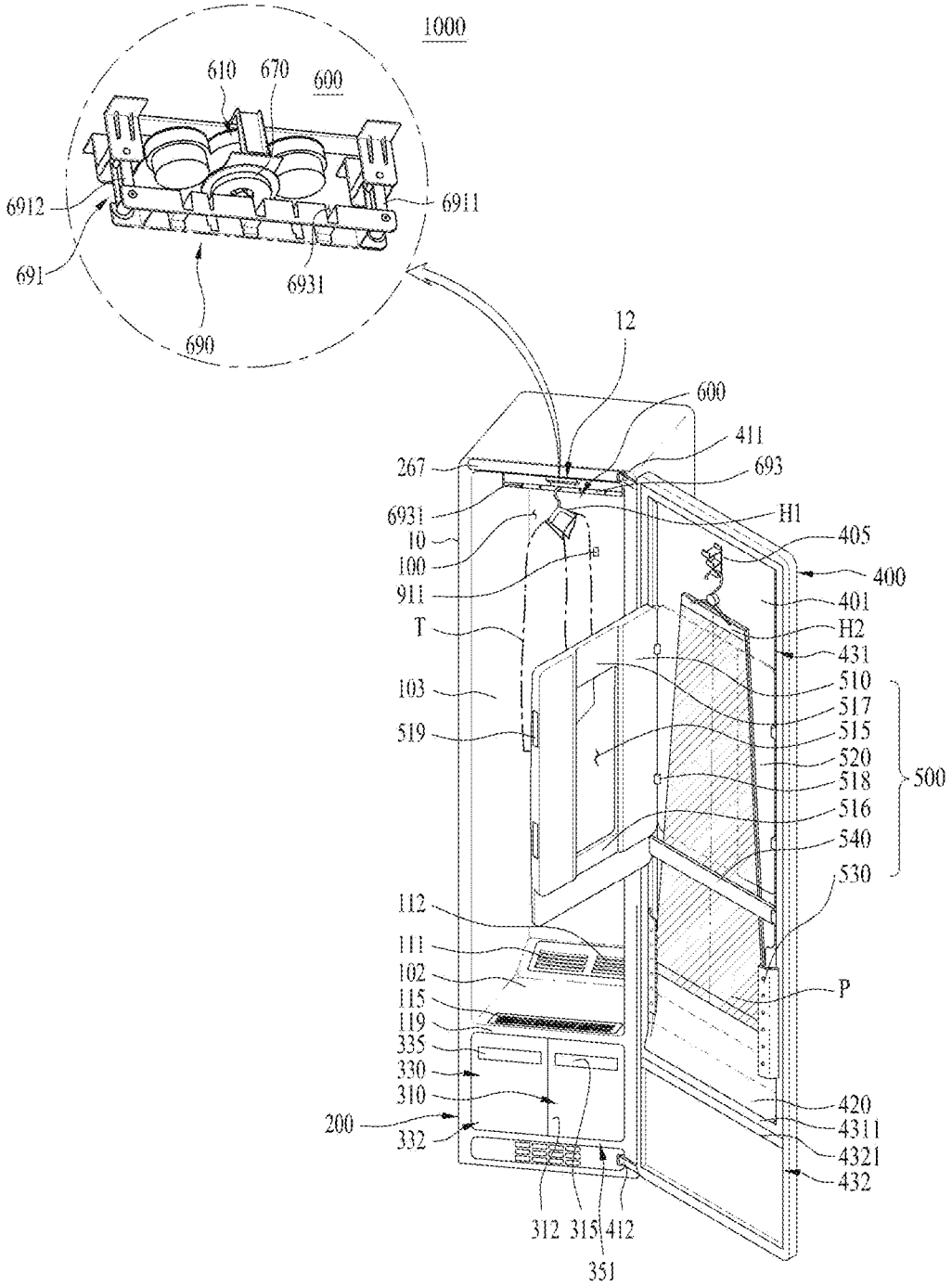
FIG. 1 shows a clothes treatment apparatus including a clothes supporter capable of reciprocating.

FIG. 1 shows an example of a conventional clothes treatment apparatus 1000. The clothes treatment apparatus 1000 according to an embodiment of the present disclosure may include: a cabinet 10 including an inlet 11 on the front side; a first chamber 100 positioned inside the cabinet 10 and defining a space for holding clothes through the inlet 11; a second chamber 200 positioned under the first chamber 100 and defining a space separated from the first chamber 100; a hanger bar 693 positioned in the first chamber 100 and configured to hold the clothes accommodated in the first chamber 100; and a driver 610 configured to reciprocate the hanger bar 693 based on the torque of a motor 620. The driver 610 may include: the motor 620; a vibrating body 630 configured to support the motor 620 and vibrate alternately in a first rotation direction and a second rotation direction opposite to the first rotation direction by the rotation of the motor 620; and a motion converter 680 configured to rotate together with the vibrating body 630 and convert the vibration of the vibrating body 630 to allow the hanger bar 693 to reciprocate along a predetermined movement direction in connection with the hanger bar 693. In particular, the hanger bar 693 may reciprocate with different amplitudes and periods according to the number of times that the motor 620 rotates The clothes treatment apparatus 1000 may include: an air blower 220 located inside the second chamber 200 and including a blowing fan 226 configured to suck air from the first chamber 100 to circulate the air in the first chamber 100;

a compressor 234 configured to compress a refrigerant; and a heat exchanger (not shown) configured to exchange heat between the air sucked by the air blower 220 and the refrigerant. The clothes treatment apparatus 1000 may further include: a heat pump 230 connected to the air blower 220 and configured to discharge the air dehumidified and heated by the heat exchanger (not shown) to the first chamber 100; a steamer 250 positioned inside the second chamber 200 and configured to generate and supply steam; a water supply tank 310 located in front of the second chamber 200 and configured to supply water to the steamer 250; and a water drain tank 330 located in front of the second chamber 200 and configured to store condensed water generated in the first chamber 100 and the heat pump 230.

The clothes treatment apparatus 1000 may include a clothes supporter 600 provided inside the first chamber and configured to hold clothes or clothes hangers. The clothes supporter 600 may include: a hanger part 690 including the hanger bar 693 configured to hold clothes or clothes hangers; and the driver 610 configured to transmit power so that the hanger part 690 reciprocate in a predetermined movement direction; and a support member 670 configured to support the driver 610

For example, the hanger bar 693 may reciprocate along the width direction of the cabinet 10. The length of the hanger bar 693 may be shorter than the width of the cabinet 10.

The clothes treatment apparatus 1000 may further include the air blower 220 (see FIGS. 2A and 2B) located inside the second chamber 200 and configured to suck air from the first chamber 100, and the heat pump 230 (see FIGS. 2A and 2B) configured to dehumidify and heat the sucked air and discharges the air to the first chamber 100.

The cabinet 10 may be made of metal. If the strength is capable of being maintained, the cabinet 10 may be made of plastic. The first chamber 100 may be formed by plastic injection molding. The first chamber 100 may be coupled to the cabinet 10 by a frame (not shown). However, a space between the cabinet 10 and the first chamber 100 or a space between the cabinet 10 and the second chamber 200 may be filled with foamed plastic such as polyurethane.

The first chamber 100 may be configured to accommodate clothes including upper and lower garments, and the air blower 220 (see FIGS. 2A and 2B), the heat pump 230 (see FIGS. 2A and 2B), and the steamer 250 (see FIGS. 2A and 2B) may be located inside the second chamber 200 and configured to keep clothes refresh. In other words, the air blower 220 (sec FIGS. 2A and 2B), the heat pump 230 (see FIGS. 2A and 2B), and the steamer 250 (see FIGS. 2A and 2B) located inside the second chamber 200 may be configured to sterilize and deodorize clothes, remove wrinkles, and dry clothes by using steam and/or heated air.

The first chamber 100 may include the clothes supporter 405 configured to hold clothes on an upper portion of the first chamber 100. The clothes supporter 405 may accommodate hangers for clothes. The clothes supporter 405 includes the hanger part 690 configured to shake the clothes placed therein, the driver 610 configured to reciprocate the hanger part 690, and the support member 670 configured to support and fix the clothes supporter to the cabinet 10. The hanger part 690 may include the hanger bar 693 provided in the width direction of the cabinet 10 and configured to hold a hanger H1 and a hanger bar supporter 691 configured to movably supporting both ends of the hanger bar. The hanger bar 693 may include a hanger groove 6931 in the form of a groove to hang a hanger.

For example, the driver 610 may be configured to convert the rotation of the motor 620, which is provided in the driver 610, into vibration that rotates alternately in the first and second rotation directions, which are opposite to each other. The motion converter may be configured to covert the vibration into the reciprocation of the hanger bar 693, which will be described in detail below. The rotation of the driver 610 may shake clothes T mounted on the hanger bar 693. Accordingly, the clothes treatment apparatus 1000 may be configured to shake the clothes mounted on the clothes supporter 405 to perform clothes management functions such as removing foreign substances including dust attached to the clothes, preserving the texture of the clothes such as hair, and removing wrinkles from the clothes.

In particular, the clothes treatment apparatus 1000 may be configured to exposure the clothes to steam or moisture supplied from the second chamber 200 while shaking the clothes mounted on the clothes supporter 405, thereby performing the clothes management functions more effectively. FIG. 1 shows the clothes supporter 405 in a circle indicated by a dashed-dotted line. The clothes supporter 600 may be referred to as a moving hanger. In a narrow sense, the clothes supporter may be referred to as a reciprocating hanger bar.

That is, when clothes are hung on the clothes supporter 405, the clothes may be hung in an unfolded state inside the first chamber 100 by their own weight. A plurality of hanger grooves 6931 may be provided at the hanger bar 693 with a predetermined distance so that the surface of the clothes may be evenly exposed to the dehumidified and heated air and/or steam supplied from the second chamber 200.

In general, water boils at 100° C. under the atmospheric pressure, and in this case, the generated water vapor may be called steam. Moisture refers to a state in which water droplets of 1 mm or less are suspended in air at the room temperature. For example, moisture is similar to fog. In general, considering that steam generated by heating and boiling water has higher sterilization power than moisture due to a high temperature and water molecules move actively at the high temperature, the permeability of the steam may be higher than that of the moisture so that the steam may be more suitable than the moisture in refreshing clothes.

The first chamber 100 may be defined by: a first chamber upper surface 101 disposed below the driver 610 of the clothes supporter 405; a first chamber bottom surface 102 defining the bottom; a first chamber side surface 103 defining the side surface of the first chamber 100 and configured to connect the first chamber upper surface 101 and the first chamber bottom surface 102; and the rear surface of the first chamber. If a surface on which the inlet 11 is formed is the front surface, the rear surface of the first chamber may be located in the opposite direction.

The following components may be disposed on the first chamber bottom surface 102: an air supply port 111 and a steam supply port 112 configured to supply steam generated by the steamer 250 in the second chamber 200 and air dehumidified and heated by the heat pump 230 in the second chamber 200 into the first chamber 100; and an air intake port 115 configured to suck the air in the first chamber 100 through the air blower 220.

The air intake port 115 may be configured to discharge condensed water in the first chamber 100, where the water is generated when the steam in the first chamber 100 condenses. That is, the condensed water generated on the inner circumferential surface of the first chamber 100 may flow or fall to the first chamber bottom surface 102 by its own weight. Since the first chamber bottom surface 102 is inclined toward the air intake port 115, the condensed water may naturally move toward the air intake port 115. Thus, the condensed water discharged to the air intake port 115 may flow down through an inlet duct 221 (see FIGS. 2A and 2B) and then be temporarily stored in a sump (not shown) located at the lower inner side of the inlet duct 221.

Similarly, condensed water generated on an inner surface 401 of a door 400 may fall down to the first chamber bottom surface along a door liner 420 provided on the door inner surface 401 and be discharged to the sump (not shown) through the air intake port 115. The condensed water collected in the sump may be discharged to and collected in the water drain tank 330 through a drain pump 339 (see FIGS. 2A and 2B)

Referring to FIG. 1, the air supply port 111 and steam supply port 112 may be provided in an area where the first chamber bottom surface 102 and the rear surface of the first chamber 100 are met. In addition, the area where the first chamber bottom surface 102 and the rear surface of the first chamber are met may have a smoothly inclined shape.

The air intake port 115 may be located close to the inlet 11 on the first chamber bottom surface 102. Therefore, a circulation structure in which the air in the first chamber 100 is discharged through the air supply port 111 and sucked again through the air intake port 115 may be formed. Steam may also be discharged through the steam supply port 112, condensed and sucked through the air intake port 115, and then collected in the sump (not shown) configured to store condensed water.

To more smoothly discharge the water condensed in the first chamber 100 into the second chamber 200 through the air intake port 115, the first chamber bottom surface 102 may be downward from the rear surface of the first chamber 100 in the direction of the air intake port 115.

As shown in FIG. 1, the water supply tank 310 configured to supply water to the steamer 250 and the water drain tank 330 configured to discharge condensed water collected in the sump (not shown) may be provided in a front portion of the second chamber 200. In addition, a tank module frame configured to define a tank installation space 351 in which the water supply tank 310 and water drain tank 330 are installed may be provided such that the tank installation space 351 is separated from the second chamber 200. That is, the tank installation space 351 and the second chamber 200 are located in a lower portion of the first chamber 100, and the tank installation space 351 may be located closer to the door 400 than the second chamber 200. The second chamber 200 may be located behind the tank installation space 351.

Each of the water supply tank 310 and water drain tank 330 may be provided to be detachable from the tank module frame (not shown). Alternatively, the water supply tank 310 and water drain tank 330 may be integrated so that the water supply tank 310 and water drain tank 330 are detachable at the same time.

The door 400 may include the door inner surface 401 located on the rear surface of the door 400 or in a direction from the door 400 to the first chamber 100 when the door 400 is closed. The door 400 may be rotatably connected to the cabinet 10 with a hinge to open and close the inlet 11. To this end, the door 400 may include door hinges 411 and 412 for rotational coupling.

When the door 400 is closed by the user, the front surfaces of the water supply tank 310 and water drain tank 330 may face the door inner surface 401. When the door 400 is opened by the user, the front surface of the water supply tank 310 and the front surface of the water drain tank 330 may be exposed to the outside.

The front surface of each of the water supply tank 310 and water drain tank 330 may be made of a transparent or translucent light transmitting material. When the user opens the door 400, the user may immediately check the water levels of the water supply tank 310 and water drain tank 330. In some embodiments, the water supply tank 310 and water drain tank 330 may include a water supply tank window (not shown) and a water drain tank window (not shown) on their front surfaces, respectively so that the user may check the water levels of the water supply tank 310 and water drain tank 330.

A water supply tank handle 315 and a drain tank handle 335 may be included on the front surfaces of the water supply tank 310 and water drain tank 330, respectively. When the user pulls the water supply tank handle 315 and drain tank handle 335, the water supply tank 310 and water drain tank 330 may rotate with respect to the front ends of the water supply tank 310 and water drain tank 330, respectively so that the water supply tank 310 and water drain tank 330 may be separated from the tank module frame (not shown). When the water supply tank 310 and water drain tank 330 are mounted on the tank module frame (not shown), the water supply tank 310 and water drain tank 330 may be seated on the tank module frame (not shown) by rotation as well.

The door 400 may further include a sealing part 430 configured to prevent steam supplied by the steamer 250 (see FIGS. 2A and 2B) to the first chamber 100 from leaking and the door liner 420 provided on the door inner surface 401 and configured to guide condensed water generated on the door inner surface 401 to be discharged through the air intake port 115.

The sealing part 430 may be configured to seal a space between the door 400 and the cabinet 10 when the door 400 is closed, thereby preventing steam or condensed water from leaking to the outside. The sealing part 430 may surround the edge of the door inner surface 401. The sealing part 430 may be configured to perform a function of mitigating an impact between the cabinet 10 and the door 400 when the door 400 is closed.

The sealing part 430 may include a first gasket 431 having a size corresponding to the front surface of the first chamber 100 within the door inner surface 401 and a second gasket 432 having a size corresponding to the front surface of the tank installation space 351, where the water supply tank 310 and water drain tank 330 are installed, within the door inner surface 401.

The first gasket 431 may be configured to seal the first chamber 100 and prevent condensed water generated in the first chamber 100 and door inner surface 401 from flowing into the tank installation space 351. The second gasket 432 may be positioned under the first gasket 431 and configured to prevent steam or moisture from leaking to the outside through the tank installation space 351.

The first gasket 431 may include a lower gasket 4311 provided in the width direction of the door 400 and configured to seal a lower portion of the first chamber 100. The second gasket 432 may include an upper gasket 4321 provided in the width direction of the door 400 and configured to seal an upper portion of the tank installation space 351. The lower gasket 4311 and upper gasket 4321 may be positioned between the first chamber 100 and the tank installation space 351 to be in contact with a front part 119 facing the door inner surface 401.

The door liner 420 may be coupled to the door inner surface 401 and configured to guide condensed water generated on the door inner surface 401 to flow into to the air intake port 115. That is, the door liner 420 may be provided such that the door liner 420 is inclined toward the bottom of the door inner surface 401 and has a protruding shape. The lower end of the door liner 420 protrudes from the door inner surface 401 such that the lower end of the door liner 420 is positioned above the air intake port 115. Accordingly, the condensed water flowing downward along the door liner 420 may be discharged directly from the lower end of the door liner 420 to the air intake port 115.

In some cases, condensed water falling down from the door liner 420 toward the first chamber bottom surface 102 may be guided by a separate guide member provided on the first chamber bottom surface 102 and discharged to the air intake port 115.

The clothes supporter 405 configured to hold a trouser hanger H2 after trousers (pants P) are hung on the trouser hanger H2 and a pressing unit 500 configured to press the pants P fixed by the clothes support 405 may be located inside the door inner surface 401 or the first chamber 100.

The reason that the pants P are hung upside down, that is, the bottom hem of the pants P faces up, is that since the weight of the waist of the pants P, i.e., the upper end of the pants P is higher than that the weight of the legs of the pants P, i.e., the lower end of the pants P, the pants P is evenly spread by the weight of the pants P.

The pressing unit 500 may include a base plate 520 coupled to the door inner surface 401 and configured to support clothes and a pressing plate 510 configured to rotate toward the base plate 520 and press the pants P.

To this end, the pressing unit 500 may further include a pressing unit hinge 518 configured to hinge-couple the pressing plate 510 and the base plate 520 for the rotation of the pressing plate 510 and a pressing plate fixer 519 configured to combine and fix the pressing plate 510 and the base plate 520.

By closing the door 400 and exposing the pants P to steam and hot air after placing the pants P between the pressing plate 510 and base plate 520, it is possible to remove the wrinkles of the pants P and form sharp creases in the pants P.

To this end, it is necessary for steam to easily penetrate the pants P, and thus a steam penetration hole 515 configured to penetrate the pressing plate 510 may be included. In addition, to prevent a seam provided along the longitudinal direction of the pants from being pressed, a first recessed portion 516 and a second recessed portion 517 may be respectively defined above and below the steam penetration hole 515 on a surface in contact with the pants P of the two surfaces of the pressing plate 510.

The base plate 520 may be made of an elastic material to support clothes to be pressed. Alternatively, the base plate 520 may further include an elastic member configured to elastically support the base plate 520 in the door 400.

To prevent the pants P from being pushed when the pressing plate 510 is coupled to the base plate 520 by rotation after the pants P are hung on the clothes supporter 405, a clothes fixer 540 may be further provided in a lower portion of the base plate.

The clothes fixer 540 may be provided in the form of a rod. Specifically, the clothes fixer 540 may be spaced apart from the bottom of the base plate 520 by a predetermined distance. In this case, the height of the pressing plate 510 is higher than the height of the base plate 520, so that the clothes fixer 540 may be covered when the pressing plate 510 is coupled to the base plate 520 by rotation.

FIG. 1 shows an example in which the clothes fixer 540 is provided in the form of a long rod and configured to fix clothes at one end by rotation. However, the clothes fixer 540 may be provided in the form of a clip so that the clothes fixer 540 are positioned at both ends of the pressing unit 500 to fix both sides of the pants P.

The pressing unit 500 may include a side fixer 530 positioned between the base plate 520 and the door liner 420 and configured to prevent the pants P hung on the clothes fixer 540 from swinging sideways.

Figure 2B:
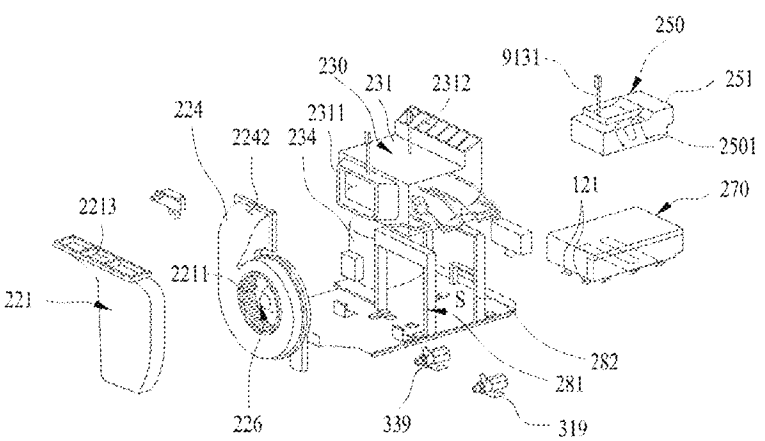
FIG. 2B is an exploded view of the mechanical device.
Figure 2A:
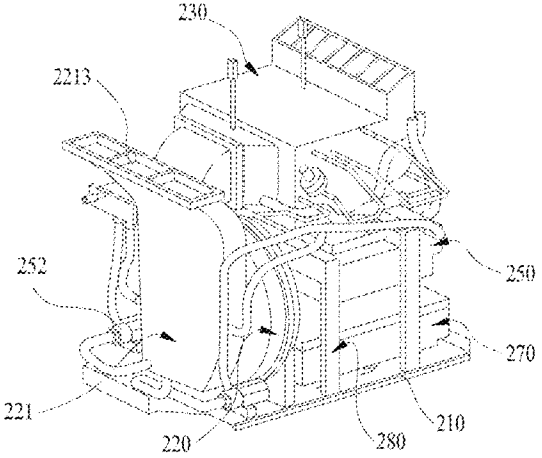
FIG. 2A shows a mechanical device located inside a second chamber.

Referring to FIG. 2A, the second chamber 200 may include the air blower 220 configured to suck air from the first chamber 100, the steamer 250 configured to generate steam by receiving water from the water supply tank 310 and provide the steam to the first chamber 100, and the heat pump 230 configured to dehumidify and heat the air sucked by the air blower 220 and discharges the air to the first chamber 100. The steamer 250, the air blower 220, and the heat pump 230 may be installed on a base 210.

A supporter 280 configured to support the steamer 250 and the heat pump 230 may be coupled to the base 210. The supporter 280 may include a first supporter 281 positioned closer to the air blower 220 and a second supporter 282 positioned farther from the air blower 220.

The heat pump 230 may be located on an upper portion of the supporter 280, and the steamer 250 may be positioned inside the supporter 280, and more particularly, in a receiving area S formed between the supporter 280 and the base 210. The controller 270 configured to control the air blower 220, steamer 250, and heat pump 230 may be located in the receiving area S.

However, this is merely an example. The controller 270 may be located at the rear of the second chamber 200. When the controller 270 is located at the rear of the second chamber 200, the controller 270 may be detached through a rear panel (not shown) which is connected to the second chamber 200 and located on the rear surface of the cabinet 10.

The controller 270 may be also configured to control the pressing unit 500, which will be described below. In addition, the controller 270 may be configured to control the reciprocation of the clothes supporter 600 (see FIG. 1).

The steamer 250 may be configured to sterilize and deodorize clothes mounted in the first chamber 100 and remove wrinkles from the clothes. The air blower 220 and the heat pump 230 may be configured to circulate air in the first chamber 100 and dehumidify the first chamber 100 by heat exchange.

Referring to FIG. 2B, the air blower 220 may include the blowing fan 226 and the inlet duct 221. Assuming that the direction in which the inlet 11 is positioned is the front direction and the direction in which the rear surface of the first chamber is positioned is the rear direction, the inlet duct 221 may be provided in front of the blowing fan 226 and the tank module frame may be provided in front of the inlet duct 221. Accordingly, the tank module frame may form the tank installation space 351, and the tank installation space 351 may be separated from the second chamber 200.

The water supply tank 310 and water drain tank 330 seated on the tank module frame may be located close to one of the two sides of the cabinet 10. For example, the water supply tank 310 may be located closer to the right side of the cabinet 10 than the left side of the cabinet 10 in the tank installation space 351. The water drain tank 330 may be located closer to the left side of the cabinet 10 than the right side of the cabinet 10 in the tank installation space 351.

Similarly to the water supply tank 310, the steamer 250 may be located closer to the right side of the cabinet 10 than the left side of the cabinet 10 within the second chamber 200. This is to simplify a connection path through which water moves from the water supply tank 310 to the steamer 250 by disposing the steamer 250 at the rear of the water supply tank 310.

The steamer 250 may include a storage 251 configured to store water and a heater 2501 located inside the storage 251 and configured to heat water. In addition, the steamer 250 may further include a steam temperature sensor 9131 configured to measure the temperature of the water stored in the storage 251.

The heater 2501 may be configured to heat the water stored in the storage 251. Steam generated by heating the water may be supplied to the first chamber 100 through the steam supply port 112 provided on the first chamber bottom surface 102 along a steam flow path (not shown).

The water supply tank 310 may be configured to provide water to be used by to the steamer 250. When the water supply tank 310 is seated in the tank installation space 351, a water supply check valve (not shown) provided on the bottom surface of the water supply tank 310 may be opened, and water may be provided to the storage 251 through a water supply path connected to the water supply check valve.

If the water supply tank 310 is located closer to the left side of the cabinet 10 than the right side of the cabinet 10, the steamer 250 may be located closer to the left side of the cabinet 10 than the right side of the cabinet 10. This is to reduce the length of the water supply path (not shown) connecting the water supply tank 310 and the steamer 250 and simplify the water supply path as much as possible.

To circulate air in the first chamber 100, the air blower 220 may be configured to suck the air through the air intake port 115 and inlet duct 221 located on the bottom surface 102 of the first chamber 100. The inlet duct 221 may include an inlet duct entrance 2213 provided in a shape corresponding to the air intake port 115, an inlet duct body 2211 configured to move the sucked air to the blowing fan 226, and an inlet duct exit 2215 connected to the entrance of the blowing fan 226.

As a kind of centrifugal blower, the blowing fan 226 may be configured to discharge the sucked air based on centrifugal force. The blowing fan 226 may be connected to the heat pump 230 through a blowing housing 224. Therefore, the air sucked by the blowing fan 226 may flow into an air inlet 2311 of a duct housing 231 connected to a blowing outlet 2242 of a blowing housing 224.

The heat pump 230 may include the duct housing 231, which is a path through which air moves, the air inlet 2311 located at one end of the duct housing 231 and configured to suck air from the blowing fan 226, and an air outlet 2312 located at the other end of the duct housing 231 and configured to discharge air to the first chamber (100).

The heat pump 230 may further include a first heat exchanger (not shown) and a second heat exchanger (not shown) positioned inside the duct housing 231 to exchange heat with the sucked air. The heat pump 230 may further include the compressor 234 located outside the duct housing 231 and configured to compress and circulate a refrigerant and supply the refrigerant to the first and second heat exchangers.

The compressor 234 may be located on a side of the supporter 280. Since the water supply tank 310 is located close to a first side of the cabinet 10 and the steamer 250 and the supporter 280 are also located close to the first side of the cabinet 10 within the second chamber 200, the compressor 235 may be located closer to a second side of the cabinet 10 than the first side of the cabinet 10. For example, referring to FIG. 2B, the compressor 235 may be located closer to the right (located closer to the right side of the cabinet 10 than the left side of the cabinet 10), and the supporter 280 and steamer 250 may be located closer to the left (located closer to the left side of the cabinet 10 than the right side of the cabinet 10).

The inlet duct 221 may include the inlet duct entrance 2213 connected to the air intake port 115 provided on the bottom surface 102 of the first chamber 100 and configured suck air in the first chamber 100. The inlet duct entrance 2213 may form an inclined flow path. This allows condensed water generated in the first chamber 100 and door 400 to pass through the inlet duct entrance 2213, which is connected to the bottom surface 102 of the first chamber 100, and move to the sump (not shown) provided at the lower inner side of the inlet duct 221 along the inclined flow path The inlet duct 221 may be positioned in front of the blowing fan 226, and the steamer 250 and heat pump 230 may be disposed in the rear of the blowing fan 226. In addition, the heat pump 230 may be supported by the supporter 280. The supporter 280 may be coupled to the base 210 that defines the bottom of the second chamber 200. Accordingly, the supporter 280 may form a predetermined distance between the base 210 and the heat pump 230, and more particularly, form the receiving area S between the supporter 280 and the base 210.

The steamer 250 may be positioned in the receiving area S and coupled to the supporter 280 in the receiving area S. The steamer 250 may be spaced apart from the base 210 and coupled to the supporter 280.

However, unlike FIG. 2B, the air blower 220 may be provided inside the duct housing 231 to circulate air in the first chamber 100. Alternatively, the air blower 220 may be installed between the air outlet 2312 and the second heat exchanger (condenser).

In the duct housing 231, condensed water may be generated by heat exchange between the first heat exchanger (evaporator) and sucked air. The condensed water generated by the heat pump 230 may move to the sump (not shown) through the bottom surface of the duct housing 231 and be discharged to the water drain tank 330.

The air and/or steam supplied by the heat pump 230 and steamer 250 may be applied to clothes accommodated in the first chamber 100, and the air and/or steam may affect physical or chemical properties of the clothes. For example, the tissue structure of the clothes may be relaxed by the hot air or steam, thereby not only removing wrinkles but also removing unpleasant odors based on reaction between the steam and odor molecules on the clothes. In addition, the hot air and/or steam supplied by the heat pump 230 and steamer 250 may sterilize parasitic bacteria on the clothes.

Figure 3A:
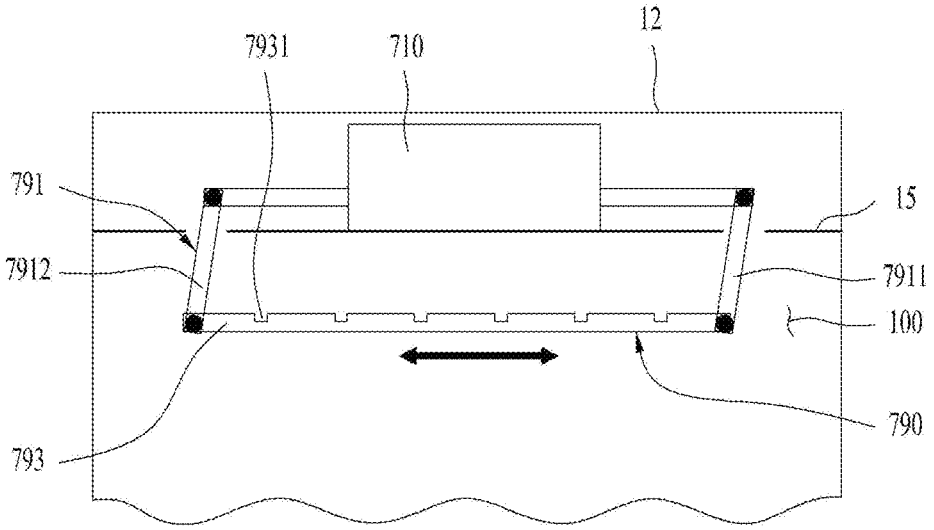
FIG. 3A shows a clothes supporter.

FIG. 3A shows an example of a clothes supporter. A clothes supporter 700 may include a hanger part 790 on which clothes are hung, a driver 710 configured to shake the hung clothes by reciprocating the hanger part 790, and the support member 670 configured to support and fix the driver 710 to a support frame 15.

The hanger part 790 may include the hanger bar 793 configured to hold clothes, a plurality of hanger grooves 7931 provided in the hanger bar 793 and configured to hold the hanger H1, hanger bar supporters 7911 and 7912 configured to support both ends of the hanger bar 793.

When it is said that clothes are hung on the hanger bar 793, it may mean that the hanger H1 for holding clothes is mounted on the hanger groove 7931. However, unlike this, it is also possible to directly hang clothes on the hanger bar 793. In this case, the hanger bar 793 may act as a laundry hanging rod.

The driver 710 may be positioned between the first chamber 100 and the cabinet 10 so that the driver 710 may not be exposed from the first chamber 100. To this end, the clothes treatment apparatus may further include the support frame 15 configured to receive and support the driver 710. Only the hanger bar supporters 7911 and 7912 configured to support the both ends of the hanger bar 793 may pass through the support frame 15 and be inserted into the first chamber 100.

The driver 710 may include a motor 720 configured to generate torque. When the motion converter 780 converts the rotation of the motor 720 into linear motion in the width direction of the cabinet 10, the hanger bar 793 may move along the width direction of the cabinet 10. If the rotation direction of the motor 720 is alternately changed, the hanger bar 793 may reciprocate along the width direction of the cabinet 10.

Figure 3B:
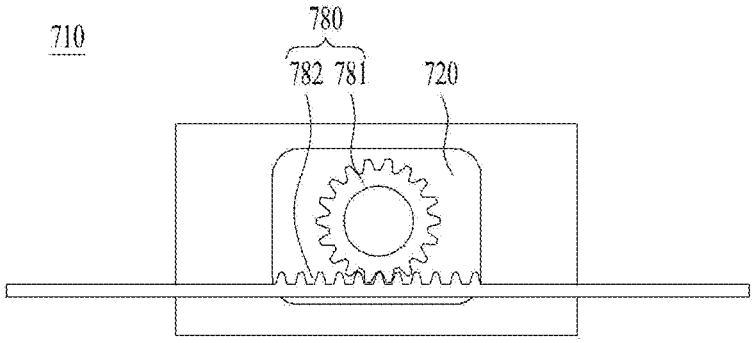
FIG. 3B shows a driver.

FIG. 3B shows a rack 782 and a pinion 781 connected to the motor 720 and configured to rotate as an example of the motion converter 780. However, this is for merely an example, and the motion of the driver 710 may be converted into the reciprocation of the hanger bar 793 in other ways. For example, the driver 710 may be provided as an actuator capable of linear reciprocating motion. In this case, no motion converter may be required. Alternatively, the driver 710 may include a linear motor and control the movement direction of the linear motor to implement the reciprocation of the hanger bar 793. Alternatively, to convert the rotation of the motor into the linear reciprocating motion, a rotational plate may be provided on the rotational shaft of the motor. Specifically, a rod may be connected to a portion deviating from the rotational center of the rotational plate, and the rotation of the motor may be converted into the reciprocating movement of the rod.

Referring to FIGS. 4 to 10, the clothes supporter 600 may be disposed on an upper portion of the cabinet 10. Specifically, the driver 610 may be positioned between an upper panel 12 defining the upper surface of the cabinet 10 and the first chamber upper surface 101. The support frame 15 configured to support the driver 610 may be positioned between the upper panel 12 and the first chamber upper surface 101. The clothes supporter 600 may be supported by the support frame 15.

Figure 4:
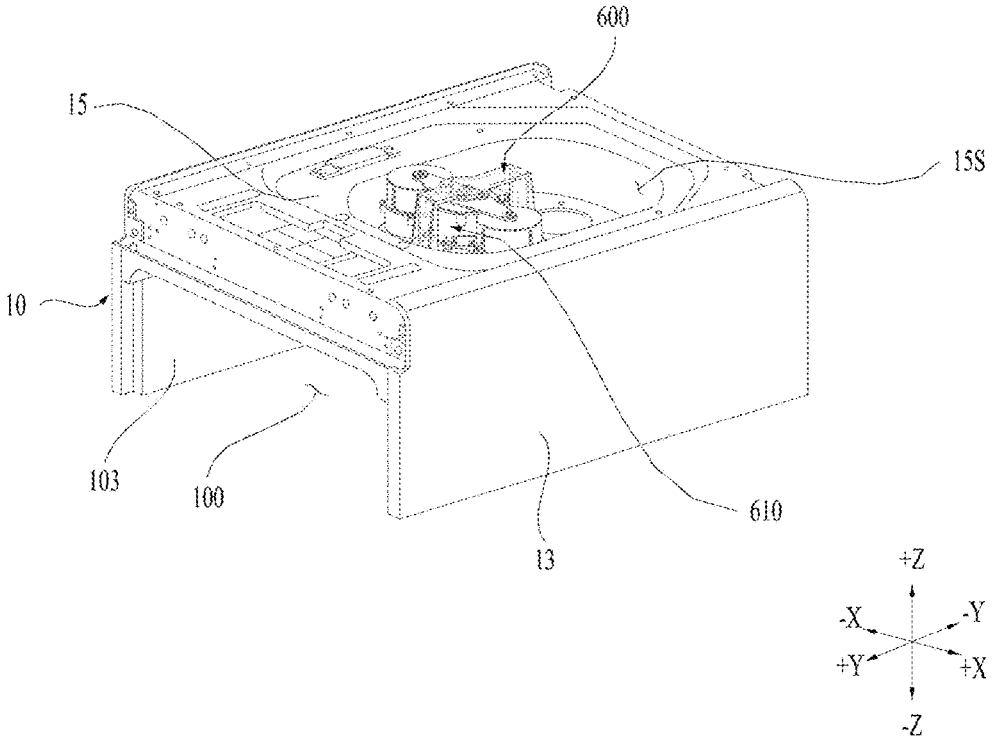
FIG. 4 shows a driver provided in a support frame located between a cabinet and a first chamber.

Referring to FIG. 4, the support frame 15 may form a support space 15S configured to accommodate the clothes supporter 600. The support space 15S may be formed by depression of the support frame 15. The support frame 15 may serve as a support for installing a lighting device (not shown) configured to illuminate the interior of the first chamber 100.

The clothes supporter 600 may include the hanger part 690 and the driver 610. The hanger part 690 may include the hanger bar 693 for holding clothes and a hanger bar supporter 691 movably connected to the support frame 15 and configured to support both ends of the hanger bar 693. The driver 610 may generate power for reciprocating the hanger bar 693. To this end, the driver 610 may include the motor 620, the vibrating body 630 configured to support the motor 620 and vibrate alternately in clockwise and counterclockwise directions by the rotation of the motor 620, and the motion converter 680 configured to rotate together with the vibrating body 630 and convert the vibration of the vibrating body 630 to allow the hanger bar 693 to reciprocate along a predetermined movement direction in connection with the hanger bar 693.

The hanger part 690 may be configured to hold clothes or hangers. The hanger part 690 may be supported by the inner circumferential surfaces of the cabinet 10 and the first chamber 100 or the support frame 15. FIG. 4 shows an example in which the hanger part 690 is supported by the support frame 15. The hanger part 690 may be connected to the driver 610 to receive the vibration of the driver 610. The vibration generated by the driver 610 may be converted by the motion converter 680 into arc reciprocation and then converted into linear reciprocation of the hanger bar 693.

Figure 5C:
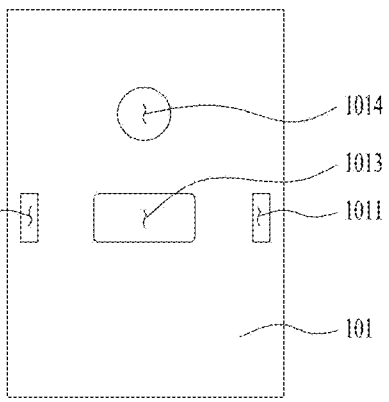
FIG. 5C shows a first chamber upper surface matching with the support frame.
Figure 5B:
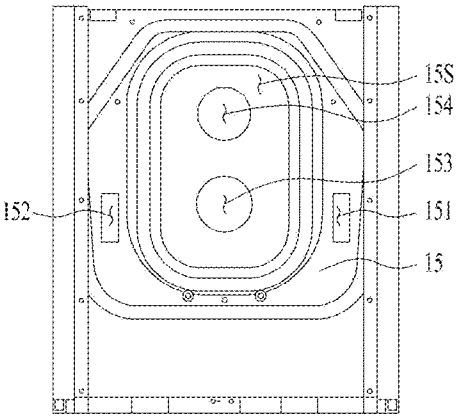
FIG. 5B shows only the support frame in FIG. 5A.
Figure 5A:
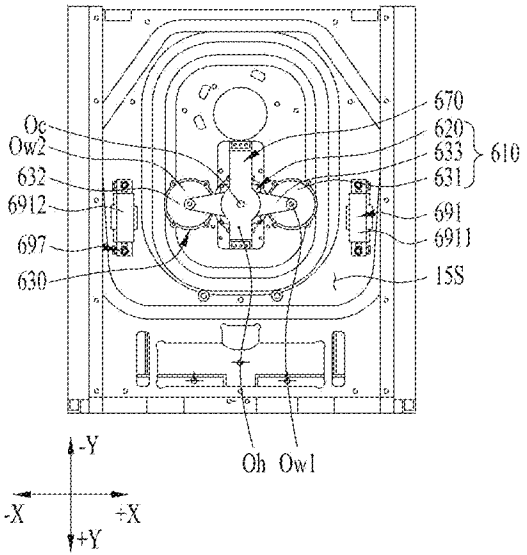
FIG. 5A is a top view of the support frame in which the driver is located.

FIGS. 5A to 5C are top views of the support frame 15, the driver 610, and the first chamber upper surface 101.

FIG. 5A is a top view of the clothes supporter 600 supported by the support frame 15. Accordingly, FIG. 5A mainly shows the driver 610. The driver 610 may include the motor 620 positioned in the center and eccentric parts 634 (see FIGS. 5A to 5C) disposed on both sides of the motor 620. The eccentric parts 634 may be connected to the vibrating body 630 so as to rotate together. In addition, the vibrating body 630 may be configured to rotatably support a motor rotation shaft 625 that rotates by the torque generated by the motor 620.

The eccentric parts 634 may rotate with respect to first and second rotation axes Ow1 and Ow2, respectively. The eccentric parts 634 may be coupled to the vibrating body 630. The motion converter 680 may protrude toward the hanger bar 693 and extend toward the first chamber 100 along a connection axis Oh.

The support member 670 may be fixed to the cabinet 10 and the support frame 15. The support member 670 may be configured to support a driver elastic member 635. In addition, the support member 670 may be configured to support the driver 610. That is, the support member 670 may be configured to rotatably support the driver 610. That is, the support member 670 may be configured to rotatably support the driver 610 with respect to a central axis Oc.

The hanger part 690 may further include the hanger bar supporter 691 configured to allow both ends of the hanger bar 693 to reciprocate. In addition, the hanger part 690 may further include a support bar fixer 697 configured to rotatably connect the hanger bar supporter 691 to the support frame 15.

FIG. 5B shows the support frame 15. The support frame 15 may include the support space 15S configured to accommodate the driver 610. The support space 15S may be formed by recessing the support frame 15 toward the first chamber 100. A central through-hole 153 that penetrates in the height direction of the cabinet 10 may be provided on the bottom surface of the support space 15S. This is to insert the motion converter 680 and connect the hanger bar 693.

In addition, a lighting through-hole 154 for installing a lighting device configured to illuminate the first chamber 100 may be further provided on the bottom surface of the support space 15S.

A first support through-hole 151 and a second support through-hole 152 that penetrate in the height direction of the cabinet 10 may be further provided on both sides of the support space 15S, respectively, so that the hanger bar supporter 691 may be rotatably connected and fixed. A first support bar 6911 and a second support bar 6912 configured to support both ends of the hanger bar 693 may be inserted into the first support through-hole 151 and the second support through-hole 152, respectively. The first support bar

6911 and the second support bar 6912 may be connected to the support frame 15 by a first fixer 6971 and a second fixer 6972, respectively.

FIG. 5C is a top view of the first chamber upper surface 101 corresponding to the support frame 15. A motion converter communication hole 1013, a chamber lighting communication hole 1014, a first upper communication hole 1011, and a second upper communication hole 1012, which are respectively related to the central through-hole 153, the lighting through-hole 154, the first support through-hole 151, and the second support through-hole 152, may be formed by penetrating the first chamber upper surface 101 in the height direction of the cabinet 10.

That is, the motion converter communication hole 1013 may be formed by penetrating the first chamber upper surface 101 so that the motion converter 680 inserted through the central through-hole 153 is inserted into the first chamber 100. Similarly, the chamber lighting communication hole 1014 may be provided to insert a lighting device (not shown). In addition, the first support bar 6911 and second support bar 6912 may be inserted into the first chamber 100 through the first upper communication hole 1011 and second upper communication hole 1012, respectively and connected to both ends of the hanger bar 693.

Figure 6:
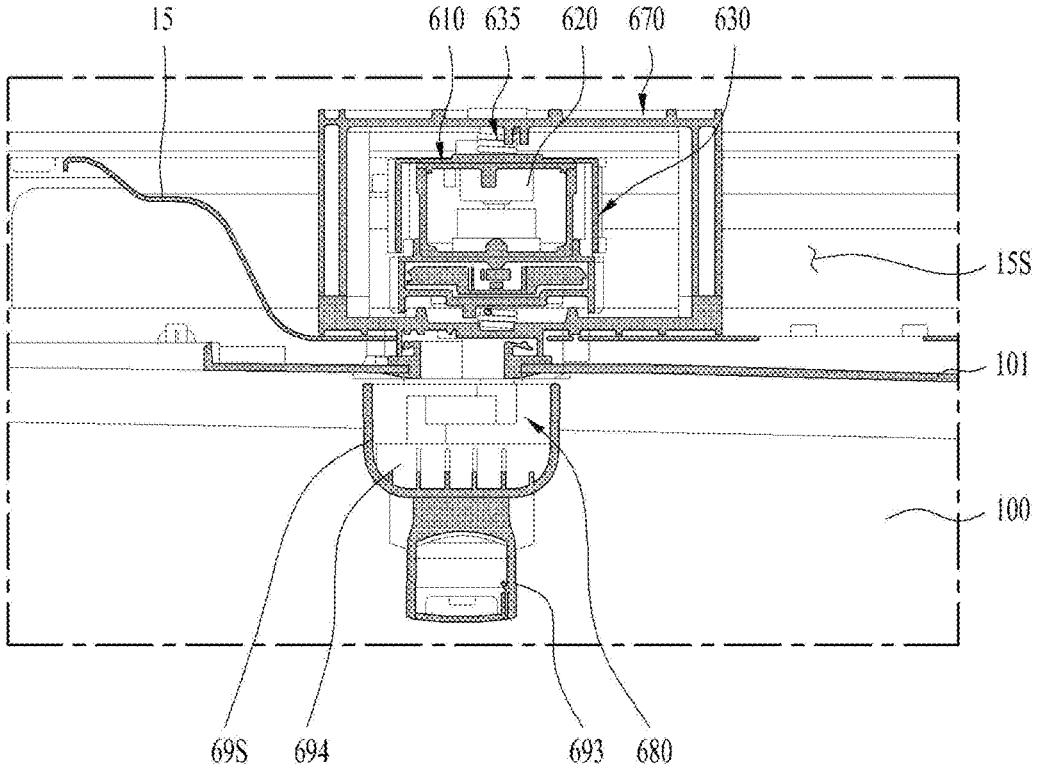
FIG. 6 is a cross-sectional view showing a relationship between the support frame, the first chamber upper surface, and the clothes supporter.

FIG. 6 is a cross-sectional view of the clothes supporter 600 viewed from one side of the cabinet 10. Referring to FIGS. 5C and 6, a part of the clothes supporter 600 may be positioned between the upper panel 12 and the first chamber upper surface 101. In particular, the support frame 15 may be positioned between the first chamber upper surface 101 and the upper panel 12, and the support frame 15 may include the support space 15S for accommodating a part of the clothes supporter 600.

The clothes treatment apparatus may further include: the first support bar 6911 and second support bar 6912 configured to support the ends of the hanger bar 693 in such a way that the hanger bar 693 is capable of reciprocating; the support frame 15 positioned between the first chamber 100 and the upper panel 12 and configured to support the driver 610; the first fixer 6971 and second fixer 6972 configured to rotatably support the first support bar 6911 and second support bar 6912 in the support frame 15; and the first chamber upper surface 101 defining the upper surface of the first chamber 100. The support frame 15 may include: the central through-hole 153 passing through the support frame 15 in the height direction of the cabinet 10; and the first support through-hole 151 and the second support through-hole positioned in opposite directions along the width direction of the cabinet 10 with respect to the central through-hole 153 and penetrating the support frame 15 in the height direction of the cabinet 10. The first chamber upper surface 101 may further include: the motion converter communication hole 1013 corresponding to the central through-hole 153 and penetrating the first chamber upper surface 101; and the first upper communication hole 1011 and the second upper communication hole 1012 respectively corresponding to the first support through-hole 151 and the second support through-hole 152 and penetrating the first chamber upper surface 101. The first support bar 6911 may be connected to the first fixer 6971 and inserted into the first support through-hole 151 and the first upper communication hole 1011 so that the first support bar 6911 may be connected to a first end of the hanger bar 693. The second support bar 6912 may be connected to the second fixer 6972 and inserted into the second support through-hole 152 and the second upper communication hole 1012 so that the second support bar 6912 may be connected to a second end of the hanger bar 693.

Referring to FIG. 6, the hanger part 690 may further include a slot 694 positioned on the hanger bar 693 and configured to convert the reciprocation of the motion converter 680 into reciprocation in the movement direction. In addition, a slot cover 695 may be further included not only to protect the slot 694 and the motion converter 680 but also to prevent the slot 694 and the motion converter 680 from being exposed to the user.

The motion converter 680 may be configured to rotate together when the vibrating body 630 rotates and protrude from the vibrating body 630 of the driver 610 to be inserted into the slot 694. Accordingly, the motion converter 680 may reciprocate the hanger bar 693.

Referring to FIG. 6, a part of the clothes supporter 600, for example, the hanger bar 693 may be exposed inside the first chamber 100. This is to hide the complicated configuration of the driver 610 and simplify the design of the first chamber 100 exposed to the user.

The support member 670 may be fixed to the support frame 15. The support member 670 may be configured to support the driver elastic member 635 and support the driver 610 as well.

Figure 7:
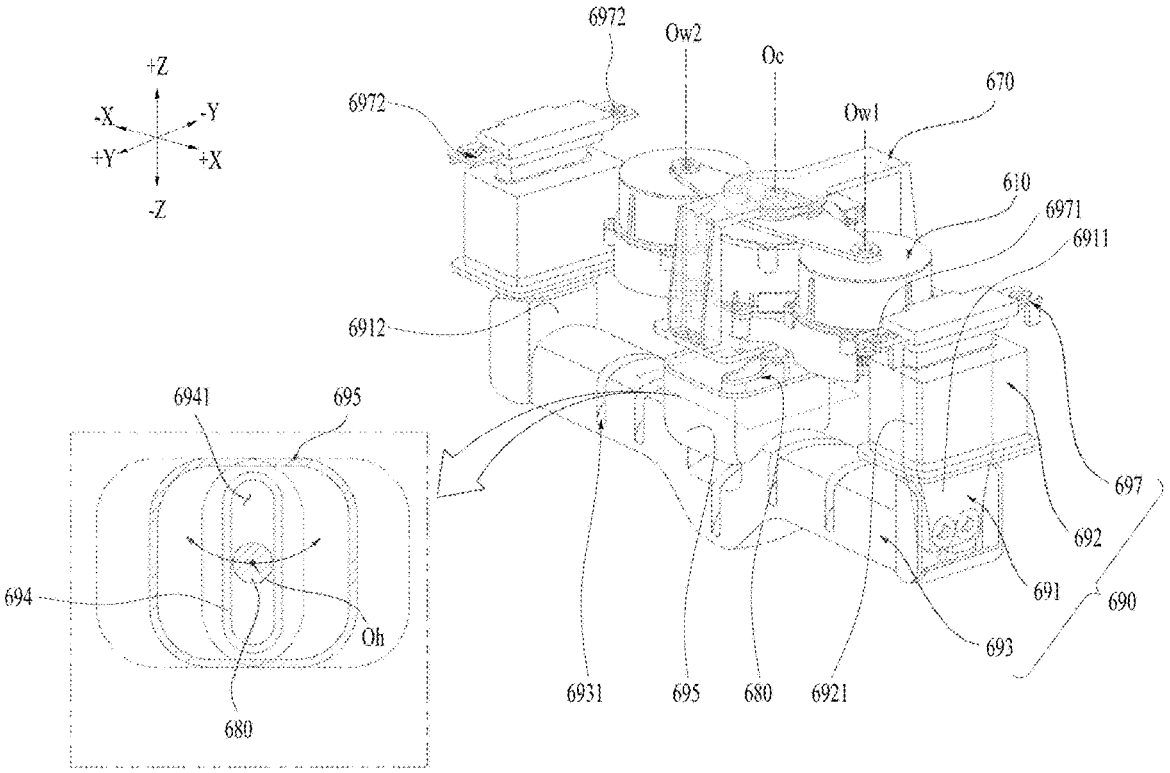
FIG. 7 shows the clothes supporter.

Referring to FIG. 7, the hanger part 690 may include the hanger bar 693 configured to hold clothes or hangers. In this embodiment, the hanger bar 693 may include the hanger grooves 6931 configured to hold the hangers. However, in another embodiment, the hanger bar 693 may include a hook (not shown) for directly hanging clothes.

The driver 610 may be configured to reciprocate (vibrate) the hanger bar 693. The driver 610 may be connected to the hanger bar 693 and configured to transfer the vibration of the driver 610 to the hanger bar 693.

The hanger bar 693 may be supported by the support frame 15. For example, the ends of the hanger bar 693 may be connected to the support frame 15 by the hanger bar supporter 691. The hanger bar 693 may be configured to be movable relative to the cabinet 10, the support frame 15, or the first chamber 100. The hanger bar 693 may be configured to vibrate and reciprocate in a predetermined vibration or movement direction (+X, −X). The hanger bar 693 may be configured to vibrate in the vibration direction (+X, −X) with respect to the cabinet 10.

That is, the driver 610 may be configured to reciprocate the hanger bar 693 in the vibration direction (+X, −X). The hanger bar 693 may reciprocate while being suspended from an upper portion of the first chamber 100.

The hanger bar 693 may extend in the vibration direction (+X, −X), i.e., in the width direction of the cabinet 10. However, the extended length may be shorter than the width of the cabinet 10. A plurality of hanger grooves 6931 may be disposed on the upper surface of the hanger bar 693. The plurality of hanger grooves 6931 may be spaced apart from each other in the vibration direction (+X, −X). Each of the hanger grooves 6931 may extend in a direction (+Y, −Y) transverse to the vibration direction (+X, −X) or in the depth direction of the first chamber 100.

The hanger part 690 may include the hanger bar supporter 691 configured to movably support the ends of the hanger bar 693. That is, the hanger bar supporter 691 may be configured to be movable in the vibration direction or movement direction (+X, −X). In addition, the hanger bar supporter 691 may be made of a flexible material to allow the hanger bar 693 to move. The hanger bar supporter 691 may include an elastic member elastically deformable when the hanger bar 693 moves. The upper end of the hanger bar supporter 691 may be connected to the support frame 15, and the lower end of the hanger bar supporter 691 may be connected to the first end of the hanger bar 693. To this end, the hanger bar supporter 691 may include: the first support bar 6911 connected to the first end of the hanger bar 693; and the second support bar 6912 connected to the second end of the hanger bar 693.

The upper end of the hanger bar supporter 691 may be rotatably or movably connected to the support frame 15 by the support bar fixer 697. The support bar fixer 697 may include the first fixer 6971 and the second fixer 6972. The first and second fixers 6971 and 6972 may be connected to the upper ends of the first and second support bars 6911 and 6912, respectively, to be coupled to the support frame 15.

The upper end of the hanger bar supporter 691 may be hung on the support bar fixer 697. The support bar fixer 697 may be formed in the shape of a horizontal plate, and the support bar fixer 697 may pass through the upper end of the hanger bar supporter 691.

The hanger bar supporter 691 configured to connect the support bar fixer 697 and the hanger bar 693 may be disposed within a support guide 692 with the shape of an empty pipe. The support guide 692 may include a first support guide 6921 and a second support guide 6922. Accordingly, the first support bar 6911 may pass through the inside of the first support guide 6921 and connect the first fixer 6971 and the first end of the hanger bar 693. The second support bar 6912 may pass through the inside of the second support guide 6922 and connect the second fixer 6972 and the second end of the hanger bar 693.

The support bar fixer 697 may be located between the first chamber upper surface 101 and the support frame 15. Due to the formation of the support space 15S, the support frame 15 may define a predetermined guide space (not shown) between the first chamber upper surface 101 and the support frame 15 in a direction from the support space 15S to the side of the support frame 15. If the support guide 692 is disposed in the guide space, it is possible to prevent the steam in the first chamber 100 from leaking to the driver 610. To this end, sealing may be performed between the upper surface of the support guide 692 and the hanger bar supporter 691. The predetermined guide space between the first chamber upper surface 101 and the support frame 15 may be maintained. The support guide 692 may guide the position of the hanger bar supporter 691. This is because the hanger bar supporter 691 is movable in the vibration direction (+X, −X) inside the support guide 692.

The hanger bar supporter 691 may penetrate the support guide 692 up and down. The horizontal length of the hanger bar supporter 691 in the direction (+X, −X) may be shorter than the vertical length of the hanger bar supporter 691 in the direction (+Y, −Y) perpendicular to the vibration direction (+X, −X).

The driver 610 may include the motion converter 680 connected to the hanger part 690. In particular, the hanger bar 693 may include the slot 694 connected to the motion converter 680. In addition, the hanger bar 693 may include the slot cover 695 configured to protect the slot 694.

Referring to the enlarged cross section view of the slot cover 695, the slot 694 may include a slit-shaped inner slot space 6941 that extends in the direction (+Y, −Y), which is transverse to the vibration direction (+X, −X). The motion converter 680 may protrude parallel to the central axis Oc, which will be described below, and be inserted into the slot 694 so that the motion converter 680 may be located in the inner slot space 6941.

In this embodiment, the slot 694 may form the inner slot space 6941 in the form of a slit, which extends in the direction (+Y, −Y), and the motion converter 680 may protrude downward and be inserted into the slot 694. However, referring to FIG. 10, the motion converter 680 may be coupled to the driver 610 so that the motion converter 680 may rotate together with the driver 610. That is, the motion converter 680 may be coupled to the vibrating body 630 so that the motion converter 680 may rotate integrally. Accordingly, the motion converter 680 may be configured to vibrate and reciprocate along an arc when the driver 610 vibrates.

The motion converter 680 may include: a rotation protrusion 6811 that protrudes from the vibrating body 630 toward the first chamber 100 in a direction parallel to the central axis Oc; a connection protrusion 6813 inserted into the slot 694 in a direction parallel to the central axis Oc and located in the inner slot space 6941; and a connecting rod 6812 configured to connect the rotation protrusion 6811 and the connection protrusion 6813. The connection protrusion 6813 or the rotation protrusion 6811 may extend along the connection axis Oh parallel to the central axis Oc. Thus, one of the connection protrusion 6813 or the rotation protrusion 6811 may be disposed on the connection axis Oh.

The slot 694 may be elongated in the direction (+Y, −Y) orthogonal to the vibration direction (+X, −X) of the clothes supporter 600. When the motion converter 680 rotates with respect to the central axis Oc while being inserted into the slot 694, the motion converter 680 may move relative to the slot 694 in the directions of (+Y, −Y).

Accordingly, the hanger bar 693 may reciprocate in the vibration direction (+X, −X). In the enlarged cross section view of FIG. 7, the arrow denotes a direction in which the motion converter 680 reciprocates (rotates) along the arc within a predetermined range while being inserted into the slot 694. In addition, the movement range of the slot 694 vibrating in the vibration or movement direction (+X, −X) is shown by a dotted line.

Figure 8:
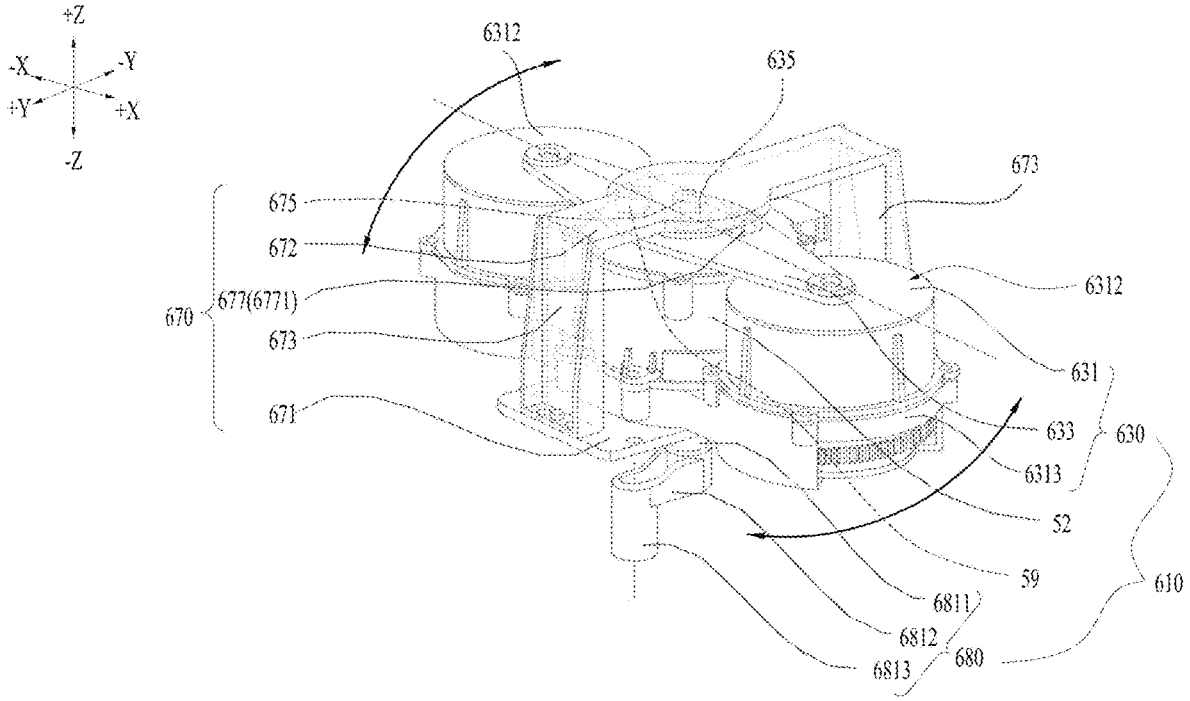
FIG. 8 shows assembly of the driver and unit and a support member.
Figure 9A:
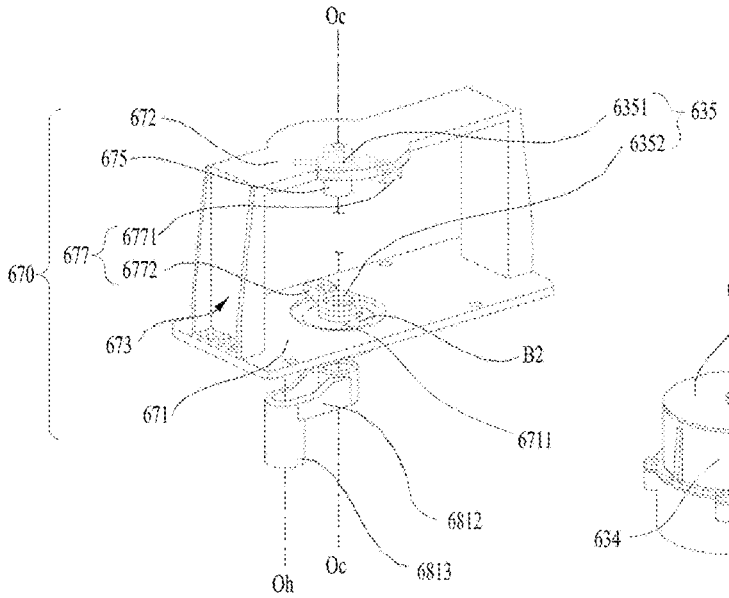
FIGS. 9A and 9B show disassembly of the driver and unit and the support member.
Figure 9B:
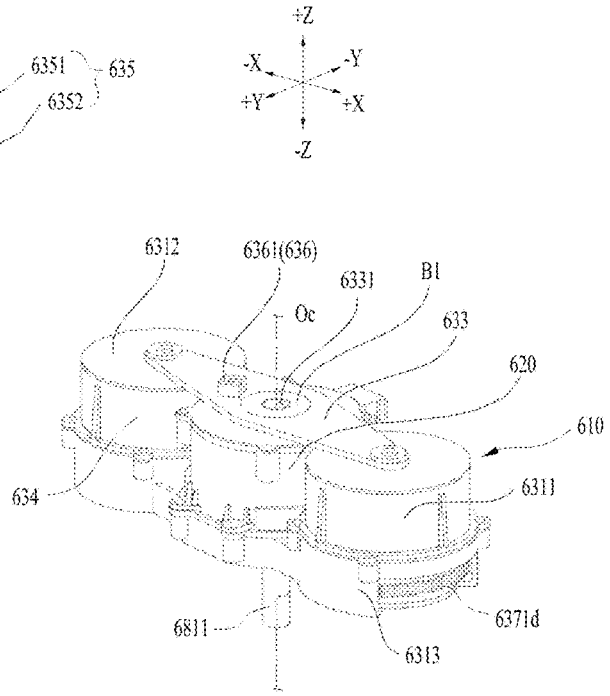

FIG. 8 shows an example in which the driver 610 is coupled. FIG. 9A shows the driver 610, the support member 670, and the motion converter 680. FIG. 9B shows the vibrating body 630.

Referring to FIGS. 8 to 9B, the driver elastic member 635 may be configured to be deformed or restored elastically when the driver 610 rotates with respect to the central axis Oc. The driver clastic member 635 may also be configured to be deformed or restored elastically when the vibrating body 630 rotates with respect to the central axis Oc.

The driver clastic member 635 may restrict the driver 610 to vibrate within a predetermined angle range. Thus, the elastic force of the driver elastic member 635 and the centrifugal force of first and second eccentric parts 6341 and 6342 may determine the vibration pattern (amplitude and frequency) of the driver 610. This is because second order harmonic oscillation, which is roughly determined by the mass, spring, and damper, is performed.

The vibration pattern of the driver 610 may be determined by the amplitude and frequency of the driver 610. The frequency of the driver 610 means the number of times that the driver 610 reciprocates, and more particularly, the number of times that the driver 610 rotates in the first rotation direction from an initial position, rotates in the second rotation direction opposite to the first rotation direction, and then returns to the initial position for a predetermined period of time. As a unit of frequency, the number of cycles per second (Hz) or the number of rounds per minute (RPM) is often used. The amplitude of the driver 610 may mean a predetermined angle at which the driver 610 rotates.

The vibration pattern of the driver 610 may be changed to the reciprocation of the hanger bar 693 by the motion converter 680, and eventually the vibration pattern of the driver 610 may determine the amplitude and frequency of the hanger bar 693. The amplitude of the hanger bar 693 refers to the maximum distance from the initial position when the hanger bar 693 moves from the initial position in the movement direction (+X, −X). The frequency of the hanger bar 693 refers to the number of times that the hanger bar 693 returns to the initial position after reciprocating once from the initial position in the movement direction for a predetermined time. Similarly, the number of cycles per second (Hz) or the number of rounds per minute (RPM) is often used as a unit of frequency. In this specification, unless otherwise specified, RPM may mean the number of rounds per minute of the hanger bar 693, and amplitude may also mean the amplitude of the hanger bar 693.

In addition, the time required for the hanger bar 693 to reciprocate once may be represented as a period, which may be expressed as the reciprocal of frequency.

One end of the driver elastic member 635 may be fixed to the vibrating body 630, and the other end may be fixed to the support member 670. The driver elastic member 635 may include a spring.

As described above, the driver 610 may include: the motor 620 configured to generate torque; the vibrating body 630 configured to support the motor 620 and vibrate alternately in the first and second rotation directions opposite to each other by the rotation of the motor 620; and the motion converter 680 configured to rotate together with the vibrating body 630 and convert the vibration of the vibrating body 630 to allow the hanger bar 693 to reciprocate along a predetermined movement direction in connection with the hanger bar 693.

The vibrating body 630 may be connected to the support frame 15 through the support member 670. In addition, the vibrating body 630 may define the exterior of the driver 610. The vibrating body 630 may be configured to be rotate relative to the support frame 15 around the central axis Oc configured with respect to the motor rotation shaft 625.

The support member 670 may be configured to rotatably support the vibrating body 630. In addition, the vibrating body 630 may be configured to be rotate within a predetermined angle range. For example, the support frame 15 or the support member 670 may include a limiter (not shown) contactable with the vibrating body 630 to limit the rotation range of the vibrating body 630. Alternatively, based on the fact that the elastic force of the driver elastic member 635 increases as the vibrating body 630 further rotates, the rotation range of the vibrating body 630 may be limited with no limiter.

The vibrating body 630 may further include a first eccentric part 6341 having eccentric weight and configured to rotate with respect to a first rotation axis Ow1 parallel to the motor rotation shaft (or central axis Oc) in connection with the motor 620; and a second eccentric part 6342 having eccentric weight and configured to rotate with respect to a second rotation axis Ow2 parallel to the motor rotation shaft 625 in connection with the motor 620. The second rotation axis Ow2 may be located opposite to the first rotation axis Ow1 with respect to the motor rotation shaft 625 along the width direction of the cabinet 10.

The vibrating body 630 may be configured to rotatably support the motor 620, the first eccentric part 6341, and the second eccentric part 6342. The first and second eccentric parts 6341 and 6342 may be configured to rotate by the rotation of the motor 620 and vibrate the vibrating body 630 alternately in the first and second rotation directions, which are opposite to each other. The vibrating body 630 may be configured to support the motor 620. The vibrating body 630 and the motion converter 680 may be coupled so that they rotate together. The vibrating body 630 may be configured to support weight shafts 6381 and 6382. In addition, the vibrating body 630 may be configured to support the first eccentric part 6341 and the second eccentric part 6342. The vibrating body 630 may be configured to accommodate the first eccentric part 6341 and the second eccentric part 6342 therein.

The vibrating body 630 may further include: a vibration base 6313 configured to support the motor 620, the first eccentric part 6341, and the second eccentric part 6342; and a vibration case 631 coupled to the vibration base 6313 and configured to define a space for accommodating the first eccentric part 6341 and the second eccentric part 6342.

The driver 610 may include the first eccentric part 6341 configured to rotate around the first rotation axis Ow1 spaced apart from the central axis Oc in such a way that the weight is off-center. The first eccentric part 6341 may be configured to rotate around the first rotation axis Ow1 in such a way that the weight is off-center. The driver 610 may include the second eccentric part 6342 configured to rotate around the second rotation axis Ow2 spaced apart from the central axis Oc in such a way that the weight is off-center. The second eccentric part 6342 may be configured to rotate around the second rotational axis Ow2 in such a way that the weight is off-center.

The first rotation axis Ow1 and the second rotation axis Ow2 may be the same as or different from each other. The second rotation axis Ow2 may be the same as or parallel to the first rotation axis Ow1. FIGS. 8 to 9B show an example in which the first rotation axis Ow1 and the second rotation axis Ow2 are parallel to each other.

Referring to FIGS. 9A and 9B, the driver 610 may include an elastic member engaging part 636 that engages with one end of the driver elastic member 635. When the driver 610 rotates with respect to the central axis Oc, the driver elastic member 635 may be elastically deformed by the clastic member engaging part 636, or the restoring force of the driver elastic member 635 may be transferred to the elastic member engaging part 636. Thus, the elastic member engaging part 636 may be positioned on the vibrating body 630.

The elastic member engaging part 636 may include a first elastic member engaging part 6361 that engages with one end of a first elastic member 6351. The first elastic member engaging part 6361 may be formed above a connecting arm 633. The elastic member engaging part 636 may further include a second elastic member engaging part 6362 that engages with one end of a second elastic member 6352. The second elastic member engaging part (not shown) may be formed on the lower side of the vibration base 6313. The elastic member engaging part 636 may include a third elastic member engaging part (not shown) that engages with one end of a third elastic member (not shown). The third elastic member engaging part may be formed in the motion converter 680.

The driver elastic member 635 may be disposed between the driver 610 and the support member 670. One end of the driver clastic member 635 may engages with the driver 50, and the other end may engage with an elastic member seating part 677 of the support member 670. The driver clastic member 635 may be a torsion spring.

The driver clastic members 6351 and 6352 may include one or more elastic members. Each of the driver elastic members 6351 and 6352 may be configured to be elastically deformed when the driver 610 rotates in one of the first rotation direction and the second rotation direction and elastically restored when the driver 610 rotates in the other direction.

The first elastic member 6351 may be disposed above the driver 610. One end of the first elastic member 6351 may engage with the first elastic member engaging part 6361, and the other end may engage with a first seating part 6771 of the support member 670. The first elastic member 6351 may include a torsion spring disposed around a central axis part 675.

The second clastic member 6352 may be disposed below the driver 610. One end of the second elastic member 6352 may engage with the second elastic member engaging part 6362 of the driver 610, and the other end may engage with a second seating part 6772 of the support member 670. The second elastic member 6352 may include a torsion spring disposed around a support base plate through-hole 6711 located in a support base plate 671 to face the central axis part 675.

The third elastic member (not shown) may be disposed below the support base plate 671. The third elastic member may be disposed between the support base plate 671 and the motion converter 680. One end of the third elastic member may engage with the third engaging part (not shown) of the driver 610, and the other end may engage with a third seating part (not shown) of the support member 670. The third elastic member may include a torsion spring disposed around the rotation protrusion 6811.

The support member 670 may include the support base plate 671 disposed below the vibrating body 630. The support base plate 671 may be formed in the shape of a horizontal plate. The support base plate 671 may have the support base plate through-hole 6711 formed on the central axis Oc, and the rotation protrusion 6811 may be inserted into the support base plate through-hole 6711. A bearing B2 may be disposed on the support base plate through-hole 6711 so that the rotation protrusion 6811 may be rotatably supported.

The support member 670 may further include a support upper plate 672 disposed above the vibrating body 630 and a support extension part 673 configured to connect the support upper plate 672 and the support base plate 671.

The support upper plate 672 may be formed in the shape of a horizontal plate. The support member 670 may include the central axis part 675 protruding from the support upper plate 672 along the central axis Oc. The central axis part 675 may protrude downward from the lower surface of the support upper plate 672. The lower end of the central axis part 675 may be inserted into a rotation shaft connection groove 6331, which passes through a connection box. The central axis part 675 may be configured to rotatably support the vibrating body 630 through a bearing B1.

The support extension part 673 may extend in the height direction of the cabinet 10 and configured to connect the support upper plate 672 and the support base plate 671. A pair of support extension parts 673 may be disposed at both ends of the support upper plate 672.

The support member 670 may include the elastic member seating part 677 that engages with one end the driver elastic member 635. The first seating part 6771 may be fixed to the lower surface of the support upper plate 672, and the second seating part 6772 may be fixed to the upper surface of the support base plate 671. The third seating part (not shown) may be located on the lower side of the support base plate 671.

The motion converter 680 may be coupled to the vibrating body 630 so that the motion converter 680 may rotate together with the vibrating body 630. The motion converter 680 may be connected to the hanger bar 693 at a location Oh apart from the central axis Oc by a predetermined distance. The motion converter 680 may forward the vibration of the vibrating body 630 to the hanger bar 693.

The motion converter 680 may be configured to transfer the vibration of the vibrating body 630 to the hanger bar 693 on the connection axis Oh. The motion converter 680 may include the rotation protrusion 6811 protruding along the connection axis Oh. The rotation protrusion 6811 may protrude parallel to the central axis Oc from the vibrating body 630 toward the hanger bar 693. The connection protrusion 6813 may protrude along the connection axis Oh. In addition, the rotation protrusion 6811 and the connection protrusion 6813 may be connected by the connecting rod 6812.

One end of the connection protrusion 6813 may be inserted into the slot 694. Thus, the motion converter 680 may be configured to convert the vibration of the driver 610 to reciprocate the hanger bar 693 in a predetermined movement or vibration direction.

Figure 10:
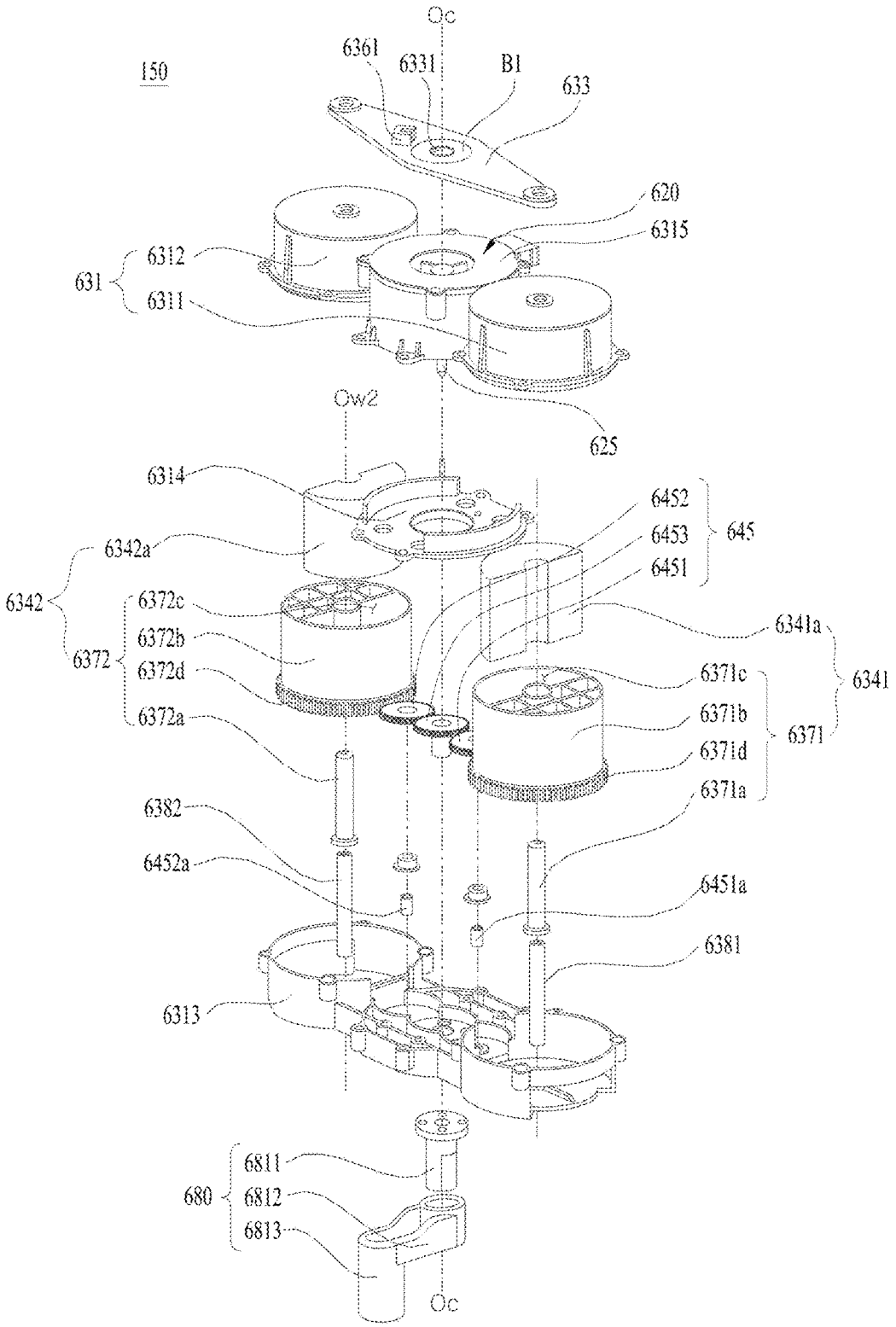
FIG. 10 is an exploded view of the driver.

FIG. 10 is an exploded view of the driver 610. As described above, the driver 610 may include the motor 620, the vibrating body 630 configured to support the motor 620 and vibrate alternately in clockwise and counterclockwise directions by the rotation of the motor 620, and the motion converter 680 configured to rotate together with the vibrating body 630 and convert the vibration of the vibrating body 630 to allow the hanger bar 693 to reciprocate along a predetermined movement direction in connection with the hanger bar 693. The driver 610 may further include the driver elastic member 635 so as to change the amplitude and frequency of the hanger bar 693 based on harmonic excitation characteristics.

The vibrating body 630 may further include the first eccentric part 6341 having eccentric weight and configured to rotate with respect to the first rotation axis Ow1 parallel to the motor rotation shaft (or central axis Oc) in connection with the motor 620; and the second eccentric part 6342 having eccentric weight and configured to rotate with respect to the second rotation axis Ow2 parallel to the motor rotation shaft 625 in connection with the motor 620. The second rotation axis Ow2 may be located opposite to the first rotation axis Ow1 with respect to the motor rotation shaft 625 along the width direction of the cabinet 10.

The vibrating body 630 may be configured to rotatably support the motor 620, the first eccentric part 6341, and the second eccentric part 6342. The first and second eccentric parts 6341 and 6342 may be configured to rotate by the rotation of the motor 620 and vibrate the vibrating body 630 alternately in the first and second rotation directions, which are opposite to each other.

The first eccentric part 6341 may be supported by the vibrating body 630. The first eccentric part 6341 may be rotatably supported by a first weight shaft 6381 disposed on the vibrating body 630. The second eccentric part 6342 may be supported by the vibrating body 630. The second eccentric part 6342 may be rotatably supported by a second weight shaft 6382 disposed on the vibrating body 630.

The centers of mass of the first eccentric part 6341 and the second eccentric part 6342 have a phase difference of 180 degrees, and the rotation directions of the first eccentric part 6341 and the second eccentric part 6342 may be the same. That is, when the first eccentric part 6341 rotates in the first rotation direction, the second eccentric part 6342 may also rotate in the first rotation direction. When the first eccentric part 6341 rotates in the second rotation direction opposite to the first rotation direction, the second eccentric part 6342 may also rotate in the second rotation direction. To this end, the vibrating body 630 may further include: a gear-shaped central transfer unit 6453 based on the rotation of the motor 620; and gear-shaped first and second transfer units 6451 and 6452 provided on both sides of the central transfer unit 6453 and configured to rotate the first eccentric part 6341 and the second eccentric part 6342 in the same direction.

In summary, the centers of mass of the first eccentric part 6341 and the second eccentric part 6342 may have the 180 degrees phase difference with respect to each other, and the rotation directions of the first eccentric part 6341 and the second eccentric part 6342 may be the same.

Since the central transfer unit 6453, the first transfer unit 6451, and the second transfer unit 6452 are configured to engage and rotate together as gears, the rotation directions of the first and second transfer units 6451 and 6452 may be determined by the rotation direction of the central transfer unit 6453, that is, the first and second transfer units 6451 and 6452 may be configured to be rotate in the same direction.

Alternatively, the central transfer unit 6453 may be directly connected to a first rotation part 6371 and a second rotation part 6372 in the form of a gear or pulley without the first transfer unit 6451 and the second transfer unit 6452.

The first eccentric part 6341 may include the first rotation part 6371 configured to rotate around the first rotation axis Ow1 in contact with a rotation transfer unit 645. The first rotation part 6371 may be configured to receive torque from the rotation transfer unit 645. The rotation force may be transferred by a gear-shaped first rotation ring gear 6371*d* located on the outer peripheral surface of the first rotation part 6371 and configured to engage with the first transfer unit 6451. The first rotation part 6371 may have the shape of a cylinder centered on the first rotation axis Ow1.

The first eccentric part 6341 may include a first weight member 6341*a* fixed to the first rotation part 6371. The first weight member 6341*a* may be configured to rotate together with the first rotation part 6371. The first weight member 6341*a* may be made of a material heavier than that of the first rotation part 6371. The first weight member 6341*a* may be disposed on one side with respect to the first rotation axis Ow1 and cause the weight of the first eccentric part 6341 to be off-centered.

The first weight member 6341*a* may be formed in the shape of a column with a semicircular bottom. The first weight member 6341*a* may be disposed within an angular range of 180 degrees with respect to the first rotation axis Ow1 at a certain point in time during rotation of the first eccentric part 6341.

The second eccentric part 6342 may include the second rotation part 6372 configured to rotate around the first rotation axis Ow1 in contact with the rotation transfer unit 645. The second eccentric part 6342 may be configured to receive torque from the rotation transfer unit 645. The rotation force may be transferred by a gear-shaped second rotation ring gear 6372*d* located on the outer peripheral surface of the second rotation part 6372 and configured to engage with the second transfer unit 6452. The second rotation part 6372 may have the shape of a cylinder centered on the second rotation axis Ow2.

The second eccentric part 6342 may include a second weight member 6342*a* fixed to the second rotation part 6372. The second weight member 6342*a* may be configured to rotate together with the second rotation part 6372. The second weight member 6342*a* may be made of a material heavier than that of the second rotation part 6372. The second weight member 6342*a* may be disposed on one side with respect to the second rotation axis Ow2 to cause the weight of the second eccentric part 6342 to be off-centered.

The second weight member 6342*a* may be formed in a column with a semicircular bottom. The second weight member 6342*a* may be disposed within an angular range of 180 degrees with respect to the second rotation axis Ow2 at any time during the rotation of the second eccentric part 6342.

The first rotation part 6371 and the second rotation part 6372 may have the same weight within a permissible error range in the manufacturing process. In addition, the first weight member 6341*a* and the second weight member 6342*a* may have the same weight.

The driver 610 may include the motor 620 configured to generate the torque of the first eccentric part 6341 and the second eccentric part 6342. The motor 620 may be disposed in the vibrating body 630. That is, the motor 620 may be positioned between the first eccentric part 6341 and the first eccentric part 6341. The motor 620 may include the motor rotation shaft 625 configured to rotate. For example, the motor 620 may include a rotor and a stator, and the motor rotation shaft 625 may be configured to rotate integrally with the rotor. The motor rotation shaft 625 may be configured to transfer the torque to the rotation transfer unit 645.

That is, the driver 610 may include the rotation transfer unit 645 configured to transfer the torque of the motor 620 to the first eccentric part 6341 and the second eccentric part 6342. The rotation transfer unit 645 may include a gear, a belt, and/or a pulley.

The driver 610 may include a weight shaft 638 configured to serve as the first rotation axis Ow1 and the second rotation axis Ow2. The weight shaft 638 may include the first weight shaft 6381 forming the first rotation axis Ow1 and the second weight shaft 6382 forming the second rotation axis Ow2. The weight shafts 6381 and 6382 may be fixed to the vibrating body 630. The weight shafts 6381 and 6382 may be disposed on the first rotation axis Ow1 and/or second rotation axis Ow2 and pass through the first eccentric part 6341 and/or the second eccentric part 6342.

The vibrating body 630 may include the vibration case 631 configured to accommodate the first eccentric part 6341 and the second eccentric part 6342 therein. The vibration case 631 may define the exterior of an upper portion of the driver 610. The motor 620 may also be accommodated in the vibration case 631.

The upper ends of the weight shafts 6381 and 6382 may be fixed to the vibration case 631. The vibration case 631 may include a first vibration case 6311 configured to cover the upper portion of the first eccentric part 6341 and a second vibration case 6312 configured to cover the upper portion of the second eccentric part 6342. The upper end of the first weight shaft 6381 may be fixed to the first vibration case 6311. The upper end of the second weight shaft 6382 may be fixed to the second vibration case 6312. A motor case 6315 may be positioned between the first vibration case 6311 and the second vibration case 6312.

The vibrating body 630 may further include the vibration base 6313 defining the exterior of the lower portion thereof. The lower ends of the weight shafts 6381 and 6382 may be fixed to the vibration base 6313. The first eccentric part 6341 and the second eccentric part 6342 may be accommodated between the vibration case 631 and the vibration base 6313. The first eccentric part 6341 may be positioned between the first vibration case 6311 and the vibration base 6313, and the second eccentric part 6342 may be positioned between the second vibration case 6312 and the vibration base 6313.

The vibrating body 630 may include a motor support part 6314 configured to support the motor 620. The motor support part 6314 may support one surface of the motor 620 positioned in a direction in which the motor rotation shaft 625 protrudes. The motor support part 6314 may be disposed between the first vibration case 6311 and the second vibration case 6312. The motor rotation shaft 625 may pass through the motor support part 6314. The motor support part 6314 may be fixed to the vibration case 631 or integrated with the vibration case 631.

The vibrating body 630 may include the connecting arm 633 that engages with one end of at least one driver elastic member 60*a*. The connecting arm 633 may be disposed on the upper side of the vibrating body 630. The connection arm 633 may be fixed to the upper ends of the first vibration case 6311 and the second vibration case 6312. The connecting arm 633 may cross the central axis Oc. The central axis part 675 may pass through the connecting arm 633.

The vibrating body 630 may include the rotation shaft connection groove 6331 or a hole into which the central axis part 675 is inserted. The rotation shaft connection groove 6331 may be formed on the upper and/or lower side of the vibrating body 630. In this embodiment, the rotation shaft connection groove 6331 may be formed in the connecting arm 633. The bearing B1 may be disposed in the rotation shaft connection groove 6331 so that the vibrating body 630 may be rotatably supported with respect to the central axis part 675.

The motor 620 may be disposed on the central axis Oc. The motor 620 may be positioned between the first eccentric part 6341 and the second eccentric part 6342. The motor 620 may include the motor rotation shaft 625 disposed on the central axis Oc. The motor rotation shaft 625 may protrude downward and be connected to the rotation transfer unit 645. Accordingly, it is possible to prevent eccentricity to one side with respect to the central axis Oc due to the weight of the motor 620.

Transfer units 6451 and 6452 may include central transfer unit 6453 configured to rotate together with the motor rotation shaft 625. The central transfer units 6453 may be fixed to the motor rotation shaft 625. The transfer units 6451 and 6452 may include first transfer units 6451 including gears or belts for transferring the torque of the central transfer unit 6453 to the first eccentric part 6341. The transfer units 6451 and 6452 may include second transfer units 6452 including gears or belts for transferring the torque of the central transfer unit 6453 to the second eccentric part 6342.

The first weight shaft 6381 and the second weight shaft 6382 may be made of different materials. The first weight shaft 6381 may be disposed on the first rotation axis Ow1, and the second weight shaft 6382 may be disposed on the second rotation axis Ow2. The first weight shaft 6381 and the second weight shaft 6382 may be located in opposite directions with respect to the central axis Oc. Thus, the first weight shaft 6381 and the second weight shaft 6382 may be symmetrically disposed with respect to the central axis Oc. The first weight shaft 6381 and the second weight shaft 6382 may be fixed to the vibrating body 630. The first weight shaft 6381 may pass through the first rotation part 6371, and the second weight shaft 6382 may pass through the second rotation part 6372.

The first eccentric part 6341 and the second eccentric part 6342 may be located in opposite directions with respect to the central axis Oc. That is, the first eccentric part 6341 and the second eccentric part 6342 may be arranged to face with each other horizontally. The first eccentric part 6341 may be disposed on one side (+X) in the vibration direction (+X, −X), and the second eccentric part 6342 may be disposed on the other side (−X).

The first eccentric part 6341 may include the first weight member 6341*a* and the first rotation part 6371. The first rotation part 6371 may include a central portion 6371*a* configured to rotate in contact with the first weight shaft 6381. The first weight shaft 6381 may pass through the central portion 6371*a*. The central portion 6371*a* may extends along the first rotation axis Ow1. The center portion 6371*a* may have a hole at the center thereof along the first rotation axis Ow1. That is, the central portion 6371*a* may have a pipe shape.

The first rotation part 6371 may include a peripheral portion 6371*b* mounted on the central portion 6371*a*. The central portion 6371*a* may pass through the peripheral portion 6371*b*. The peripheral portion 6371*b* may have the shape of a cylinder that extends along the first rotation axis Ow1. A weight mounting groove 6371*c* in which the first weight member 6341*a* rests may be formed in the peripheral portion 6371*b*. The weight mounting groove 6371*c* may be formed in such a way that the top is open. A centrifugal side of the weight mounting groove 6371*c* in the distal direction with respect to the first rotation axis Ow1 may be blocked. The peripheral portion 6371*b* and the first weight member 6341*a* may be configured to rotate together.

The second eccentric part 6342 may include the second weight member 6342*a* and the second rotation part 6372. The second rotation part 6372 may include a central portion 6372*a* configured to rotate in contact with the second weight shaft 6382. The second weight shaft 6382 may pass through the central portion 6372*a*. The central portion 6372*a* may extend along the second rotation axis Ow2. The center portion 6372*a* may have a hole at the center thereof along the second rotation axis Ow2. That is, the central portion 6372*a* may have a pipe shape.

The second rotation part 6372 may include a peripheral portion 6372*b* mounted on the central portion 6372*a*. The central portion 6372*a* may pass through the peripheral portion 6372*b*. The peripheral portion 6372*b* may have the shape of a cylinder that extends along the second rotation axis Ow2. A weight mounting groove 6372*c* in which the second weight member 6342*a* rests may be formed in the peripheral portion 6372*b*. The weight mounting groove 6371*c* may be formed in such a way that the top is open. A centrifugal side of the weight mounting groove 6372*c* in the distal direction with respect to the second rotation axis Ow2 may be blocked. The peripheral portion 6372*b* and the first weight member 6342*a* may be configured to rotate together.

The motion converter 680 may include the rotation protrusion 6811 fixed to the vibrating body 630. The upper end of the rotation protrusion 6811 may be fixed to the lower portion of the vibrating body 630. Thus, the rotation protrusion 6811 may be configured to rotate together with the vibrating body 630.

The rotation protrusion 6811 may pass through the support base plate 671 along the central axis Oc. The bearing B2 may be disposed between the rotation protrusion 6811 and the support base plate 671. Thus, the rotation protrusion 6811 may be rotatably supported by the support base plate 671. The rotation protrusion 6811 may be configured to transfer the torque of the vibrating body 630 to the hanger bar 693 through the connecting rod 6812 and the connection protrusion 6813.

The connecting rod 6812 may be configured to rotate together with the rotation protrusion 6811. The connection protrusion 6813 extending in the direction of the connection axis Oh may be connected to one end of the connecting rod 6812. The connection protrusion 6813 may be inserted into the slot 694 to convert the vibration of the vibrating body 630 into the reciprocation of the hanger bar 693.

In this document, the movement or vibration direction of the hanger bar 693 (+X, −X) means a predetermined direction in which the hanger bar 693 reciprocates, and in this embodiment, the vibration direction of (+X, −X) is left and right.

In this document, the central axis Oc, first rotation axis Ow1, second rotation axis Ow2, and connection axis Oh are virtual axes for describing the present disclosure and do not refer to actual device components.

The central axis Oc refers to an imaginary straight line serving as the rotation center of the driver 610. The central axis Oc is an imaginary straight line that maintains a fixed position relative to the cabinet 10. The central axis Oc may extend along the height direction of the cabinet 10.

In this embodiment, the central axis part 675 protruding from the support member 670 along the central axis Oc may be formed, and the support base plate through-hole 6711 or a through-hole that rotatably engages with the central axis part 675 may be formed in the in the vibrating body 630 in provide the function of the central axis Oc. In another embodiment, a protrusion protruding along the central axis Oc may be formed in the vibrating body 630, and a groove that rotatably engages the protrusion may be formed in the support member 670 to provide the function of the central axis Oc.

The first rotation axis Ow1 refers to an imaginary straight line serving as the rotation center of the first eccentric part 6341. The first rotation axis Ow1 maintains a fixed position with respect to the vibrating body 630. That is, even if the vibrating body 630 moves, the first rotation axis Ow1 moves integrally with the vibrating body 630 and maintains a relative position with respect to the vibrating body 630. The first rotation axis Ow1 may extend along the height direction of the cabinet 10.

In this embodiment, the first weight shaft 6381 may be disposed on the first rotation axis Ow1 to provide the function of the first rotation axis Ow1. In another embodiment, a protrusion protruding along the first rotation axis Ow1 may be formed in one of the first eccentric part 6341 and the vibrating body 630, and a groove that rotatably engages with the protrusion may be formed in the other one in order to provide the function of the first rotation axis Ow1.

The second rotation axis Ow2 refers to an imaginary straight line serving as the rotation center of the second eccentric part 6342. The second rotation axis Ow2 maintains a fixed position relative to the vibrating body 630. That is, even if the vibrating body 630 moves, the second rotation axis Ow2 moves integrally with the vibrating body 630 and maintains a relative position with respect to the vibrating body 630. The second rotation axis Ow2 may extend along the height direction of the cabinet 10.

In this embodiment, the second weight shaft 6382 may be disposed on the second rotation axis Ow2 to provide the function of the second rotation axis Ow2. In another embodiment, a protrusion protruding along the second rotation axis Ow2 may be formed in one of the second eccentric part 6342 and the vibrating body 630, and a groove that rotatably engages with the protrusion may be formed in the other one in order to provide the function of the second rotation axis Ow2.

The connection axis Oh refers to an imaginary straight line spaced apart from the central axis Oc. The connection axis Oh is arranged parallel to the central axis Oc. The connection axis Oh maintains a fixed position relative to the vibrating body 630. That is, even if the vibrating body 630 moves, the connection axis Oh moves integrally with the vibrating body 630 and maintains a relative position with respect to the vibrating body 630. The connection axis Oh may extend in the vertical direction. The motion converter 680 may be provided along the connection axis Oh at a connection point between the driver 610 and the hanger bar 693 so that the alternate rotation (vibration) of the driver 610 is converted into the linear reciprocation of the hanger bar 693.

A circumferential direction D1 means a circumferential direction centered on the central axis Oc, and includes a first rotation direction D11 and a second rotation direction D12 opposite to the first rotation direction D11. The first rotation direction D11 and the second rotation direction D12 are defined based on a state viewed from one direction (+Z) of the extension directions (+Z, −Z) of the central axis Oc.

When the direction of centrifugal force F1 about the first rotation axis Ow1 due to the rotation of the first eccentric part 6341 is equal to the circumferential direction D1, the centrifugal force F1 may cause the vibrating body 630 to rotate with respect to the central axis Oc. In addition, when the direction of centrifugal force F2 about the second rotation axis Ow2 due to the rotation of the second eccentric part 6342 is equal to the circumferential direction D1, the centrifugal force F2 may cause the vibrating body 630 to rotate with respect to the central axis Oc.

A diameter direction Dr refers to a direction transverse to the central axis Oc and includes a centrifugal direction Dr1 and a centripetal direction Dr2. The centrifugal direction Dr1 means a direction away from the central axis Oc, and the centripetal direction Dr2 means a direction closer to the central axis Oc.

When the direction of the centrifugal force F1 about the first rotation axis Ow1 due to the rotation of the first eccentric part 6341 is equal to the diameter direction Dr, the centrifugal force F1 does not cause the vibrating body 630 to rotate with respect to the central axis Oc. When the direction of the centrifugal force F2 about the second rotation axis Ow2 due to the rotation of the second eccentric part 6342 is equal to the diameter direction Dr, the centrifugal force F2 does not cause the vibrating body 630 to rotate with respect to the central axis Oc.

FIGS. 11 to 14 are simplified views of the driver 610 to explain the harmonic excitation motion of the driver 610.

FIGS. 11 to 14 show the center of mass m1 of the first eccentric part 6341, the center of mass m2 of the second eccentric part 6342, and the radius of rotation r1 of the center of mass m1 with respect to the first rotation axis Ow1, the radius of rotation r2 of the center of mass m2 with respect to the second rotation axis Ow2, the angular speed w of the first eccentric part 6341 with respect to the first rotation axis Ow1, and the angular speed w of the second eccentric part 6342 with respect to the second rotation axis Ow2, the distance A1 between the central axis Oc and the first rotation axis Ow1, the distance A2 between the central axis Oc and the second rotation axis Ow2, and the distance B between the central axis Oc and the connection axis Oh.

FIGS. 11 to 14 show the direction of the centrifugal force F1 of the first eccentric part 6341 about the first rotation axis Ow1 and the direction of the centrifugal force F2 of the second eccentric part 6342 about the second rotation axis Ow2. The sum of the centrifugal force F1 of the first eccentric part 6341 and the centrifugal force F2 of the second eccentric part 6342 may be the torque of the vibrating body 630. An excitation force Fo may be represented as an external force having a point of action on the connection axis Oh by considering moment arm lengths A1, A2, and B for the sum of the centrifugal force F1 and the centrifugal force F2.

The magnitude of the centrifugal force F1 is $m1 \cdot r1 \cdot w^2$, and the magnitude of the centrifugal force F2 is $m2 \cdot r2 \cdot w^2$. The centrifugal force F1 of the first eccentric part 6341 and the centrifugal force F2 of the second eccentric part 6342 are applied to the vibrating body 630, and the point of action of the centrifugal force F1 of the first eccentric part 6341 and the point of action of the centrifugal force F2 of the second eccentric part 6342 may be a point on the first rotation axis Ow1 and a point on the second rotation axis Ow2, respectively. Since the first eccentric part 6341 and the second eccentric part 6342 rotate at the same speed by the rotation transfer unit 645, the first eccentric part 6341 and the second eccentric part 6342 may rotate at the same angular speed w.

Figure 11:
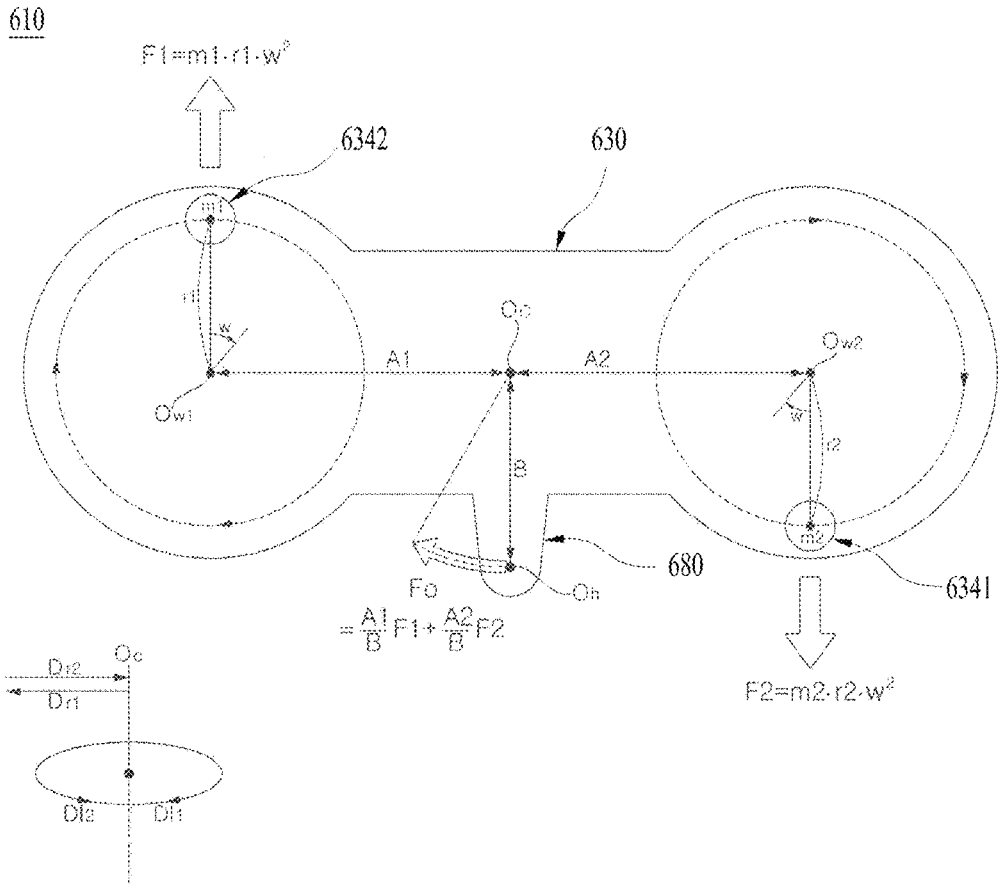
FIGS. 11 to 14 show states in which a first eccentric part 6341 and a second eccentric part 6342 rotate by 90 degrees at the same angular speed w to explain the principle of the driver in brief.

Referring to FIG. 11, the centrifugal force F1 of the first eccentric part 6341 and the centrifugal force F2 of the second eccentric part 6342 may reinforce each other when the torque of the vibrating body 630 is generated around the central axis Oc. That is, when the weight of the first eccentric part 6341 is off-centered from the first rotation axis Ow1 in one direction D1 of the first rotation direction D11 and the second rotation direction D12 with respect to the central axis Oc, the weight of the second eccentric part 6342 may be off-centered from the second rotation axis Ow2 in the direction D1.

When the first eccentric part 6341 generates centrifugal force about the first rotation axis Ow1 in one direction D1 of the first rotation direction D11 and the second rotation direction D12 with respect to the central axis Oc, the second eccentric part 6342 may generates centrifugal force about the second rotation axis Ow2 in the direction D1. In this case, the moment $A1 \cdot F1 + A2 \cdot F2$ caused by the centrifugal force F1 of the first eccentric part 6341 and the centrifugal force F2 of the second eccentric part 6342 is the same as the moment $B \cdot Fo$ caused by the excitation force Fo. Thus, the excitation force Fo may be $(A1 \cdot F1 + A2 \cdot F2)/B$. Accordingly, in the example of FIG. 11, the vibrating body 630 may rotate clockwise so that the motion converter 680 may also rotate clockwise.

Figure 12:
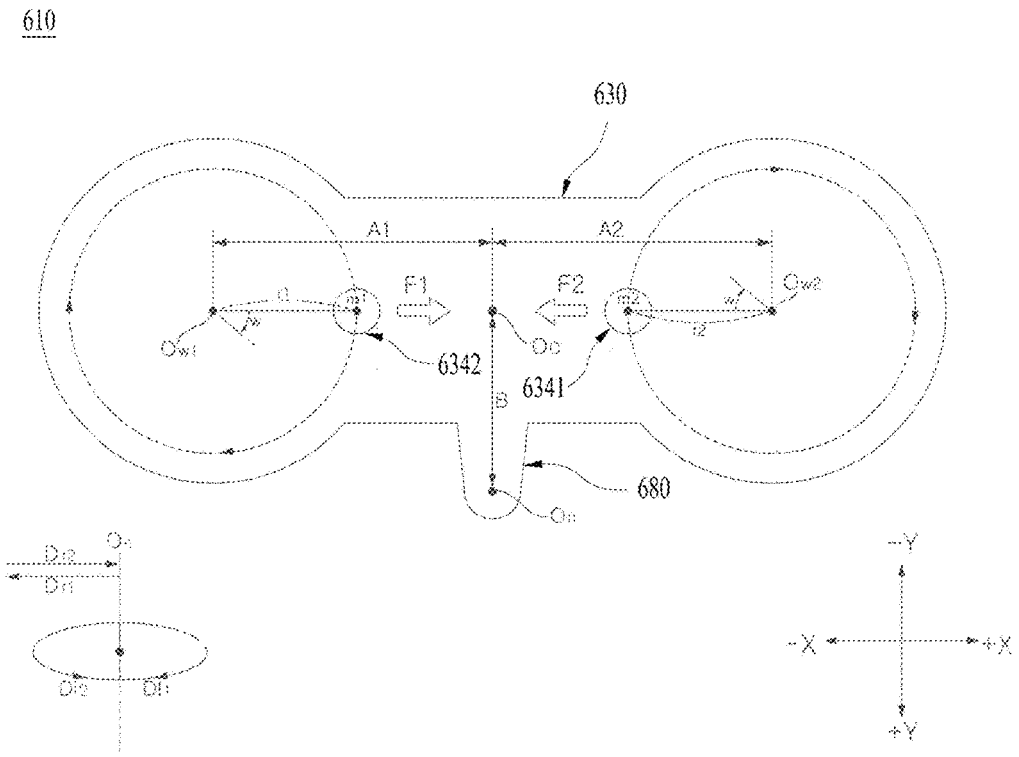

Referring to FIG. 12, the centrifugal force F1 of the first eccentric part 6341 and the centrifugal force F2 of the second eccentric part 6342 are directed in opposite directions with respect to the central axis Oc of the vibrating body 630. In this case, since the resultant force becomes 0, there occurs no torque. When the weight of the first eccentric part 6341 is off-centered from the first rotation axis Ow1 in one direction D2 of the centrifugal direction Dr1 and the centripetal direction Dr2 with respect to the central axis Oc, the weight of the second eccentric part 6342 may be off-centered from the second rotation axis Ow2 in the direction opposite to the direction D2.

In this case, since the centrifugal force F1 and the centrifugal force F2 act in opposite directions, and therefore the sum of the centrifugal forces F1 and F2 is equal to the difference between the magnitude of the centrifugal force F1 and the magnitude of the centrifugal force F2. Thus, at least one of the centrifugal forces F1 and F2 may be offset by the other.

Therefore, the driver 610 moves the hanger bar 693 by rotation. In this case, the centrifugal force F1 of the first eccentric part 6341 and the centrifugal force F2 of the second eccentric part 6342 in the circumferential direction D1, which cause the rotation of the driver 610, may reinforce each other, thereby generating vibration in the predetermined vibration direction (+X, −X), but the centrifugal force F1 of the first eccentric part 6341 and the centrifugal force F2 of the second eccentric part 6342 in the diameter direction Dr, which cause no rotation of the driver 610, may offset each other, thereby preventing the hanger bar 693 from vibrating in the direction (+Y, −Y) orthogonal to the vibration direction (+X, −X).

Preferably, the centrifugal force F1 of the first eccentric part 6341 and the centrifugal force F2 of the second eccentric part 6342 may completely offset each other when no torque is applied to the vibrating body 630. Here, the expression "completely offset" means that the sum of the centrifugal force F1 of the first eccentric part 6341 and the centrifugal force F2 of the second eccentric part 6342 is zero. This may minimize unnecessary vibrations generated in the direction (+Y, −Y) perpendicular to the predetermined vibration direction (+X, −X).

In order for the centrifugal force F1 of the first eccentric part 6341 and the centrifugal force F2 of the second eccentric part 6342 in the diameter direction Dr to completely offset each other, the scalar quantity $m1 \cdot r1$ and the scalar quantity $m2 \cdot r2$ may be set equal to each other.

The radius of rotation r1 of the center of mass m1 of the first eccentric part 6341 with respect to the first rotation axis Ow1 and the radius of rotation r2 of the center of mass m2 of the second eccentric part 6342 with respect to the second rotation axis Ow2 may be set equal ($r1=r2$). The mass m1 of the first eccentric part 6341 and the mass m2 of the second eccentric part 6342 may be set equal ($m1=m2$). Based on these two conditions ($r1=r2$ and $m1=m2$), the centrifugal force F1 of the first eccentric part 6341 and the centrifugal force F2 of the second eccentric part 6342 in the diameter direction Dr may completely offset each other. Even when the radius of rotation r1 and the radius of rotation r2 are different and the mass m1 and the mass m2 are different, if the scalar quantity $m1 \cdot r1$ and the scalar quantity $m2 \cdot r2$ are set equal to each other, the centrifugal force F1 of the first eccentric part 6341 and the centrifugal force F2 of the second eccentric part 6342 in the diameter direction Dr may completely offset each other.

The distance A1 between the first rotation axis Ow1 and the central axis Oc and the distance A2 between the second rotation axis Ow2 and the central axis Oc may be the same. In this case, the centrifugal force F1 and centrifugal force F2 contribute to the generation of the excitation force Fo in the same proportions, thereby preventing fatigue load from concentrating on either a region supporting the first eccentric part 6341 or a region supporting the second eccentric part 6342.

The first rotational axis Ow1 and the second rotational axis Ow2 may be spaced apart from the center axis Oc in the same direction or in opposite directions. The central axis Oc, the first rotation axis Ow1, and the second rotation axis Ow2 may be disposed to intersect perpendicularly to one virtual straight line. In the embodiments shown in FIGS. 4 to 10, the first rotation axis Ow1 and the second rotation axis Ow2 are spaced apart from the central axis Oc in opposite directions.

Therefore, the centrifugal force F1 of the first eccentric part 6341 and the centrifugal force F2 of the second eccentric part 6342 in the diameter direction Dr may offset each other.

The angular speed w of the first eccentric part 6341 around the first rotation axis Ow1 and the angular speed w of the second eccentric part 6342 around the second rotation axis Ow2 may be set equal to each other. This enables periodic reinforcement and offsetting of the centrifugal forces F1 and F2 caused by the rotation of the first and second eccentric part 6341 and 6342.

Here, the angular speed refers to a scalar only having magnitude with no direction of rotation, which is different from angular velocity, i.e., a vector having both direction of rotation and magnitude. That is, if the angular speed w of the first eccentric portion 6341 and the angular speed w of the second eccentric portion 6342 are equal, this does not mean that they rotate in the same direction.

Referring to FIGS. 11 to 14, the rotation direction of the first eccentric part 6341 around the first rotation axis Ow1 and the rotation direction of the second eccentric part 6342 around the second rotation axis Ow2 may be the same. The motion converter 680 may be fixed to the vibrating body 630 and rotate together with the vibrating body 630.

The first rotation axis Ow1 and the second rotation axis Ow2 are spaced apart from each other in opposite directions with respect to the central axis Oc. Also, the first rotation axis Ow1 and the second rotation axis Ow2 may be symmetrically disposed with respect to the central axis Oc. This may prevent the vibrating body 630 from being biased to one side with respect to the central axis Oc due to the weights m1 and m2 of the first and second eccentric parts 6341 and 6342.

Referring to FIGS. 11 to 14, when the centrifugal force F1 of the first eccentric part 6341 and the centrifugal force F2 of the second eccentric part 6342 offset each other, both the centrifugal force F1 of the first eccentric part 6341 and the centrifugal force F2 of the second eccentric part 6342 may act in either the centrifugal direction Dr1 or the centripetal direction Dr2.

FIGS. 11 to 14 show states in which the first eccentric part 6341 and the second eccentric part 6342 rotate by 90 degrees at the same angular speed w.

Referring to FIG. 11, when the first eccentric part 6341 generates the centrifugal force F1 with respect to the first rotation axis Ow1 in the first rotation direction D11, the second eccentric part 6342 generates the centrifugal force F2 with respect to the second rotation axis Ow2 in the first rotation direction D11. Accordingly, the centrifugal force F1 of the first eccentric part 6341 and the centrifugal force F2 of the second eccentric part 6342 reinforce each other, thereby generating torque for the vibrating body 630 in the first rotation direction D11. The excitation force Fo transferred to the hanger bar 693 on the connection axis Oh may act in the first rotation direction D11.

Referring to FIG. 12, when the first eccentric part 6341 generates the centrifugal force F1 with respect to the first rotation axis Ow1 in the centripetal direction Dr2, the second eccentric part 6342 generates the centrifugal force F2 with respect to the second rotation axis Ow2 in the centripetal direction Dr2. Accordingly, the centrifugal force F1 of the first eccentric part 6341 and the centrifugal force F2 of the second eccentric part 6342 generate no torque for the vibrating body 630. The excitation force Fo transferred to the hanger bar 693 on the connection axis Oh becomes zero. The centrifugal force F1 of the first eccentric part 6341 and the centrifugal force F2 of the second eccentric part 6342 may act in opposite directions and thus offset each other.

Figure 13:
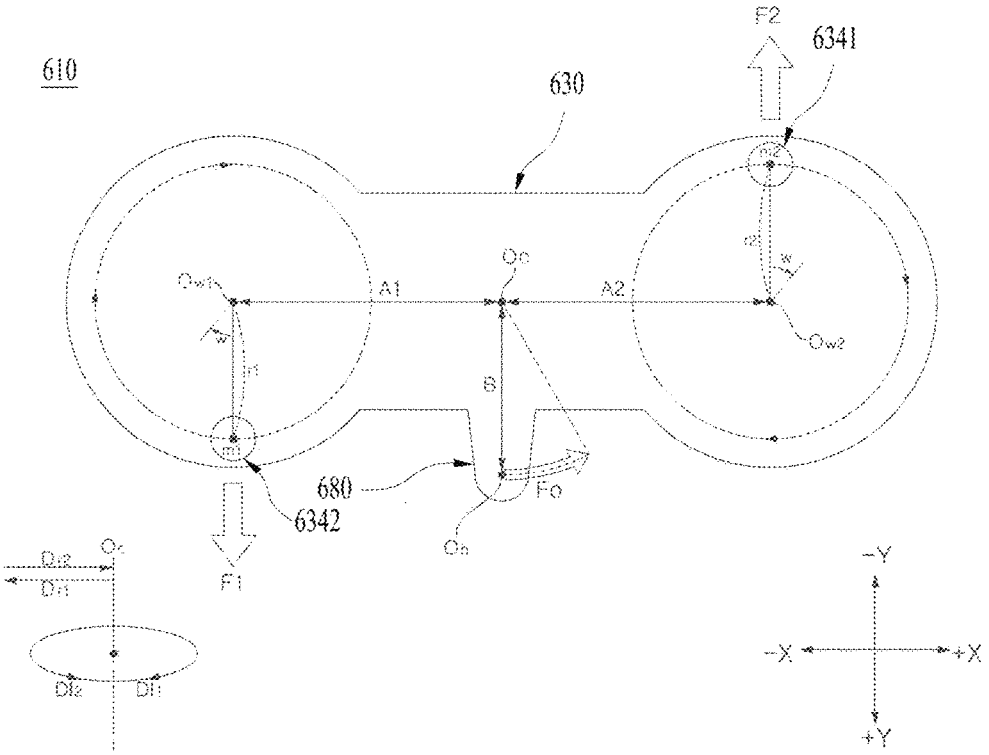

Referring to FIG. 13, when the first eccentric part 6341 generates the centrifugal force F1 with respect to the first rotation axis Ow1 in the second rotation direction D12, the second eccentric part 6342 generates the centrifugal force F2 with respect to the second rotation axis Ow2 in the second rotation direction D12. Accordingly, the centrifugal force F1 of the first eccentric part 6341 and the centrifugal force F2 of the second eccentric part 6342 reinforce each other, thereby generating torque for the vibrating body 630 in the second rotation direction D12. The excitation force Fo transferred to the hanger bar 693 on the connection axis Oh may act in the second rotation direction D12.

Figure 14:
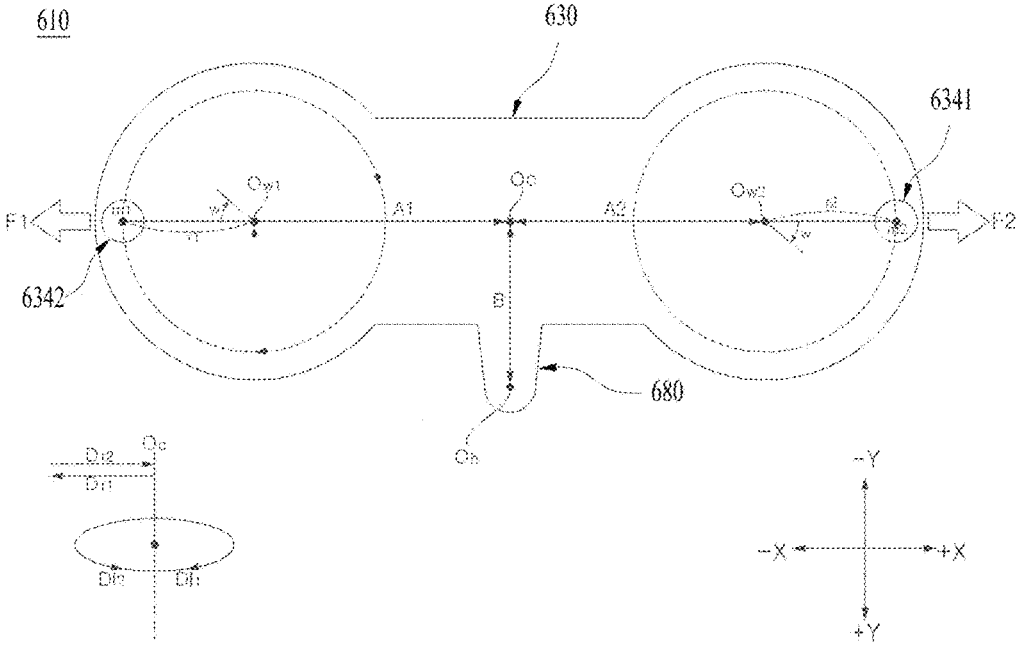

Referring to FIG. 14, when the first eccentric part 6341 generates the centrifugal force F1 with respect to the first rotation axis Ow1 in the centrifugal direction Dr1, the second eccentric part 6342 generates the centrifugal force F2 with respect to the second rotation axis Ow2 in the centripetal direction Dr2. Accordingly, the centrifugal force F1 of the first eccentric part 6341 and the centrifugal force F2 of the second eccentric part 6342 generate no torque for the vibrating body 630. The excitation force Fo transferred to the hanger bar 693 on the connection axis Oh becomes zero. The centrifugal force F1 of the first eccentric part 6341 and the centrifugal force F2 of the second eccentric part 6342 may act in opposite directions and thus offset each other.

Therefore, referring to FIGS. 11 to 14, when the motor 620 rotates clockwise or counterclockwise, the vibrating body 630 may rotate alternately in the first rotation direction and the second rotation direction, which are opposite to each other, depending on where the weight of the first eccentric part 6341 and the second eccentric part 6342 is concentrated.

The alternate rotation of the vibrating body 630 may cause the motion converter 680 to reciprocate along an arc, and the reciprocation of the motion converter 680 may be converted by the slot 694 into the reciprocation of the hanger bar 693 in the predetermined movement or vibration direction.

Figure 15A:
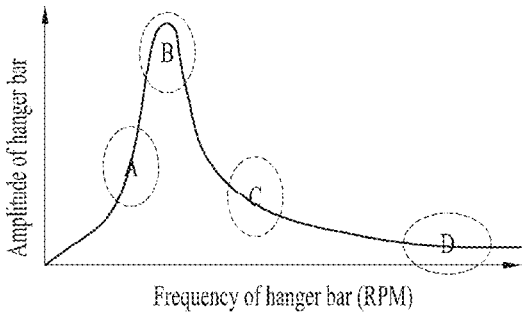
FIG. 15A shows a relationship between the frequency (RPM) and amplitude of a hanger bar according to a harmonic excitation motion of the driver.
Figure 15B:
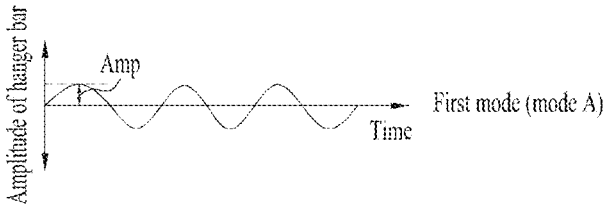
FIGS. 15B to 15E show amplitudes depending on four different frequencies over time.
Figure 15C:
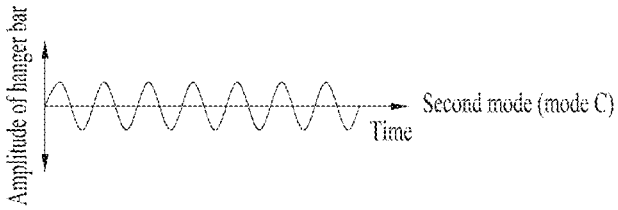
Figure 15D:
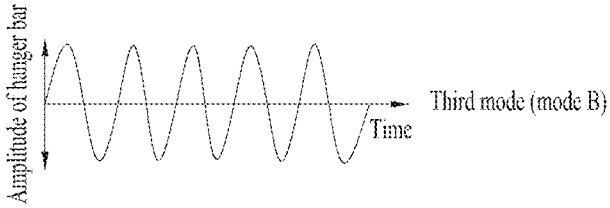
Figure 15E:
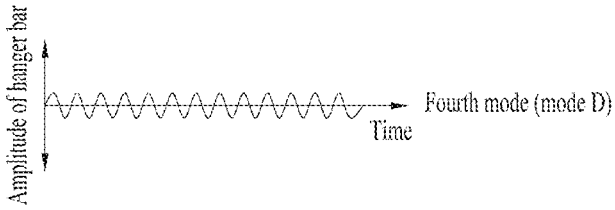

FIG. 15A shows a graph of the amplitude and frequency of the hanger bar 693, which may be obtained through the physical analysis of the harmonic excitation motion of the driver 610. Since the reciprocation of the driver 610 is eventually converted into the reciprocation of the hanger bar 693, the graph may be regarded as a graph of the frequency and amplitude of the hanger bar 693.

If the weight m1 of the first eccentric part 6341 and the weight m2 of the second eccentric part 6342 are at arbitrary positions, the harmonic excitation motion of the driver 610 may be represented by a second-order differential equation as shown in Equation 1 below.

$$p1 \cdot \frac{d^2x}{dt^2} + p2\frac{dx}{dt} + p3 \cdot x = Fo \cdot \cos(\mathrm{wt}) \qquad \text{[Equation 1]}$$

In Equation 1, p1, p2, and p3 are non-zero constants. Specifically, p1 is the mass of the clothes supporter 600 excluding the support member 670 fixed to support frame 15, the damping coefficient p2 may be generated by structural factors of the clothes supporter 600 and/or clothes hung on the hanger bar 693, the modulus of elasticity p3 is generated by the driver elastic member 635, and x is the position of the connection axis Oh in the movement direction (+X, −X) depending on time t. The excitation force Fo may be represented by $m \cdot r \cdot w^2$ if the first eccentric part 6341 and the second eccentric part 6342 have the same weight and the same distance to the central axis, where w is the angular speed, m is the mass of each eccentric part, and r is the distance from each eccentric part to the central axis.

When Equation 1 is solved, the natural frequency (resonant frequency) of the driver may be expressed by Equation 2 below.

$$\omega_n = \sqrt{\frac{p3}{p1}} \quad \text{[Equation 2]}$$

In Equation 2, $\omega_n$ denotes the natural frequency (resonant frequency).

If Equation 3 below is satisfied, the driver may have a maximum amplitude in the vicinity of the natural frequency. If Equation 3 is not satisfied, the amplitude decreases monotonously as the frequency increases. As a result, the amplitude may not vary depending on the frequency, which is not preferable.

$$p1 \cdot p3 \geq p2^2 \quad \text{[Equation 3]}$$

In Equation 3, the larger the value of p2, the larger the amplitude may be (where p2 is a positive integer).

A graph may be obtained as shown in FIG. 15A by representing the amplitude of the hanger bar 693 (an arbitrary unit (AU) is used because only relative sizes are involved) depending on the frequency (or the number of rounds per minute (RPM)) of the hanger bar 693 based on Equations 1 to 3.

Various modes of the hanger bar 693 may be set from the graph according to the frequency and amplitude. Here, the mode means that the hanger bar 693 reciprocates in a predetermined movement or vibration direction with a predetermined frequency and amplitude.

If the graph is monotone decreasing unlike the graph of FIG. 15A, the amplitude may not vary depending on the frequency. Therefore, it may be difficult to distinguish different modes in the four areas as in the example shown in FIG. 15A. Therefore, the condition of Equation 3 needs to be satisfied to obtain the graph as shown in FIG. 15A.

In FIG. 15A, the four areas in which four different modes are configurable may be denoted by A, B, C, and D, respectively. B may be set near the natural frequency (resonant frequency). Accordingly, the hanger bar 693 may have the maximum amplitude in area B. If the hanger bar 693 reciprocates with the frequency and amplitude set in area B, it may be said that the hanger bar 693 reciprocates in mode B If the hanger bar 693 reciprocates with the frequency and amplitude selected in area A, it may be said that the hanger bar 693 reciprocates in mode A. Similarly, when the hanger bar 693 reciprocates at the frequency and amplitude selected in area C, it may be said that the hanger bar 693 reciprocates in mode C. Further, when the hanger bar 693 reciprocates at the frequency and amplitude selected in area D, it may be said that the hanger bar 693 reciprocates in mode D.

The frequency and amplitude of the hanger bar 693 may be independent of each other. However, according to the present disclosure, the amplitude of the hanger bar 693 may be determined according to the frequency of the hanger bar 693 due to the harmonic excitation motion. This is because the rotation angles in the first rotation direction and the second rotation direction of the vibration of the driver 610 vary depending on the frequency of the driver 610 due to the harmonic excitation motion.

In the clothes treatment apparatus according to the present disclosure, when the hanger bar 693 reciprocates, the amplitude of the hanger bar 693 may vary depending on the period of hanger bar 693 or the frequency of the hanger bar 693 related to the period of the hanger bar 693. That is, the amplitude of the hanger bar 693 may be determined by the frequency of the hanger bar 693.

FIGS. 15B to 15E shows changes in amplitude over time when the hanger bar 693 operates in mode A, mode B, mode C, and mode D, respectively. Due to the harmonic excitation characteristics, the amplitude has the shape of a sinusoidal wave.

The frequency and amplitude of the hanger bar 693 may be defined as follows. The frequency of the hanger bar 693 is the reciprocal of the time taken for the hanger bar 693 to move from an initial position to the left and right once and then return to the initial position. In other words, the frequency of the hanger bar 693 is the reciprocal of the time taken for the hanger bar 693 to return to the initial position after reciprocating once (period). In this document, the number of rounds per minute RPM is used as a unit representing the frequency of the hanger bar 693 instead of Hz.

The amplitude of the hanger bar 693 means the maximum distance the hanger bar is capable of moving from the initial position to the left and right. The initial position means the position of the hanger bar 693 when the hanger bar 693 stops. Since the magnitude of the amplitude is not an absolute value but may vary by the mass of the driver 610, the amplitude is expressed as a relative value without a unit (or based on the arbitrary unit (AU)).

Referring to 15A to 15E, the frequency in mode A may be smaller than the resonance frequency of the driver 610, and the frequency in mode C may be set greater than the resonance frequency.

The frequency and amplitude in mode A may also be referred to as a first frequency and a first amplitude, and mode A may be referred to as a first mode. Similarly, the frequency and amplitude in mode C may also be referred to as a second frequency and a second amplitude, and mode C may be referred to as a second mode.

The first frequency may be set smaller than the resonance frequency of the driver 610, and the second frequency may be set larger than the resonance frequency of the driver 610. The hanger bar 693 may operate in one of the first mode and the second mode. In the first mode, the hanger bar 693 may reciprocate at the predetermined first frequency smaller than the resonance frequency of the driver 610 and the first amplitude depending on the first frequency. In the second mode, the hanger bar 693 may reciprocate at the predetermined second frequency greater than the resonance frequency and the second amplitude depending on the second frequency.

Referring to FIG. 15A, the first frequency may be smaller than the second frequency. However, the first amplitude may be similar to the second amplitude, or the first amplitude may be slightly greater than the second amplitude.

The frequency and amplitude in mode B may also be referred to as a third frequency and a third amplitude, and mode B may be referred to as a third mode. Similarly, the frequency and amplitude in mode D may also be referred to as a fourth frequency and a fourth amplitude, and mode D may be referred to as a fourth mode.

The third frequency may be similar to the resonance frequency at which resonance may occur. Since unexpected tremors or vibrations may occur at the resonant frequency, the third frequency may be preset to an arbitrary frequency near the resonant frequency to avoid the occurrence of the unexpected tremors or vibrations. The hanger bar 693 may operate in any one of the first mode, the second mode, and the third mode. In the third mode, the hanger bar 693 may reciprocate at the third frequency between the first and second frequencies and the third amplitude depending on the third frequency. In addition, the third amplitude may be greater than the first amplitude and the second amplitude.

The fourth frequency may be set greater than the second frequency. The hanger bar 693 may reciprocate in any one of the first mode, the second mode, the third mode, and the fourth mode. In the fourth mode, the hanger bar 693 may reciprocate at the fourth frequency greater than the third frequency and the fourth amplitude depending on the fourth frequency. The fourth amplitude may be smaller than the first amplitude, the second amplitude, and the third amplitude.

To obtain the amplitude significantly varying depending on the frequency as described above, it is necessary to have a harmonic excitation motion pattern where the maximum value is present at the resonant frequency as shown in FIG. 15A.

The frequency and amplitude of the driver may be set independent of each other. To this end, the rotation angle of the driver may vary as shown in FIGS. 3A and 3B so that the amplitude and frequency may vary independently of each other. However, considering that the purpose of the clothes treatment apparatus 1000 is clothes management, only the amplitude and frequency for performing various functions required for clothes management, for example, a dust removal function, a drying function, a wrinkle removal function, etc., need to be implemented. In other words, there is no need to implement the driver in such a way that the driver is capable of varying the amplitude and frequency independently.

Figure 15F:
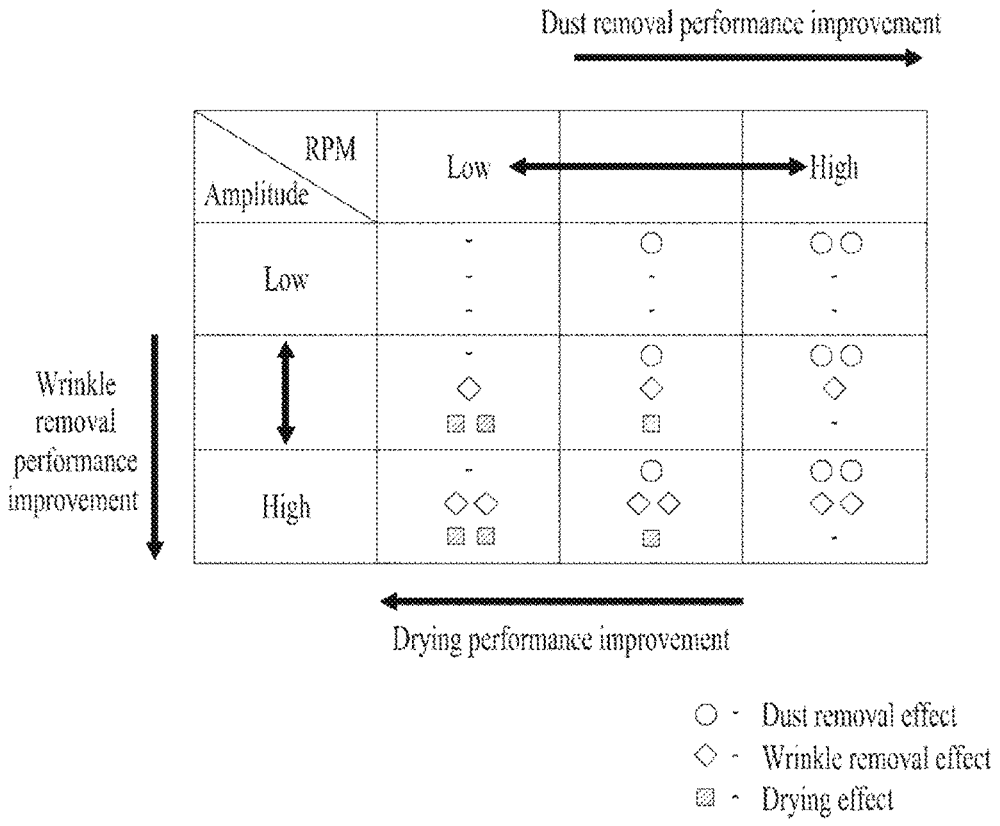
FIG. 15F schematically shows a relationship between various functions for clothing management based on amplitude and frequency.

FIG. 15F schematically shows a relationship between various functions required for clothing management and the amplitude and frequency. In other words, FIG. 15F shows how the dust removal function, the drying function, and the wrinkle removal function are related to the amplitude and frequency. FIG. 15F shows that the more the figure for each function is, the better the performance is.

Referring to FIG. 15F, as the frequency (RPM) of the hanger bar 693 increases, the dust removal function may be improved. On the contrary, as the frequency (RPM) of the hanger bar 693 decreases, the drying function may be improved. The wrinkle removal function may be improved when the amplitude increases. When the frequency and amplitude of the hanger bar 693 decrease, the performance of the dust removal function and drying function may be degraded. Therefore, a mode with small amplitude or frequency may not be used except in special cases.

Specifically, as the frequency (RPM) of the hanger bar 693 increases, the dust removal performance may be improved. This is because the faster the hanger bar 693 reciprocates, the more dust may be removed from clothes due to inertia. However, if the amplitude is small even though the frequency is high, it may not be suitable for dusting. That is, if the amplitude is small, the inertia may not be enough to fall off dust.

As described above, the drying function may be improved as the frequency (RPM) of hanger bar 693 decreases. However, since the clothes treatment apparatus 1000 according to the present disclosure adopts drying by a heat pump rather than dehydration by centrifugal force, high temperature and dry air needs flow into clothes hung on the clothes supporter 600. Thus, if the frequency (RPM) of the hanger bar 693 is high, it may obstruct the air flow. However, if the amplitude is too low, the air flow may not be promoted because it may be the same as a case of simply standing.

The larger the amplitude of the hanger bar 693, the more advantageous it is to remove wrinkles. This is because the larger the amplitude of the hanger bar 693, the more effective it is to straighten clothes, which is effective in removing wrinkles. When the clothes form a waveform due to the amplitude of the hanger bar 693, a node may be formed due to a standing wave. Since the node does not change in a certain mode, wrinkles may not be removed from a part of the clothes corresponding to the node. Therefore, it is necessary to change the node, and to this end, it may be desirable to change the mode of the hanger bar 693 while performing the wrinkle removal function.

Referring to FIG. 15F and FIG. 15A, it may be seen that among various modes implementable in the driver 610, which mode is specialized for which clothing management function. This is illustrated in FIG. 16.

Figure 16:
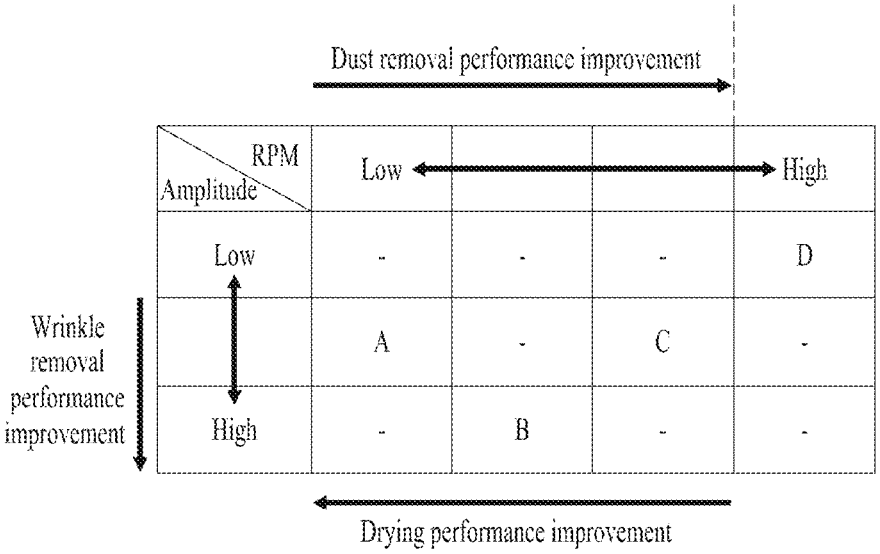
FIG. 16 schematically shows a relationship between amplitudes and frequencies of the hanger bar and clothes management functions.

FIG. 16 shows mode A (first mode), mode C (second mode), and mode B (third mode) implementable in the clothes treatment apparatus according to the present disclosure in consideration of each relative frequency and amplitude. These modes are denoted by A, B, and C, respectively. Mode D (fourth mode) is separately represented considering that it is used in a special case.

Comparing with FIGS. 15A to 15E, it may be seen that mode A (first mode) is specialized for clothes drying. That is, when the hanger bar 693 reciprocates at the first frequency, the clothes mounted on the hanger bar 693 may be shaken appropriately. In particular, considering that steam is provided to the clothes through the steamer 250 and thus the weight of the wet clothes increases, the clothes may be damaged by friction between the hanger H1 (sec FIG. 1) and the clothes T (see FIG. 1) when shaken at a frequency higher than the first frequency. Accordingly, since mode A has the smallest frequency among the plurality of modes described above, it is preferable to use mode A. In addition, mode A may allow to manage clothes late at night or early in the morning with low noise due to the low frequency.

Mode B (third mode) is specialized for wrinkle removal. Compared to other modes, the amplitude of the hanger bar 693 is the largest in mode B. Thus, mode B may be suitable for removing the wrinkles of clothes because the clothes are shaken the most.

Mode C (second mode) is specialized for dusting. This is because the amplitude of mode C is similar to that of mode A but the frequency of mode C is higher than that of mode A. Therefore, mode A is specialized for drying due to a relatively low frequency, whereas mode C is more effective for dust removal due to a relatively high frequency. In addition, although the second amplitude of mode C is smaller than the third amplitude of mode B, mode C may reciprocate the hanger bar 693 at the second frequency greater than the third frequency with a certain amplitude. Thus, mode C may be more effective than mode A even in removing wrinkles.

In other words, mode C is not only specialized for dust removal but also effective in wrinkle removal. In addition, mode C may restore the volume of clothes such as a padded jacket filled with filling materials. Specifically, mode C may restore the volume of clothes by beating filling materials for clothes to increase a gap between the filling materials. That is, mode C mode has the effect of increasing the volume of clothes.

Herein, the dust means small foreign substances which float in the air and attach to clothes. The dust may include lint, dead skin, animal hair, dirt, and the like. In general, the dust has a size of 10 μm or more. Dust with a smaller size is called fine dust.

Mode D (mode 4) with the smallest amplitude and the highest frequency may be used for special purposes. That is, Mode D may allow steam to penetrate well into the fabrics of clothes when or after the steam is sprayed by the steamer 250 by transmitting fine vibration with high frequency and small amplitude to the clothes. This is because as the amount of steam that penetrates the clothes increases, the moisture content of the clothes increases. Further, when the moisture content increases, wrinkle removal and deodorizing may be improved. Mode D may be effective in restoring hairs of fur clothes. This is because, since each hair is small in size, the frequency needs to be high to transmit vibration to each hair and shake the hair to give the effect of revitalizing the hair.

In addition to that, since the frequency is high, mode D may be effective in removing fine dust smaller than foreign substances or dust. This is similar to a sonicator that uses ultrasonic waves to remove fine dust.

The functions of mode A (first mode), mode B (third mode), mode C (second mode), and mode D (fourth mode) are summarized in Table 1 below.

TABLE 1

| Mode | Core function | Additional function | Description |
|---|---|---|---|
| A (first mode) | Increase in dryness | — | Mode specialized for drying<br>Quiet mode<br>Minimize damage of clothes due to friction |
| B (third mode) | Wrinkle removal | — | Specialized mode for wrinkle removal |
| C (second mode) | Dust removal | Wrinkle removal and volume up | Mode suitable for wrinkle removal and dust removal<br>Restore volume of clothes filled with filling materials |
| D (fourth mode) | Increase in moisture content | Wrinkle removal and fur restoration | Facilitates steam penetration and moisture absorption<br>Easy to manage fur clothes |

Figure 17:
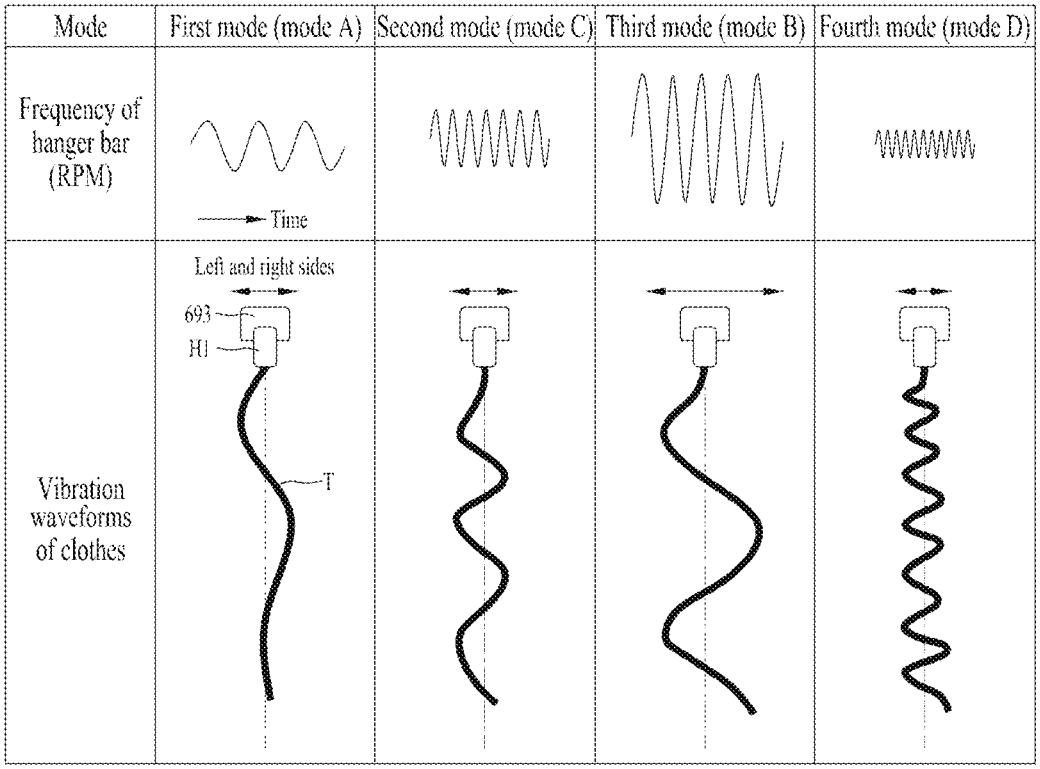
FIG. 17 is a diagram schematically illustrating the shape of shaking clothes hung on the hanger bar in four modes with four different frequencies in the form of waves.

FIG. 17 schematically shows vibration waveforms of clothes based on the four modes described above. The first amplitude and the second amplitude, which are the amplitudes of mode A and mode C, are similar in magnitude. The fourth amplitude, which is the amplitude of mode D, has the smallest magnitude. The third amplitude, which is the amplitude of mode B, has the largest magnitude.

FIG. 17 shows a part of the hanger H1 holding clothes on the hanger bar 693 in each mode. The double arrow denotes the movement direction of the hanger bar 693. When the hanger bar 693 reciprocates at predetermined amplitude and frequency in each mode, the mounted clothes may also create a waveform. That is, when one end of the clothes T is held and shaken, a wave proceeds along the clothes. In this case, the other end of the clothes is a free end, and the wave is reflected from the free end. Thus, a standing wave may be created, so that a node may be formed. Referring to FIG. 18D, a plurality of nodes may be formed in the clothes according to the size of the wave, that is, the wavelength.

Since there is no amplitude change at the node of the clothes, the node may be undesirable for wrinkle removal and dusting. Therefore, the node needs to change, and to this end, it may be preferable to use a combination of several modes rather than using only one mode in performing wrinkle removal, dust removal, and drying functions.

FIGS. 18A to 19B show an embodiment in which various clothes management functions are performed by combining the above-described modes. In FIGS. 18A to 19B, a combination of various modes is used, which is referred to as a motion. That is, the motion refers to repeatedly performing a mode combination consisting of at least one mode among a plurality of modes to perform a clothing management function for a predetermined motion time. Each mode may be repeated for each predetermined time during the motion time. For example, if the first mode is executed for 30 seconds and then the second mode is performed for 5 minutes, the hanger bar 693 may operate (reciprocate) alternately in the first mode for 30 seconds and in the second mode for 5 minutes for one hour, which is the total wrinkle removal time.

The first mode and the second mode may be continuously performed or discontinuously performed with a pause duration.

One mode may last for the motion time, which is referred to as a single-mode motion. On the other hand, various modes may be repeated during the motion time, which is referred to as a multi-mode motion. In the multi-mode motion, each mode may be repeatedly performed for each predetermined time during the motion time.

A course may mean that a combination of motions is performed for a predetermined course time.

Accordingly, the course time may be set longer than the motion time. The motion time may be set longer than the time required for each of one or more modes required to perform a clothes management function.

Referring to FIGS. 18A to 19B, when the hanger bar 693 reciprocate, the third mode (mode B) needs to be included during the reciprocation. This is because the third mode (mode B) is the most basic mode for implementing a motion.

Figure 18A:
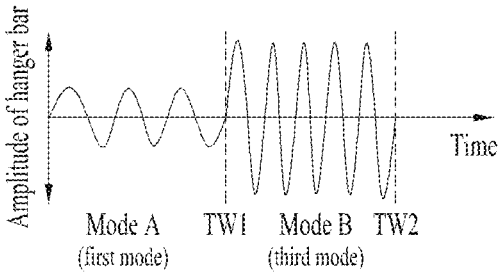
FIGS. 18A to 18C show a combination of various modes available for a wrinkle removal motion, a dust removal motion, and a volume motion for restoring the volume of clothes.
Figure 18B:
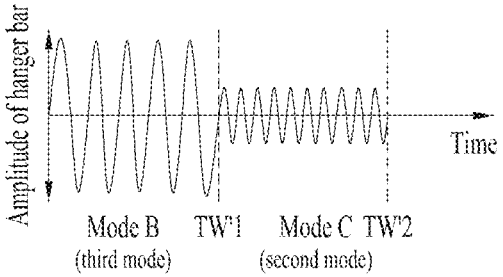
Figure 18C:
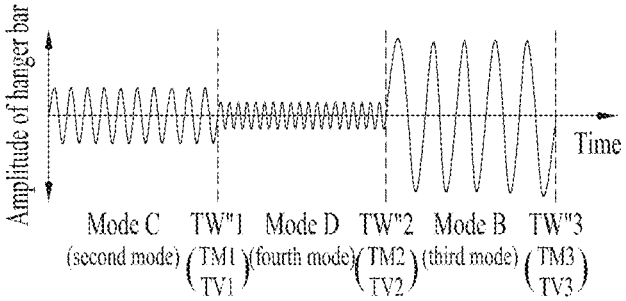
Figure 18D:
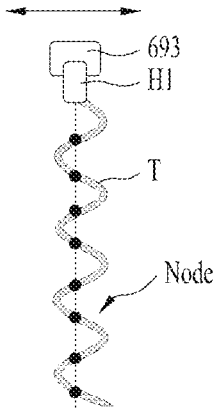
FIG. 18D shows possible nodes in hung clothes when the hanger bar reciprocates with a prescribed frequency and amplitude.

FIGS. 18A to 18C show different types of wrinkle removal motions for removing wrinkles from clothes in the first chamber 100.

Referring to FIGS. 18A to 18C, three different types of wrinkle removal motions may include at least mode B (third mode) specialized for wrinkle removal to remove the wrinkles. That is, to remove the wrinkles of the clothes in the first chamber 100, the hanger bar 693 may reciprocate in the third mode during at least part of a predetermined total wrinkle removal time.

Here, the total wrinkle removal time means the total time required to perform the wrinkle removal motion.

The third mode may be performed during the total wrinkle removal time (single-mode motion). Alternatively, the third mode may be performed only during a part of the total wrinkle removal time. FIGS. 18A to 18C show different embodiments in which the third mode is executed only for a part of the wrinkle removal time.

FIG. 18A shows an embodiment of the wrinkle removal motion. The hanger bar 693 may reciprocate in the first mode for a predetermined first wrinkle removal time TW1. After expiration of the first wrinkle removal time TW1, the hanger bar 693 may reciprocate in the third mode for a predetermined second wrinkle removal time TW2. During the total wrinkle removal time, the hanger bar 693 may reciprocate alternately in the first mode for the first wrinkle removal time TW1 and in the third mode for the second wrinkle removal time TW2. FIG. 18A shows mode patterns of the first mode and the third mode to be continuously repeated during the total wrinkle removal time. FIGS. 18A to 19B show patterns of repeated mode combinations unless otherwise specified.

FIG. 18B shows another embodiment of the wrinkle removal motion. The hanger bar 693 may reciprocate in the third mode for a predetermined first wrinkle removal time TW1'. After expiration of the first wrinkle removal time TW1', the hanger bar 693 may reciprocate in the second mode for a predetermined second wrinkle removal time TW2'. During the total wrinkle removal time, the hanger bar 693 may reciprocate alternately in the third mode for the first wrinkle removal time TW1' and in the second mode for the second wrinkle removal time TW2'.

FIG. 18C shows another embodiment of the wrinkle removal motion. The hanger bar 693 may reciprocate in the second mode for a predetermined first wrinkle removal time TW1". After expiration of the first wrinkle removal time TW1", the hanger bar 693 may reciprocate in the fourth mode for a predetermined second wrinkle removal time TW2". After expiration of the second wrinkle removal time TW2", the hanger bar 693 may reciprocate in the third mode for a predetermined third wrinkle removal time TW3". During the total wrinkle removal time, the hanger bar 693 may reciprocate alternately in the second mode for the first wrinkle removal time TW1", in the fourth mode for the second wrinkle removal time TW2", and in the third mode for the third wrinkle removal time TW3".

As another embodiment of the wrinkle removal motion, the hanger bar 693 may operate in each mode only once during the total wrinkle removal time, instead of repeating the second mode, the fourth mode, and the third mode. That is, the total wrinkle removal time may be divided into three parts in such a way that the sum of the first wrinkle removal time TW1, second wrinkle removal time TW2, and third wrinkle removal time TW3 becomes the total wrinkle removal time. Each of the second mode, the fourth mode, and the third mode may be performed once.

In this case, each of the second mode, the fourth mode, and the third mode may be performed once, and the sum of the first wrinkle removal time TW1, second wrinkle removal time TW2, and third wrinkle removal time TW3 may be the total wrinkle removal time.

The wrinkle removal motion shown in FIG. 18A, the wrinkle removal motion shown in FIG. 18B, and the wrinkle removal motion shown in FIG. 18C may be referred to as a first wrinkle removal motion, a second wrinkle removal motion, and a third wrinkle removal motion, respectively.

The first wrinkle removal motion may be used to remove wrinkles from thin clothes such as a shirt. The first wrinkle removal motion essentially uses the third mode, mode B.

The first wrinkle removal motion alternately uses mode B and mode A. When clothes are thin and light, if a strong mode is applied, it may cause wrinkles to the clothes. Therefore, the hanger bar 693 may reciprocate in mode B by default and reciprocate in mode A in addition to mode B. When the two modes are applied together, the positions of nodes on the clothes may change, thereby uniformly removing the wrinkles from the clothes.

The second wrinkle removal motion may be used for thick and heavy clothes such as suits or school uniforms. To remove wrinkles from thick and heavy clothes, mode B alone is not enough, and a combination of mode B and mode C may be used. Similarly, when the two modes are applied together, the positions of nodes on the clothes may change, thereby uniformly removing the wrinkles from the clothes.

The third wrinkle removal motion may be used to remove wrinkles from clothes thicker than a suit. To this end, mode B, mode C, and mode D may be combined, thereby maximizing the performance of the wrinkle removal.

One of the first wrinkle removal motion, the second wrinkle removal motion, and the third wrinkle removal motion may be selectively used depending on the material and thickness of clothes. That is, the user may select a motion based on the material and thickness of clothes. For example, an input/output unit 950 configured to receive a user selection and output the current operating state of the clothes treatment apparatus 1000 may be disposed on the opposite surface of the door inner surface 401, that is, on the front surface (not shown) of the door 400 facing forward when the inlet 11 is closed by the door 400. When the user places clothes in the first chamber 100, closes the door 400, and selects a desired menu according to the thickness, type, or material of the clothes through the input/output unit 950, the controller 270 may be configured to reciprocate the hanger bar 693 based on one of the first wrinkle removal motion, the second wrinkle removal motion, and the third wrinkle removal motion.

FIG. 18C may be used to explain another motion. For the other motion, the combination of the second mode, the fourth mode, and the third mode may be repeated, but the execution time of each mode may be set different. For example, although FIG. 18C shows the predetermined first wrinkle removal time TW1", a predetermined first dust removal time TM1, and a predetermined first volume time TV1 together, this represents that the order of modes is the same but does not mean that the times are the same. The first wrinkle removal time TW1", the first dust removal time TM1, and the first volume time TV1 may be set different based on each motion.

To remove fine dust and dust including foreign substances attached to clothes, the clothes need to be shaken, and thus, the reciprocation of the hanger bar 693 may be required.

After removing large dust with the second mode (mode C), it is possible to remove fine dust attached to clothes with the fourth mode (mode D), which has the highest acceleration due to small amplitude and high frequency. The third mode (mode B) may be used to remove foreign substances that are easy to fall off.

For a dust removal motion, that is, to remove dust attached to clothes in the first chamber 100, the hanger bar 693 may reciprocate in the second mode during at least part of a predetermined total dust removal time.

Here, the total dust removal time means the total time required to perform the dust removal motion.

Basically, the third mode may be included in all motions. The hanger bar 693 may reciprocate in the second mode for the predetermined first dust removal time TM1. Then, after expiration of the first dust removal time TM1, the hanger bar 693 may reciprocate in the fourth mode during a predetermined second dust removal time TM2. After expiration of the second dust removal time TM2, the hanger bar 693 may reciprocate in the third mode during a predetermined third dust removal time TM3. During the predetermined total dust removal time, the hanger bar 693 may repeatedly reciprocate in the second mode for the first dust removal time TM1, in the fourth mode for the second dust removal time TM2, and in the third mode for the third dust removal time TM3.

As another embodiment of the dust removal motion, the hanger bar 693 may perform each mode only once, instead of repeating the second mode, the fourth mode, and the third mode. That is, the total dust removal time may be divided into three parts in such a way that the sum of the first dust removal time TM1, second dust removal time TM2, and third dust removal time TM3 becomes the total dust removal time. Each of the second mode, the fourth mode, and the third mode may be performed once.

In this case, each of the second mode, the fourth mode, and the third mode may be performed once, and the sum of the first dust removal time TM1, second dust removal time TM2, and third dust removal time TM3 may be the total dust removal time.

The clothes treatment apparatus 1000 may further include a dust sensor unit 911 located in the first chamber 100 and configured to detect the concentration of dust in the first chamber 100. The first dust removal time may be changed based on the dust concentration detected by the dust sensor 911.

The dust sensor 911 may be configured to transmit a control signal obtained by measuring the concentration of dust or fine dust to the controller 270, and the controller 270 may be configured to determine the current dust or fine dust concentration based on the control signal.

The controller 270 may be configured to change the total dust removal time or the first dust removal time based on the dust concentration detected by the dust sensor 911. Thus, dust may be removed more efficiently in terms of energy saving.

Referring to FIG. 1, the dust sensor 911 may be provided on the inner peripheral surface of the first chamber 100, and more particularly, on the rear surface of the first chamber 100. Alternatively, the dust sensor 911 may be located in other places, for example, in the vicinity of the air intake port 115 or inside the inlet duct 221.

FIG. 18C may also be used to explain a motion for restoring the volume of clothes such as a padded jacket filled with wadding.

Clothes such as a padded jacket may be filled with padding such as feathers, so air in the space between the feathers may escape depending on use and storage. In this case, the volume of the clothes may decrease, and the thermal insulation performance thereof may also decrease. The volume may represent the thickness of the clothes, and thus, restoring the volume may mean that the thickness of the clothes increases compared to that of the clothes before the clothes treatment apparatus 1000 performs a volume motion.

To this end, the hanger bar 693 may reciprocate in the second mode for a predetermined first volume time TV1 so that the thickness of clothes in the first chamber 100 is equal to or greater than the thickness of the clothes before being placed in the first chamber 100. After expiration of the first volume time TV1, the hanger bar 693 may reciprocate in the fourth mode for a predetermined second volume time TV2. After expiration of the second volume time TV2, the hanger bar 693 may reciprocate in the third mode for a predetermined third volume time TV3. During a predetermined total volume time, the hanger bar 693 may repeatedly reciprocate in the second mode for the first volume time TV1, in the fourth mode for the second volume time TV2, and in the third mode for the third volume time TV3.

Here, the total volume time means the total time required to perform the volume motion.

As another embodiment of the volume motion, the hanger bar 693 may perform each mode only once, instead of repeating the second mode, the fourth mode, and the third mode. That is, the total volume time may be divided into three parts in such a way that the sum of the volume time TV1, second volume time TV2, and third volume time TV3 becomes the total volume time. Each of the second mode, the fourth mode, and the third mode may be performed once.

In this case, each of the second mode, the fourth mode, and the third mode may be performed once, and the sum of the volume time TV1, second volume time TV2, and third volume time TV3 may be the total volume time.

Figure 19A:
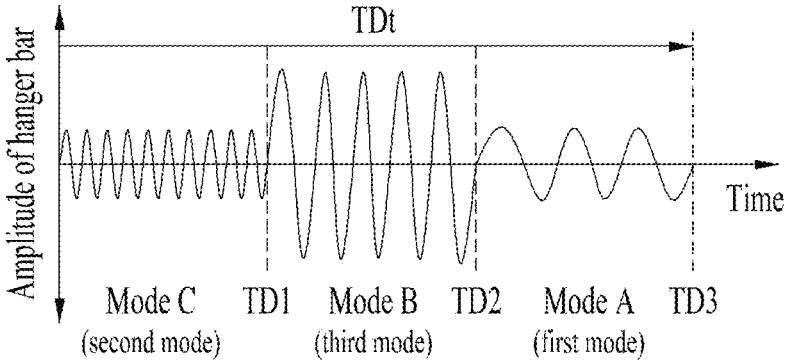
FIG. 19A shows a combination of modes available for drying motion.

FIG. 19A shows an example of a drying motion. The drying motion refers to a motion for drying wet clothes, and in general, the clothes treatment apparatus 1000 may provide steam to the first chamber 100 through the steamer 250 for wrinkle removal, deodorization, and sterilization. Accordingly, when the steam penetrates the clothes in the first chamber 100, the clothes are changed from the dry state to the wet state. The drying motion may be used to dry the wet clothes.

At the early stage of the drying motion, the clothes may be strongly shaken by the second mode because the clothes are wet. At the middle of the drying motion, the clothes may be shaken by the third mode because the clothes are somewhat dried. At the last stage of the drying motion, the clothes may be gently shaken by the first mode.

To this end, the steamer 250 may supply steam to the first chamber 100 for a predetermined steam supply time. Thereafter, the hanger bar 693 may reciprocate in the first mode during at least part of a predetermined total drying time TDt while the air blower 220 and the heat pump 230 are driven to dry the clothes in the first chamber 100.

Alternatively, after the steamer 250 supplies steam to the first chamber 100 for the predetermined steam supply time, the hanger bar 693 may reciprocate in the second mode for a predetermined first drying time TD1 while the air blower 220 and the heat pump 230 are driven to dry the clothes in the first chamber 100. After expiration of the first drying time TD1, the hanger bar 693 may reciprocate in the third mode for a predetermined second drying time TD2. After expiration of the second drying time TD2, the hanger bar 693 may reciprocate in the first mode for a predetermined third drying time TD3.

In the drying motion, the sum of the first drying time TD1, second drying time TD2, and third drying time TD3, where the second mode, third mode, and first mode are performed once respectively, may be the total drying time TDt, unlike other motions where multiple modes are repeatedly performed.

The drying motion may be performed simultaneously with the operation of the heat pump 230, and the operation of the heat pump 230 may be confirmed by checking whether the compressor 234 is driven. This is because a refrigerant needs to be compressed and circulated for heat exchange with air sucked from the first chamber 100.

Figure 19B:
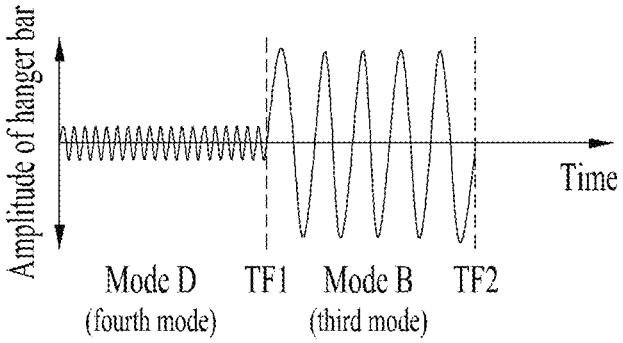
FIG. 19B shows a combination of modes available for a fur restoration motion.

FIG. 19B shows an example of a fur restoration motion. When fabric made animal fur such as rabbit fur or artificial fur, the appearance of the clothes may be degraded if the fur lies. In this case, the restoration motion may be used to bring the fur back to the original state.

For the restoration motion, mode B may be used by default, and mode D may be additionally used. Mode D may restore the lying fur by transmitting waves of small frequency and amplitude to the fur. Then, mode B may vigorously shake the fur and supply air to the fir to restore the fur.

Accordingly, since the restoration motion is capable of restoring the lying fur, the thickness of the clothes may be the same as or larger than that before the restoration motion is performed. This means that the thickness of the clothes is the same as or larger than that before the fur restoration motion is performed.

That is, the hanger bar 693 may reciprocate in the fourth mode for a predetermined first restoration time TF1. After expiration of the first restoration time TF1, the hanger bar 693 may reciprocate in the third mode for a predetermined second restoration time TF2. During a predetermined total restoration time, the hanger bar 693 may reciprocate repeatedly in the fourth mode for the first restoration time TF1 and in the third mode for the second restoration time TF2. In this case, the thickness of clothes after a lapse of the total restoration time may be greater than or equal to the thickness of the clothes before being placed in the first chamber.

As another embodiment of the fur restoration motion, the hanger bar 693 may reciprocate in the fourth mode for a predetermined first restoration time TF1. After expiration of the first restoration time TF1, the hanger bar 693 may reciprocate in the third mode for a predetermined second restoration time TF2. Each of the fourth mode and the third mode may be performed only once, and the sum of the first restoration time TF1 and the second restoration time TF2 may be equal to the predetermined total restoration time.

That is, the fourth mode and the third mode may not be repeatedly performed, but each of the third mode and the fourth mode may be performed once by dividing the total restoration time into two parts. In this case, the thickness of clothes after a lapse of the total restoration time may be greater than or equal to the thickness of the clothes before being placed in the first chamber.

The fur restoration motion may be performed after steam is supplied by the steamer 250.

As described above, the clothes treatment apparatus 1000 may include: the cabinet 10 including the inlet 11 on the front side; the first chamber 100 positioned inside the cabinet 10 and defining a space for holding clothes through the inlet 11; the second chamber 200 positioned under the first chamber 100 and defining a space separated from the first chamber 100; the air blower 220 located inside the second chamber 200 and including the blowing fan 226 configured to suck air from the first chamber 100 to circulate the air in the first chamber 100; the compressor 234 configured to compress a refrigerant; the heat pump 230 connected to the air blower 220 and configured to discharge air dehumidified and heated by the heat exchanger (not shown) to the first chamber 100; the steamer 250 positioned inside the second chamber 200 and configured to generate and supply steam; the water supply tank 310 located in front of the second chamber 200 and configured to supply water to the steamer 250; the water drain tank 330 located in front of the second chamber 200 and configured to store condensed water generated in the first chamber 100 and the heat pump 230; and the driver 610, wherein the driver may include: the vibrating body 630 configured to support the motor 620 and vibrate alternately in the first rotation direction and the second rotation direction, which are opposite to each other, by the rotation of the motor 620; and the motion converter 680 configured to rotate together with the vibrating body 630 and convert the vibration of the vibrating body 630 to allow the hanger bar 693 to reciprocate along the predetermined movement direction in connection with the hanger bar 693. The hanger bar 693 may reciprocate with different amplitudes and periods (or frequencies) according to the number of times that the motor 620 rotates while at least one of the air blower 220, the heat pump 230, and the steamer 250 operates.

The clothes treatment apparatus 1000 may perform various clothes management functions as described above. For example, the clothes treatment apparatus 1000 may perform the wrinkle removal motion, drying motion, dust removal motion (or dusting motion), fur restoration motion, and volume motion. In order to perform the various motions, the controller 270 may reciprocate the hanger bar 693 by combining various modes.

Figure 21:
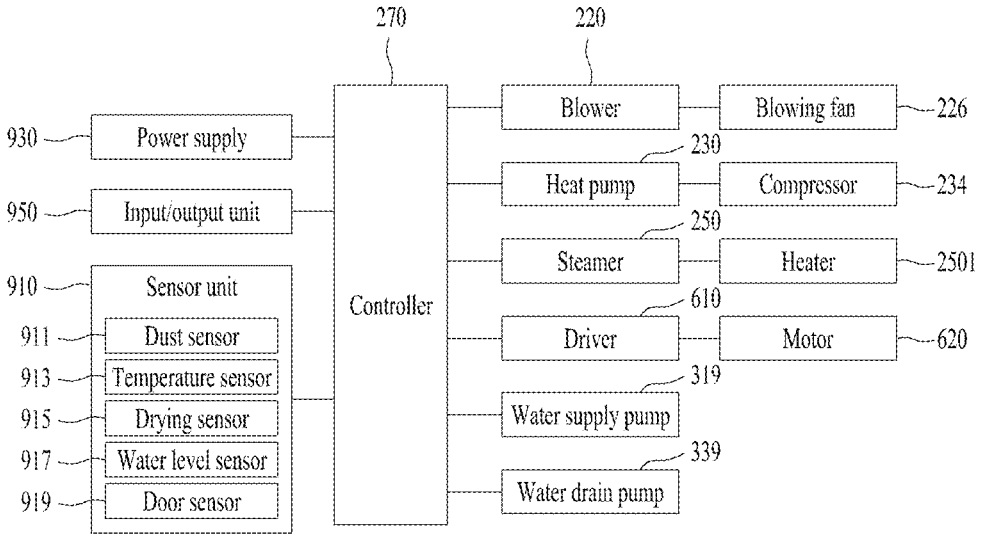
FIG. 21 is a block diagram showing the control configuration of the clothes treatment apparatus according to an embodiment of the present disclosure.

Referring to FIGS. 2A, 2B, and 21, the controller 270 may be configured to control the driver 610, the steamer 250, the air blower 220, the heat pump 230, a water supply pump 319 configured to supply water to the water supply tank 310, and a water drain pump 339 configured to discharge condensed water collected in the sump (not shown) to the water drain tank 330. The controller 270 may be configured to control the rotation speed of the motor 620 included in the driver 610 rotates. The controller 270 may be configured to control the rotation speed of the blowing fan 226 included in the air blower 220. The controller 270 may be configured to control the compressor 234 controlling the refrigerant. Further, the controller 270 may be configured to control the heater 2501 configured to heat water accommodated in the storage 251 to generate steam.

The controller 270 may control the blowing fan 226, the compressor 234, the heater 2501, and the motor 620 to develop a course for processing clothes based on multiple modes and motions, each of which corresponds to a combination of multiple modes.

Figures 20A, 20B:
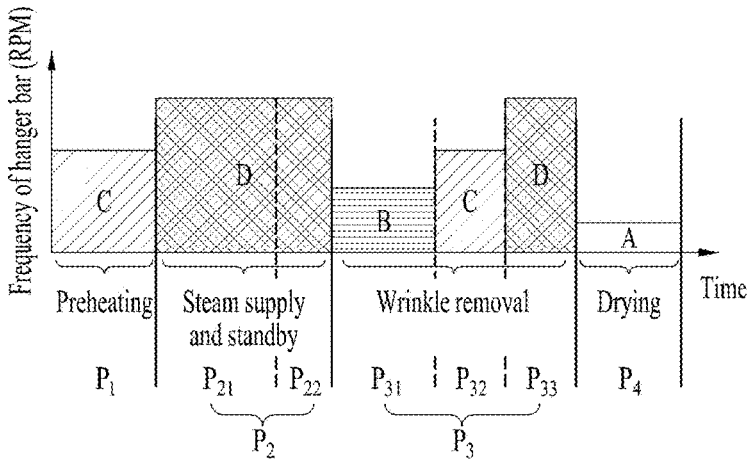
FIG. 20A shows a clothes management course.
FIG. 20B shows whether main components operate in each step (or process)

FIGS. 20A and 20B show an example of a course for processing clothes based on the above-described modes and motions. Here, the course may mean that a combination of motions is performed for a predetermined course time. Accordingly, the course time may be set longer than the motion time. The motion time may be set longer than or equal to the time required for each of one or more modes required to perform a clothes management function.

FIG. 20A shows an example of a course including a steam supply process, a wrinkle removal process, and a drying process. The course may further include a preheating process before the steam supplying process. In addition, the course may further include a standby process between the steam supply process and the wrinkle removal process.

Here, a combination of the steam supply process, the standby process, and the wrinkle removal process may be referred to as a refresh process. This is because it is necessary to supply steam and shake clothes by the reciprocation of the hanger bar 693 for sterilization, deodorization, and wrinkle removal.

In this document, the process (or step) means a sequential process that is distinguished according to the operations of the blowing fan 226, the compressor 234, and the heater 2501 except for the motor 620 and motions (or modes). Multiple processes may be combined to form a course. The operation of the motor 620 is already included in modes (or motions). That is, even if a motion includes the same mode, processes may be distinguished depending on whether the blowing fan 226, the compressor 234, and the heater 2501 operate.

In a normal clothes treatment apparatus, the hanger bar may reciprocate at the same frequency and period in all processes. That is, the frequency of the hanger bar may be between 120 RPM (revolutions per minute or rounds per minute) to 200 RPM. Preferably, the hanger bar may reciprocate with 180 RPM. However, only the frequency changes, but the amplitude is the same. This is because even if the RPM is changed within the frequency range of the hanger bar, there is no significant effects on the clothes treatment performance.

On the contrary, according to the present disclosure, the hanger bar 693 may give a large change in amplitude based on various frequencies due to the harmonic excitation motion of the driver 610. Therefore, it is possible to more effectively manage clothes based on various modes having different frequencies and amplitudes.

The user may place clothes on the hanger bar 693 in the first chamber 100, close the door 400, and select a course through the input/output unit 950 provided in front of the door 400. Depending on the course selected by the user, the controller 270 may be configured to heat the heater 2501 and convert water in the storage 251 into steam. This is called the preheating process.

That is, the preheating process may be performed before the steam supply process. The preheating process may be executed during a steam preheating time P1. The controller 270 measures the temperature of the water in the storage 251 through the steam temperature sensor 9131. If it is determined that the temperature reaches a temperature at which steam is capable of being generated, the controller 270 may proceed to the steam supply process.

The steam preheating time P1 refers to a heating time required for the steamer 250 to reaches a temperature capable of converting water into steam through the heater 2501. Theoretically, water would be converted to steam at 100° C. at atmospheric pressure.

Alternatively, when steam is simply generated and supplied to the first chamber 100, the preheating process may be regarded as proceeding to the steam supply process. That is, the steam preheating time P1 is used to distinguish the preheating process and the steam supply process, but the steam preheating time P1 may not be clearly defined.

Referring to FIG. 20B, during the preheating process or during the steam preheating time P1, the hanger bar 693 may reciprocate in the second mode and the blowing fan 226 may rotate. Alternatively, the hanger bar 693 and the blowing fan 226 may operate only in a part of the preheating process. Further, the hanger bar 693 may stop during the steam preheating time P1 with no operations.

The reason that the hanger bar 693 operates in the second mode in the preheating process is to prevent the clothes hung on the hanger bar 693 from falling off and covering the steam supply port 112 during the reciprocation of the hanger bar 693. This is because if the clothes block steam spray during the steam supply process, the clothes may be damaged by the steam.

Thus, the hanger bar 693 needs to be reciprocate with smaller amplitude than mode B during the preheating process. However, to remove dust from clothes through the preheating process, the hanger bar 693 needs to reciprocate in mode C, which is the second mode specialized for dust removal.

When the steam preheating time P1 elapses, that is, when the steamer 260 starts to generate steam, the controller 270 may be configured to start the steam supply process.

The steam supply process may be executed for a predetermined steam supply time P21. During the steam supply time P21, the hanger bar 693 may reciprocate in the fourth mode. This is to prevent the clothes hung on the hanger bar 693 from falling off and blocking the steam supply port 112 during the reciprocation of the hanger bar 693. Since the fourth mode, mode D is effective for steam penetration and moisture absorption, it is possible to increase the moisture content of the clothes, thereby improving the performance of the wrinkle removal and deodorization.

Referring to FIG. 20B, during the steam supply time P21, the blowing fan 226 rotates and the heater 2501 continuously heats the water of the storage 251, so that steam may be injected into the first chamber 100 through the steam supply port 112.

When the steam supply process is completed, the controller 270 may be configured to perform the standby process for a predetermined standby time P22. There is no steam injection from the steamer 250 during the standby process, and the hanger bar 693 may reciprocate in mode D, which is the fourth mode. That is, the hanger bar 693 may continue to maintain the fourth mode during the steam supply process and the standby process.

In the standby process, the inside of the first chamber 100 may be filled with wet steam (wet vapor or wet saturated vapor) due to the steam supply process. Accordingly, additional steam injection may not be necessary.

Referring to FIG. 20B, during the steam supply time P21, the blowing fan 226 may rotate and the heater 2501 may stop heating.

The standby process may allow steam to penetrate well into the clothes, so that the moisture content of the clothes may increase. Further, the temperature of the clothes may increase due to the steam, which may be helpful in removing wrinkles from the clothes in the subsequent processes.

Since the standby process is between the steam supply process and the wrinkle removal process, the standby time P22 is also between the steam supply time P21 and a predetermined total wrinkle removal process time P3, which will be described later.

In general, since the hanger bar 693 reciprocates in the fourth mode during both the steam supply process and the standby process, the steam supply process and the standby process may be referred to as a steam supply and standby process. The steam supply process and the standby process may differ only in whether or not steam is generated and sprayed through the heater 2501. Referring to FIG. 20B, in the steam supply process, the heater 2501 generates and spays steam, but in the standby process, the heater 2601 generates no steam because steam is no longer needed.

The controller 270 may be configured to proceed to the wrinkle removal process from the steam supply process without the standby process, that is, switch the mode of the hanger bar 693 to the mode used in the wrinkle removal process.

The wrinkle removal process may also be referred to as a cooling process. This is because although the heat pump 230 does not operate to dry the moisture in the first chamber 100 and the moisture of the clothes, both the blowing fan 226 and the hanger bar 693 operate during the wrinkle removal process so that the temperature inside the first chamber 100 decreases over time. When the drying process starts after the wrinkle removal process is completed, the heat pump 230 may be configured to cool and dehumidify the air in the first chamber 100 and heat the air again. In this case, if the temperature of the air in the first chamber is too high, the cooling efficiency through the heat pump 230 may decrease. Thus, it is necessary to lower the temperature of the air inside the first chamber 100 during the wrinkle removal process for the drying process. Therefore, the wrinkle removal process may be called the cooling process.

In addition, since the blowing fan 226 and the hanger bar 693 operate in the wrinkle removal process, the wrinkle removal process may perform drying to some extent as well as lower the temperature of the first chamber 100 and clothes.

For the wrinkle removal process, the third mode, mode B may be used by default, and other modes may be additionally used. This is to change the positions of nodes that may occur in the clothes as described above. To this end, after the steam supply time and/or the standby time, the hanger bar 693 may reciprocate in the third mode, mode B during at least part of the predetermined total wrinkle removal process time P3.

Referring to FIG. 20A, in an embodiment of the wrinkle removal process, the hanger bar 693 may reciprocate in the third mode during a first wrinkle removal process time P31 after expiration of the steam supply time and/or the standby time. This is called a first wrinkle removal process. After expiration of the first wrinkle removal process time P31, the hanger bar 693 may reciprocate in one of the second mode and the fourth mode during a predetermined second wrinkle removal process time P32. This is called a second wrinkle removal process.

The total wrinkle removal process time P3 may consist of only the first wrinkle removal process time P31 and the second wrinkle removal process time P32. If a predetermined third wrinkle removal process time P33 is added, the hanger bar 693 may reciprocate in the other mode of the second mode and the fourth mode during the third wrinkle removal process time P33 after expiration of the second wrinkle removal process time P32. This is called a third wrinkle removal process.

Referring to FIG. 20B, the blowing fan 226 may be configured to rotate during the wrinkle removal process. The blowing fan 226 may suck and circulate the humid air inside the first chamber 100 through the air intake port 115. In this process, although the heat pump 230 does not operate, the temperature inside the first chamber 100 may drop due to the air circulation, and condensate water may occur due to the temperature. In addition, the air circulation may dry the clothes in the first chamber 100 to some extent.

In the wrinkle removal process, the controller 270 may change the mode of the hanger bar 693 by changing the rotation speed of the driver 610.

FIG. 20A shows an embodiment in which three different modes: mode B (third mode), mode C (second mode), and mode D (fourth mode) are performed once in the wrinkle removal process. Alternatively, mode B (third mode), mode C (second mode), and mode D (fourth mode) may be repeatedly performed during the total wrinkle removal process time P3. That is, one pattern configured by combining mode B (third mode), mode C (second mode), and mode D (fourth mode) may be repeatedly performed during the total wrinkle removal process time P3.

After expiration of the total wrinkle removal process time, the controller 270 may be configured to reciprocate the hanger bar 693 in mode A (first mode) and perform the drying process by operating the heat pump 230. The heat pump 230 may be configured to suck the humid air in the first chamber 100 through the air blower 220, dehumidify and heat the sucked air through heat exchange with the refrigerant, and provide the high temperature and dry air to the inside of the first chamber 100 through the air supply port 111.

Therefore, the high temperature and dry air may lower the humidity inside the first chamber 100, and the moisture of the clothes in the first chamber 100 may be evaporated so that the clothes may be dried.

The drying process may be executed during a predetermined drying process time P4. During the drying process time P4, the hanger bar 693 may reciprocate in the first mode (mode A).

Referring to FIG. 20B, the blowing fan 226 may be configured to rotate during the drying process, and the compressor 234 may be configured to operate to circulate the refrigerant used in the heat pump 230.

The course described in this specification (hereinafter referred to as a standard course) is summarized as shown in Table 2 below.

TABLE 2

| Process (Step) | Representative mode | Purpose |
|---|---|---|
| Preheating | Mode C | Fine dust removal |
| Steam supply | Mode D | Steam spraying, moisture impregnation, and removal of small wrinkles |

TABLE 2-continued

| Process (Step) | Representative mode | Purpose |
|---|---|---|
| Standby | | Steam spraying, moisture impregnation, and removal of small wrinkles |
| Wrinkle removal (cooling) | Modes B, C, and D | Wrinkle removal and fine dust removal |
| Drying | Mode A | Drying |

Referring to Table 2, mode D may be effective in removing fine dust in the wrinkle removal process as described above. In this case, if the clothes are made of fur, the fur may be restored. Even if the clothes are not all dried in the wrinkle removal process, fine dust may be removed by mode D.

For the processes, not only the amplitude and frequency of the hanger bar 693 but also other components of the clothes treatment apparatus 1000 are considered as shown in FIG. 20B. Referring to FIG. 20B, in the standard course, when the hanger bar reciprocates, the blowing fan may also rotate.

In the standard course, the hanger bar 693 may reciprocate and, at the same time, the blowing fan 226 may rotate. That is, the amplitude and frequency of the hanger bar 693 may be changed so that the hanger bar 693 may reciprocate in a mode optimized for each process, and at the same time, the air inside the first chamber 100 may be circulated by the blowing fan 226.

In the drying process, the compressor 234 may operate to compress and circulate the refrigerant, and in this case, the hanger bar 693 may reciprocate in the first mode.

In each process, the rotation speed of the blowing fan 226 may be changed similarly to the hanger bar 693. For example, in the preheating process, the blowing fan 226 may rotate at a first rotation speed. In the steam supply process and the standby process, the blowing fan 226 may rotate at a second rotation speed and a third rotation speed, respectively. In the wrinkle removal process, the blowing fan 226 may rotate at a fourth rotation speed. In the drying process, the blowing fan 226 may rotate at a fifth rotation speed. The first rotation speed, the second rotation speed, the third rotation speed, the fourth rotation speed, and the fifth rotation speed may be the same as or different from each other.

The rotation speed of the blowing fan 226 during the first wrinkle removal process time P31 may be different from at least one of the rotation speed of the blowing fan 226 during the second wrinkle removal process time P32 and the rotation of the blowing fan 226 during the third wrinkle removal process time P33.

In each process, the rotation speed of the blowing fan 226 may vary depending on the degree of dryness and the concentration of dust. That is, the controller 270 may detect the humidity and dust concentration in the first chamber 100 through a drying sensor 915 or the dust sensor 911 to change the rotation speed of the blowing fan 226.

Similarly, during the drying process, the rotation speed of the compressor 234 may vary depending on the humidity (dryness) and temperature inside the first chamber 100, rather than keeping constant. That is, the controller 270 may detect the temperature and humidity inside the first chamber 100 through a temperature sensor 913 and the drying sensor 915 installed in the inlet duct 221 or the air intake port 115 to change the compression rate of the compressor 234 and the rotation speed of the blowing fan 226.

FIG. 21 is a block diagram schematically illustrating the control configuration of the clothes treatment apparatus according to an embodiment of the present disclosure.

The controller 270 may be provided in the second chamber 200, but this is merely an example. That is, the controller 270 may be provided anywhere, for example, inside the door, in the space between the cabinet and the first chamber as long as the controller 270 is capable of controlling the components of the clothes treatment apparatus. The controller 270 may turn on a power supply 900 according to a user's input to receive power required to drive the clothes treatment apparatus 1000. In addition, when the course or menu selected by the user is completed, the controller 270 may turn off the power supply 900.

In addition, the controller 270 may detect the user's input through the input/output unit provided on the front side (not shown) of the door and display the current operating state of the clothes treatment apparatus or any errors.

The controller 270 may receive information necessary for treating clothes through a sensor unit 910. For example, the sensor unit 910 may include a water level sensor 917. The water level sensor 917 may detect the water level of the water supply tank 310 and the water level of the water drain tank 330. In addition, the water level sensor 917 may determine whether the water supply tank 310 and the water drain tank 330 are installed in the tank installation space 351.

The sensor unit 910 may further include the temperature sensor 913 for sensing the temperature. The temperature sensor 913 may include the steam temperature sensor 9131 provided in the steamer 250. In addition, the controller 270 may determine the temperature inside the first chamber 100 through a temperature sensor (not shown) provided in the inlet duct 221 or near the air intake port 115.

The sensor unit 910 may further include the drying sensor 915 for detecting the degree of dryness. The drying sensor 915 may be provided on the inner peripheral surface of the first chamber 100 to measure the degree of dryness (or humidity) of the first chamber 100.

The sensor unit 910 may further include the dust sensor 911 for measuring the concentration of dust on the inner peripheral surface of the first chamber 100 or inside the air intake port 115 or inlet duct 221 as described above. In addition, the sensor unit 910 may further include a door sensor 919 for detecting whether the door is opened or closed.

Upon detecting the course selected by the user through the input/output unit 950, the controller 270 may control the air blower 220, the heat pump 230, the steamer 250, and the driver 610 to sequentially perform predetermined motions or modes. Specifically, the controller 270 may control the rotation speed of the blowing fan 226, the rotation speed of a motor inside the compressor 234, ON/OFF of the heater 2501, and the motor 620 of the driver 610.

Figure 22:
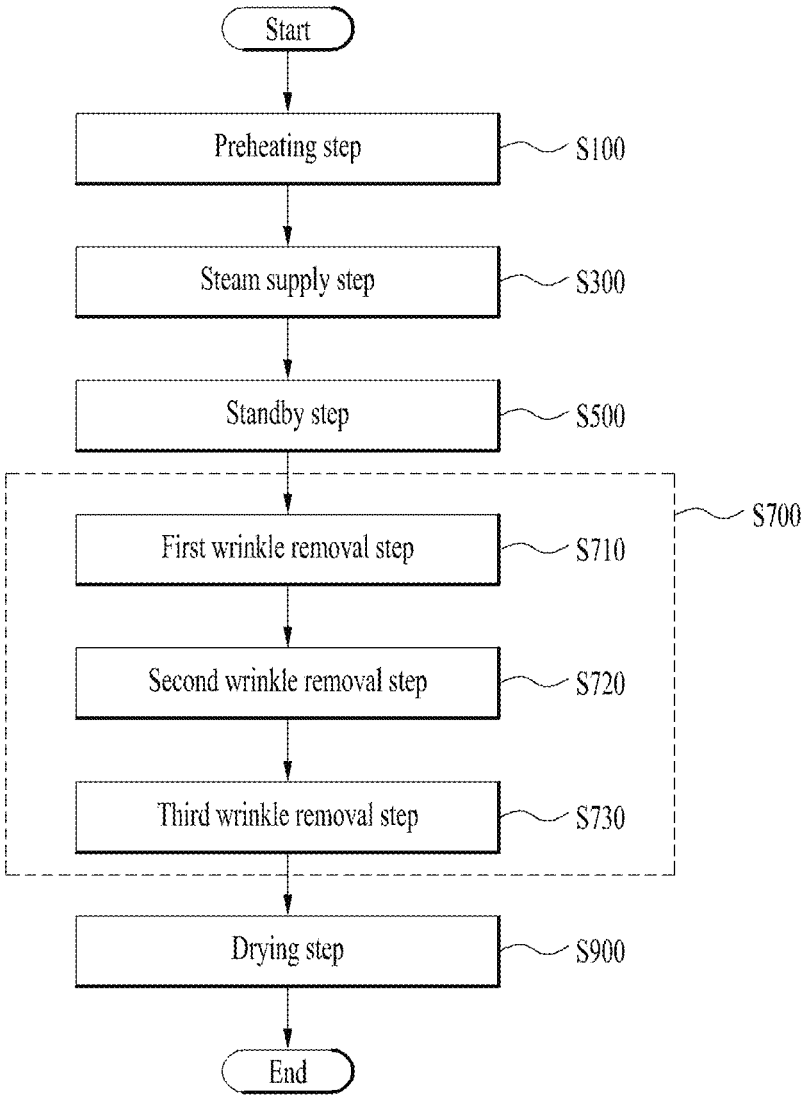
FIG. 22 is a flowchart showing a method of controlling a clothing management course.

FIG. 22 is a flowchart showing a method for controlling a course for clothes management. Assuming that the course disclosed in FIGS. 20A and 20B is a standard course, the method shown in FIG. 22 corresponds to a method for controlling the standard course. When the user selects the standard course, the control method according to the present disclosure starts a preheating step (S100) of heating the water of the storage 251 through the heater 2501 for a predetermined steam preheating time P1 to supply steam through the steamer 250. In the preheating step (S100), the hanger bar 693 may reciprocate in the third mode. In addition, the blowing fan 226 may rotate at a first rotation speed. The steamer 250 may heat the water through the heater 2501 but may not spray the steam into the first chamber 100. The preheating step (S100) may be performed during the predetermined steam preheating time P1.

After expiration of the steam preheating time P1, the control method according to the present disclosure may perform to a steam supply step (S300) of supplying the steam generated in the steamer 250 to the first chamber 100 through the steam supply port 112 for a predetermined steam supply time P21. In the steam supply step (S300), the hanger bar 693 may reciprocate in the fourth mode, and the blowing fan 226 may rotate at a second rotation speed.

After expiration of the steam supply time P21, the control method according to the present disclosure may perform a standby step (S500) of exposing clothes to steam for a predetermined standby time P22 with no steam spraying. Considering that a sufficient amount of steam is already supplied during the steam supply step (S300), the purpose of the standby step (S500) is to sufficiently expose the clothes to the steam during the standby time P22 so that the steam penetrates into the clothes and the clothes absorb moisture. In the standby step (S500), the blowing fan 226 may rotate at a third rotation speed, and the hanger bar 693 may reciprocate in the fourth mode as in the steam supply step (S300). The heater 2501 may be turned off.

After expiration of the standby time P22, the control method according to the present disclosure may perform a wrinkle removal step (S700) of removing wrinkles from clothes during a predetermined total wrinkle removal process time P3. In the wrinkle removal step (S700), the blowing fan 226 may rotate at a fourth rotation speed. The wrinkle removing step (S700) may be subdivided according to the mode of the hanger bar 693. The control method according to the present disclosure may perform: a first wrinkle removal step (S710) of reciprocating the hanger bar 693 in the third mode during a predetermined first wrinkle removal process time P31; a second wrinkle removal step (S720) of reciprocating the hanger bar 693 in the second mode during a predetermined second wrinkle removal process time P32 after expiration of the first wrinkle removal process time P31; and a third wrinkle removal step (S730) of reciprocating the hanger bar 693 in the fourth mode during a predetermined third wrinkle removal process time P33 after expiration of the second wrinkle removal process time P32.

In the wrinkle removal step (S700), the clothes treatment apparatus 1000 may remove wrinkles from clothes, remove fine dust from clothes, increase the volume of clothes, and restore fur that has been laid down.

After expiration of the total wrinkle removal process time P3, the control method according to the present disclosure may perform a drying step (S900) of dehumidifying and heating air inside the first chamber 100 to dry clothes by operating the heat pump 230 during a predetermined drying process time P4. According to the control method according to the present disclosure, the heat pump 230 may convert humid air sucked from the first chamber 100 into high temperature and dry air and provide the high temperature and dry air to the first chamber 100. Thus, the humidity inside the first chamber 100 may be lowered so that the clothes may be dried. During the drying process time P4, the blowing fan 226 may rotate at a fifth rotation speed. The control method according to the present disclosure may drive the compressor 234 to operate the heat pump 230.

The present disclosure may be embodied in other specific forms without departing from the spirit and essential characteristics of the present disclosure. Thus, the above embodiments are to be considered in all respects as illustrative and not restrictive. The scope of the present disclosure should be determined by reasonable interpretation of the appended claims and all change which comes within the equivalent scope of the disclosure are included in the scope of the disclosure.

What is claimed is:

1. A clothes treatment apparatus comprising:

a hanger bar to hold clothes; and a driver to cause the hanger bar to reciprocate, wherein the hanger bar is configured to reciprocate with different amplitudes and periods by the driver, wherein the hanger bar is configured to reciprocate in at least one of a first mode, a second mode, and a third mode, wherein the hanger bar is configured to, in the first mode, reciprocate at a first frequency and a first amplitude, the first frequency being smaller than a resonance frequency of the driver, wherein the hanger bar is configured to, in the second mode, reciprocate at a second frequency and a second amplitude, the second frequency being greater than the resonance frequency, wherein the hanger bar is configured to, in the third mode, reciprocate at a third frequency and a third amplitude, the third frequency being between the first and second frequencies, the third amplitude being determined based on the third frequency, and the third amplitude being greater than the first amplitude and the second amplitude, and wherein the hanger bar is configured to reciprocate to include at least the third mode.

2. The clothes treatment apparatus of claim 1, wherein the third frequency is within a preset range from the resonance frequency of the driver.

3. The clothes treatment apparatus of claim 1, wherein the hanger bar is configured to reciprocate at an amplitude that varies depending on a reciprocating period of the hanger bar.

4. The clothes treatment apparatus of claim 3, wherein the hanger bar is configured to reciprocate in either a first mode or a second mode, wherein the first amplitude is determined based on the first frequency, and wherein the second amplitude is determined based on the second frequency.

5. The clothes treatment apparatus of claim 4, wherein the hanger bar is configured to reciprocate to include at least the third mode for a wrinkle removal time.

6. The clothes treatment apparatus of claim 5, wherein the hanger bar is configured to reciprocate to include one of the first mode or the second mode for the wrinkle removal time.

7. The clothes treatment apparatus of claim 6, wherein the hanger bar being configured to, in a fourth mode, reciprocate at a fourth frequency and a fourth amplitude, the fourth frequency being greater than the third frequency, and the fourth amplitude being determined based on the fourth frequency, and wherein the fourth amplitude is smaller than the first amplitude, the second amplitude, and the third amplitude, and wherein the hanger bar is configured to reciprocate to include the fourth for the wrinkle removal time.

8. The clothes treatment apparatus of claim 4, wherein the hanger bar is configured to reciprocate to include at least the third mode for a dust removal time.

9. The clothes treatment apparatus of claim 8, wherein the hanger bar is configured to reciprocate to include one of the first mode or the second mode for the dust removal time.

10. The clothes treatment apparatus of claim 4, wherein the hanger bar is configured to reciprocate to include at least the third mode for a volume time.

11. The clothes treatment apparatus of claim 10, wherein the hanger bar is configured to reciprocate to include one of the first mode or the second mode for the volume time.

12. The clothes treatment apparatus of claim 4, wherein the hanger bar is configured to reciprocate to include at least the third mode for a drying time.

13. The clothes treatment apparatus of claim 12, wherein the hanger bar is configured to reciprocate to include the second mode for the drying time.

14. The clothes treatment apparatus of claim 13, wherein the hanger bar is configured to reciprocate to include the first mode for the drying time.

15. The clothes treatment apparatus of claim 4, wherein the hanger bar is configured to reciprocate to include at least the third mode for a restoration time.

16. The clothes treatment apparatus of claim 15, wherein the hanger bar being configured to, in a fourth mode, reciprocate at a fourth frequency and a fourth amplitude, the fourth frequency being greater than the third frequency, and the fourth amplitude being determined based on the fourth frequency, and wherein the fourth amplitude is smaller than the first amplitude, the second amplitude, and the third amplitude, and wherein the hanger bar is configured to reciprocate to include the fourth mode for the restoration time.

17. The clothes treatment apparatus of claim 4, wherein the hanger bar is configured to reciprocate to include at least the third mode for a preheating time.

18. The clothes treatment apparatus of claim 4, wherein the hanger bar is configured to reciprocate in a first mode and a third mode.

19. The clothes treatment apparatus of claim 18, wherein the hanger bar is configured to reciprocate in the first and the third mode for a wrinkle removal time.

20. The clothes treatment apparatus of claim 18, wherein the hanger bar is configured to reciprocate in the first and the third mode for a drying time.

* * * * *